US012680436B2

(12) United States Patent
Weightman et al.

(10) Patent No.: US 12,680,436 B2
(45) Date of Patent: Jul. 14, 2026

(54) HYDRAULIC FRACTURING WITH MODULATING INJECTION FLOW RATE

(71) Applicant: Halliburton Energy Services, Inc., Houston, TX (US)

(72) Inventors: Glenn Howard Weightman, Duncan, OK (US); Timothy Holiman Hunter, Duncan, OK (US); Zhijie Sun, Houston, TX (US); Andrew Silas Clyburn, Duncan, OK (US); Carlos Alfredo Vallejo Gordon, Houston, TX (US); Bruce Carl Lucas, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/056,363

(22) Filed: Feb. 18, 2025

(65) Prior Publication Data

US 2026/0168367 A1 Jun. 18, 2026

Related U.S. Application Data

(63) Continuation-in-part of application No. 18/962,875, filed on Nov. 27, 2024.

(60) Provisional application No. 63/733,847, filed on Dec. 13, 2024, provisional application No. 63/690,391, filed on Sep. 4, 2024, provisional application No. 63/654,764, filed on May 31, 2024, provisional application No. 63/654,571, filed on May 31, 2024.

(51) Int. Cl.
*E21B 43/26* (2006.01)

(52) U.S. Cl.
CPC ..... *E21B 43/2607* (2020.05); *E21B 43/26* (2013.01)

(58) Field of Classification Search
CPC ..... E21B 43/2607; E21B 43/26; E21B 49/00
See application file for complete search history.

(56) References Cited

U.S. PATENT DOCUMENTS

| | | | |
|---|---|---|---|
| 1,134,197 | A | 4/1915 | Henederson |
| 2,915,122 | A | 12/1959 | Hulse |
| 5,093,811 | A | 3/1992 | Mellor et al. |
| 7,114,560 | B2 | 10/2006 | Nguyen et al. |
| 7,413,010 | B2 | 8/2008 | Blauch et al. |
| 9,581,004 | B2 | 2/2017 | Ciezobka et al. |

(Continued)

FOREIGN PATENT DOCUMENTS

CN 109564296 B 3/2021

OTHER PUBLICATIONS

Foreign Communication from Related Application—International Search Report and Written Opinion of the International Searching Authority, International Application No. PCT/US2025/023418, dated Jul. 16, 2025, 11 pages.

(Continued)

*Primary Examiner* — Brad Harcourt
(74) *Attorney, Agent, or Firm* — Conley Rose, P.C.; Rodney B. Carroll

(57) ABSTRACT

A system for hydraulic fracturing includes a pump system fluidly coupled to a wellbore; and a controller configured to estimate a natural frequency of the wellbore based on a pressure wave response from the wellbore, and control the pump system to pump fluid into the wellbore at an oscillating flow rate based on the estimated natural frequency of the wellbore.

23 Claims, 37 Drawing Sheets

(56) References Cited

U.S. PATENT DOCUMENTS

| | | | | |
|---|---|---|---|---|
| 9,879,514 | B2 | 1/2018 | Ciezobka et al. | |
| 9,982,523 | B2 | 5/2018 | Ciezobka et al. | |
| 10,018,025 | B2 | 7/2018 | Ciezobka | |
| 10,196,886 | B2 | 2/2019 | Tolman et al. | |
| 10,487,638 | B2 | 11/2019 | Ciezobka et al. | |
| 10,683,739 | B2 | 6/2020 | Nguyen et al. | |
| 11,143,005 | B2 | 10/2021 | Dusterhoft et al. | |
| 11,293,276 | B2 | 4/2022 | Searles et al. | |
| 11,352,868 | B2 | 6/2022 | Beisel et al. | |
| 11,376,058 | B2 | 7/2022 | Ward et al. | |
| 11,560,792 | B2 | 1/2023 | Zhang et al. | |
| 11,668,174 | B2 | 6/2023 | Beuterbaugh et al. | |
| 11,725,507 | B2 | 8/2023 | Gordon et al. | |
| 11,767,738 | B1 * | 9/2023 | Altammar | E21B 43/119 166/308.1 |
| 11,840,912 | B1 | 12/2023 | Weightman et al. | |
| 2004/0206494 | A1 | 10/2004 | Stephenson et al. | |
| 2007/0125543 | A1 | 6/2007 | McNeel et al. | |
| 2012/0049625 | A1 | 3/2012 | Hopwood | |
| 2014/0352954 | A1 | 12/2014 | Lakhtychkin et al. | |
| 2015/0175873 | A1 | 6/2015 | Milam et al. | |
| 2016/0281484 | A1 | 9/2016 | Lestz et al. | |
| 2017/0016433 | A1 | 1/2017 | Chong et al. | |
| 2017/0314379 | A1 | 11/2017 | Guidry | |
| 2018/0223634 | A1 * | 8/2018 | Holtz | E21B 43/2605 |
| 2018/0320514 | A1 | 11/2018 | Felkl et al. | |
| 2019/0316447 | A1 | 10/2019 | Oehring et al. | |
| 2020/0308958 | A1 | 10/2020 | Kabannik | |
| 2021/0032967 | A1 | 2/2021 | Dusterhoft et al. | |
| 2021/0140312 | A1 * | 5/2021 | Dumoit | G01V 1/133 |
| 2021/0199833 | A1 * | 7/2021 | Davies | G01V 1/30 |
| 2022/0074293 | A1 | 3/2022 | Hunter et al. | |
| 2022/0082004 | A1 | 3/2022 | Bannikov et al. | |
| 2023/0058311 | A1 | 2/2023 | Haustveit et al. | |
| 2023/0119075 | A1 | 4/2023 | Hall et al. | |
| 2023/0147476 | A1 | 5/2023 | Wheelock et al. | |
| 2023/0392482 | A1 | 12/2023 | Dusterhoft et al. | |
| 2024/0146040 | A1 | 5/2024 | Martin et al. | |

OTHER PUBLICATIONS

Specification and Drawings for U.S. Appl. No. 63/654,764, filed May 31, 2024, entitled "Data Processing for Evaluating Subsurface Conditions in a Wellbore," 532 pages.

Foreign Communication from Related Application—International Search Report and Written Opinion of the International Searching Authority, International Application No. PCT/US2024/053385, dated Feb. 20, 2025, 12 pages.

Specification and Drawings for U.S. Appl. No. 63/690,391, filed Sep. 4, 2024, entitled "Hydraulic Fracturing With Modulating Injection Flow Rate," 115 pages.

Specification and Drawings for U.S. Appl. No. 18/962,875, filed Nov. 27, 2024, entitled "Hydraulicfracturing With Modulating Injection Flow Rate," 123 pages.

Specification and Drawings for U.S. Appl. No. 18/804,708, filed Aug. 14, 2024, entitled "Monitoring Hydraulic Fracturing of a Well Using Pressure Waves," 532 pages.

Specification and Drawings for U.S. Appl. No. 63/654,571, filed May 31, 2024, entitled "Monitoring Hydraulic Fracturing of a Well Using Pressure Waves," 57 pages.

Specification and Drawings for U.S. Appl. No. 63/733,847, filed Dec. 13, 2024, entitled "Hydraulic Fracturing With Modulating Injection Flow Rate," 144 pages.

Foreign Communication from Related Application—International Search Report and Written Opinion of the International Searching Authority, International Application No. PCT/US2025/010578, dated Apr. 24, 2025 10 pages.

First Office Action dated Nov. 4, 2025. U.S. Appl. No. 18/962,875, filed Nov. 27, 2024. 28 pages.

* cited by examiner

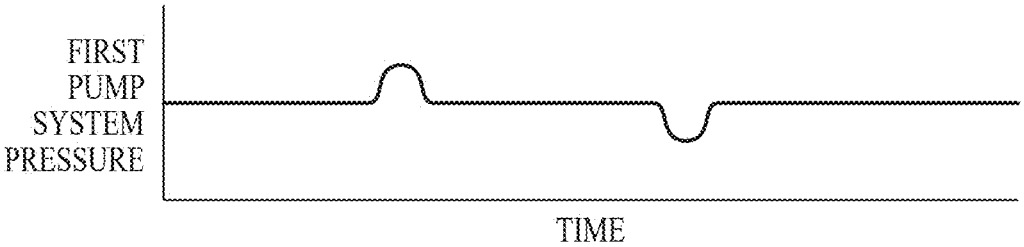
FIG. 14C1
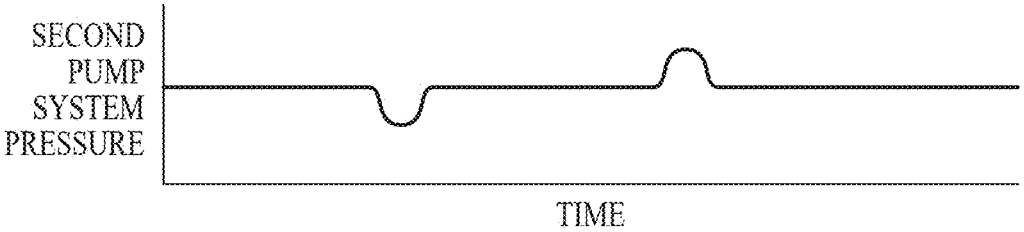
FIG. 14C2

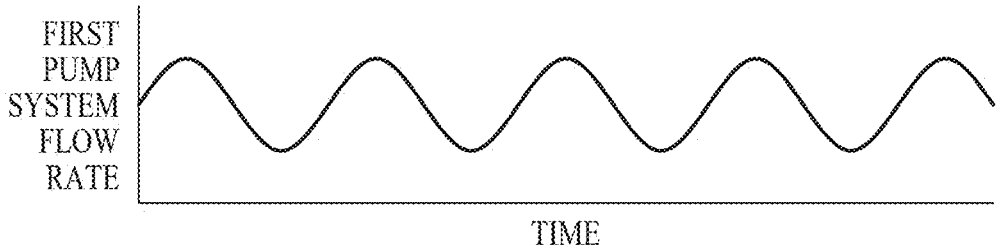
FIG. 14D1
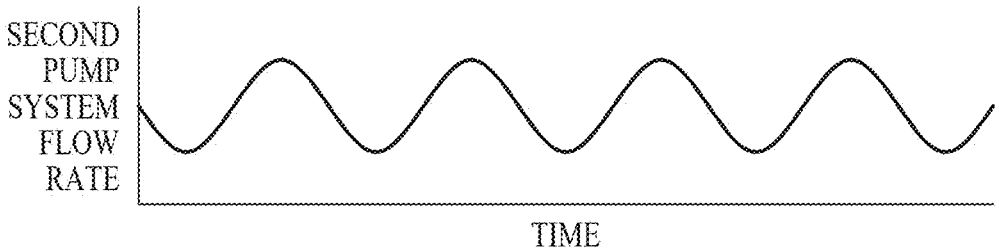
FIG. 14D2

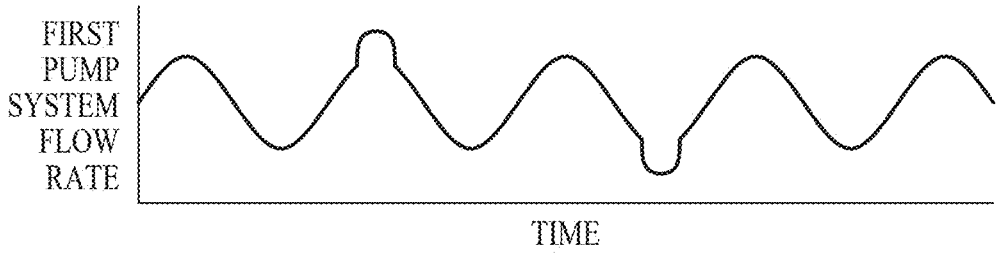
FIG. 14E1
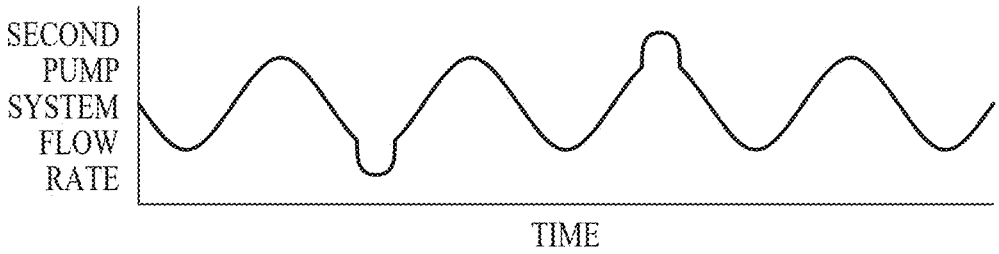
FIG. 14E2

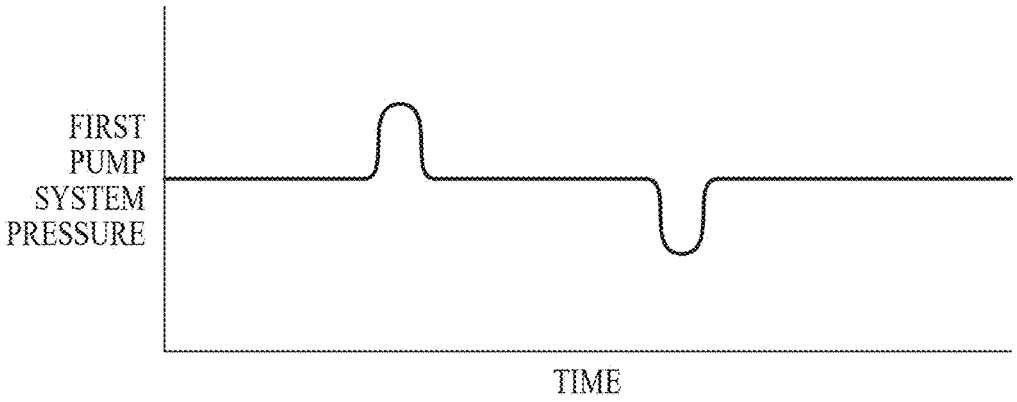
FIG. 15C1
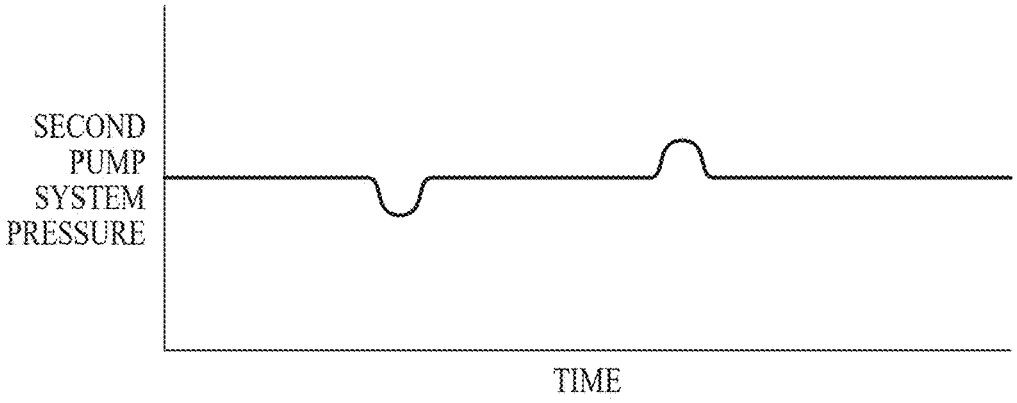
FIG. 15C2
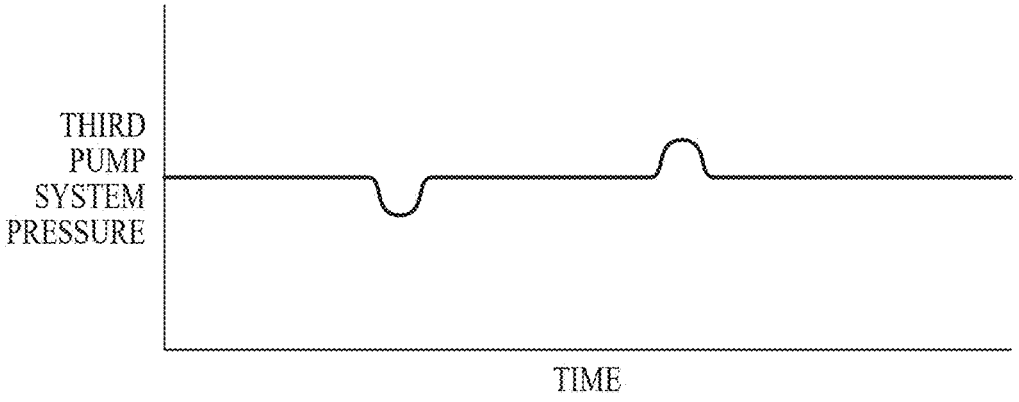
FIG. 15C3

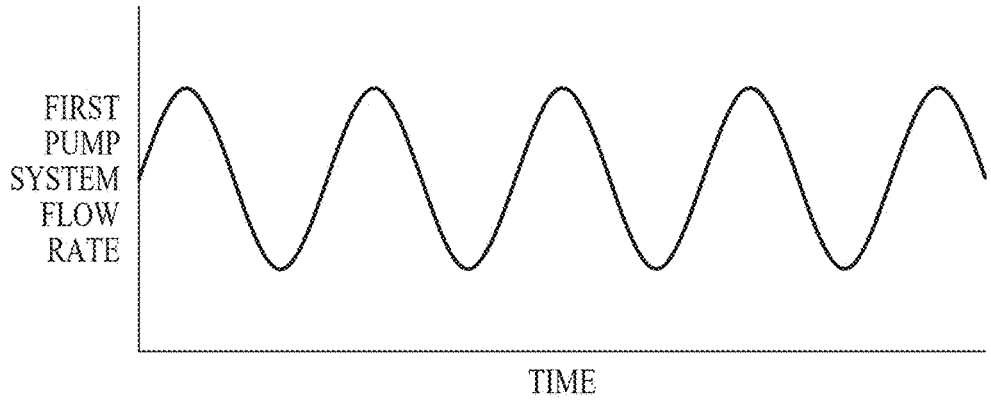
FIG. 15D1
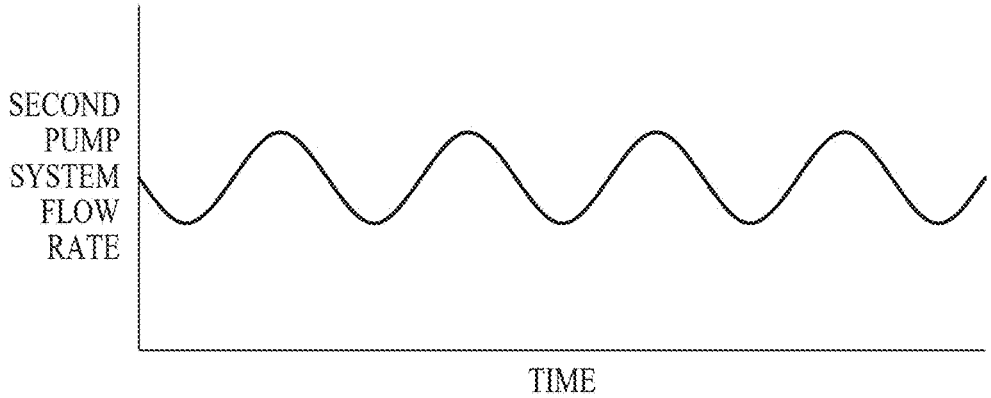
FIG. 15D2
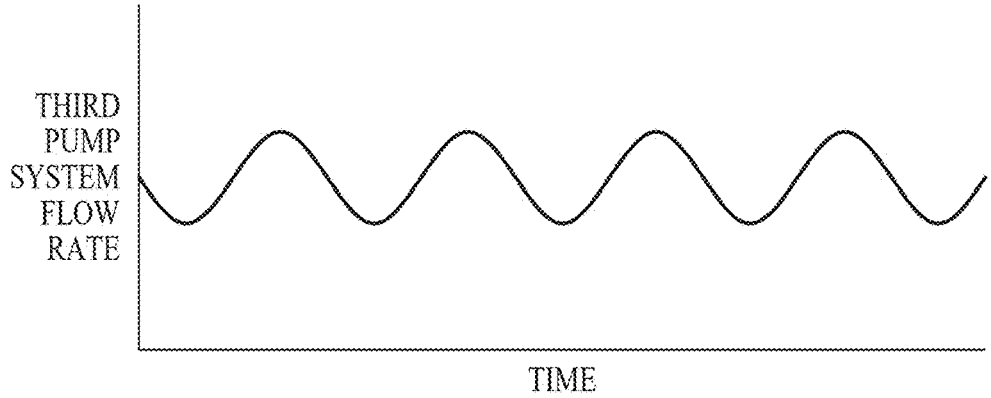
FIG. 15D3

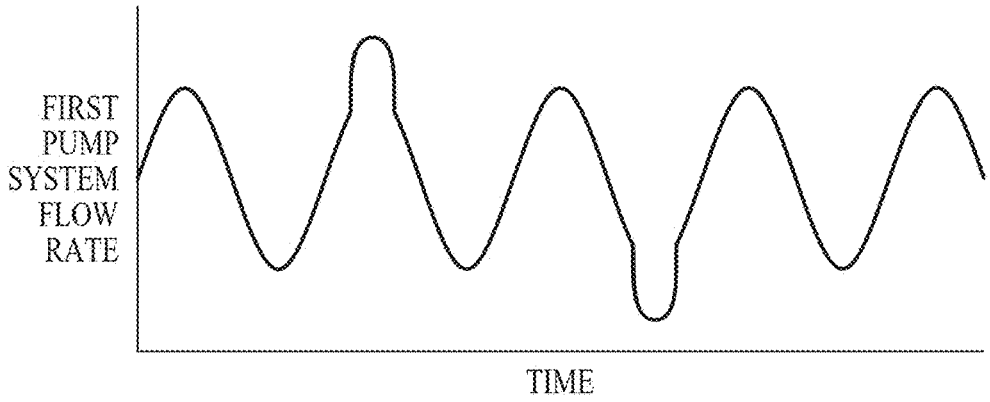
FIG. 15E1
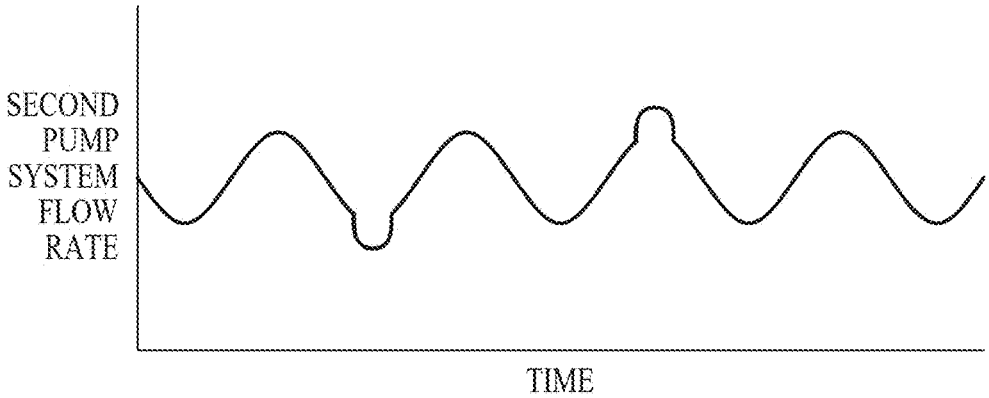
FIG. 15E2
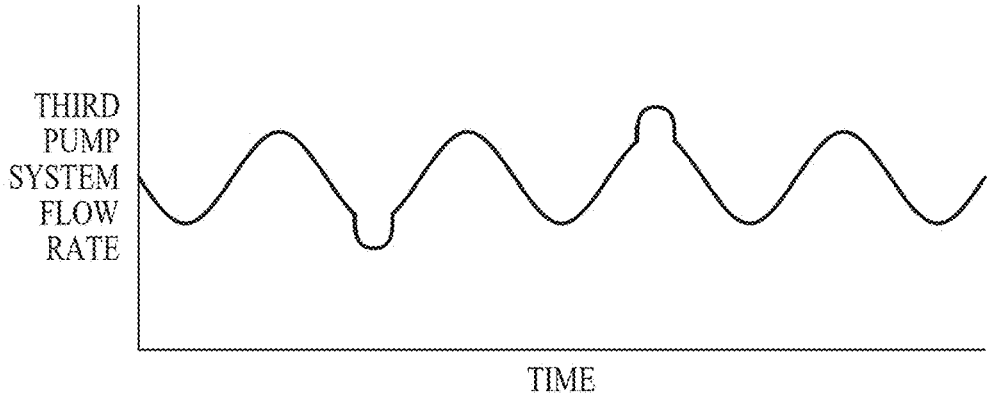
FIG. 15E3

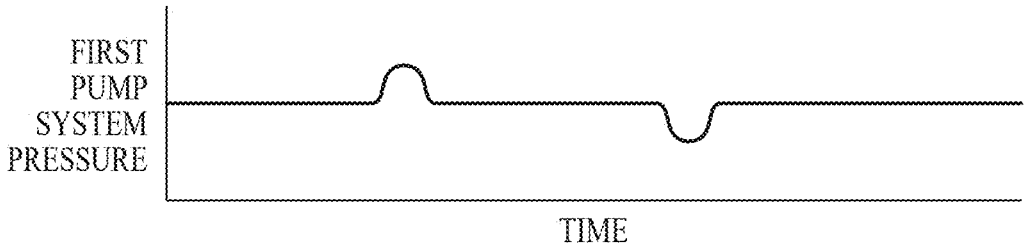
FIG. 16C1
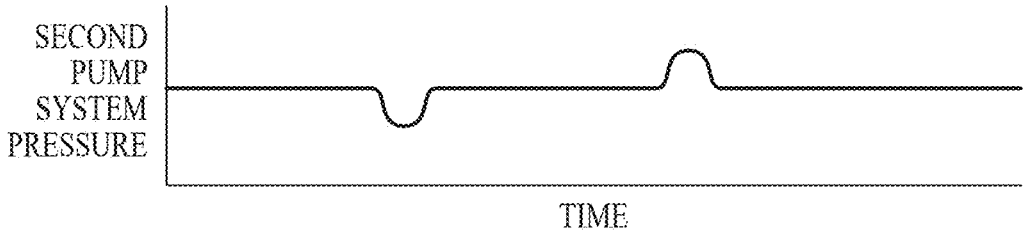
FIG. 16C2
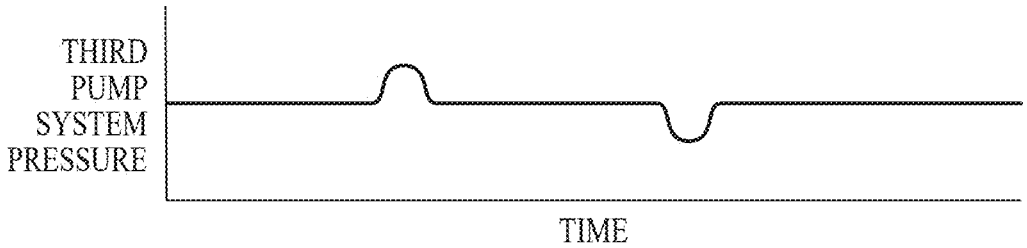
FIG. 16C3
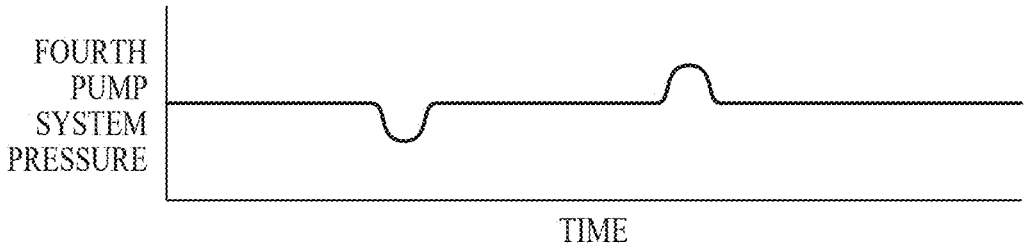
FIG. 16C4

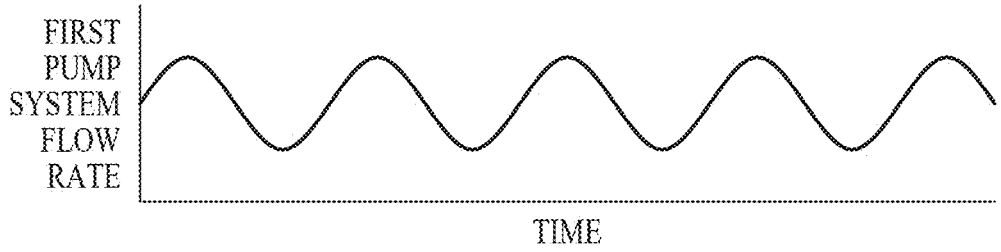
FIG. 10D1
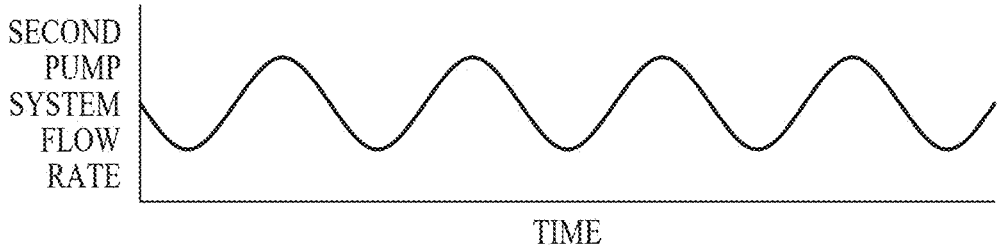
FIG. 10D2
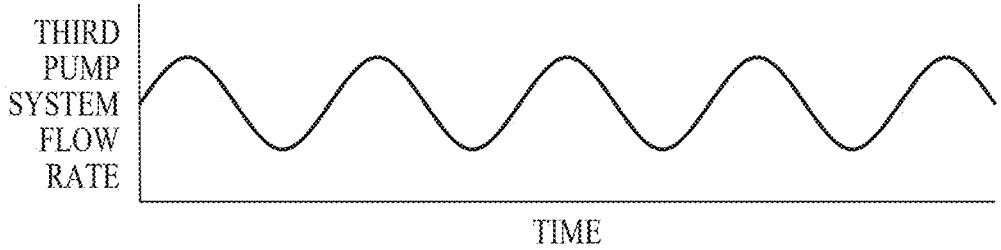
FIG. 10D3
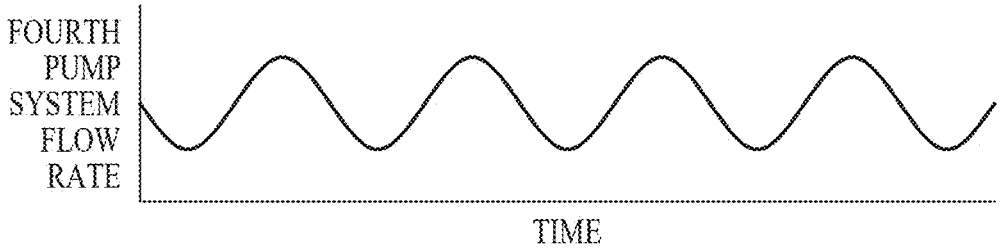
FIG. 10D4

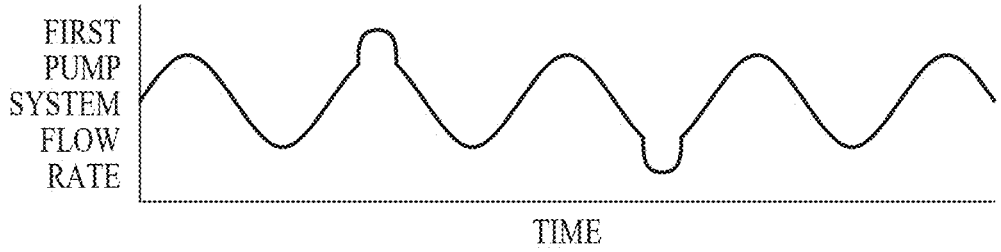
FIG. 10E1
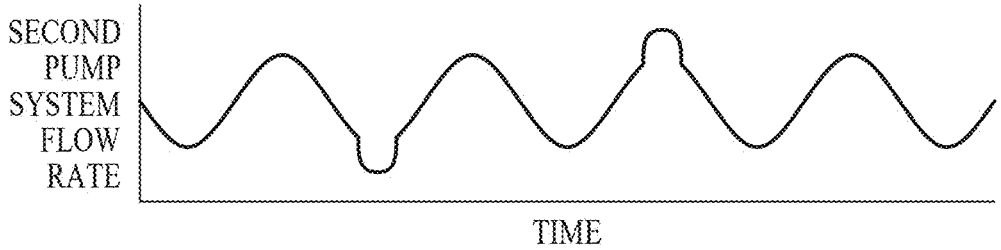
FIG. 10E2
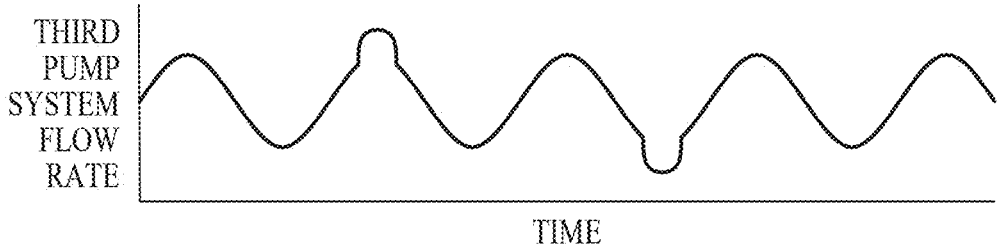
FIG. 10E3
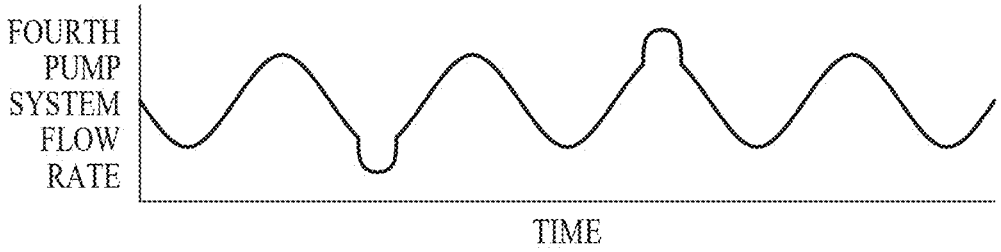
FIG. 10E4

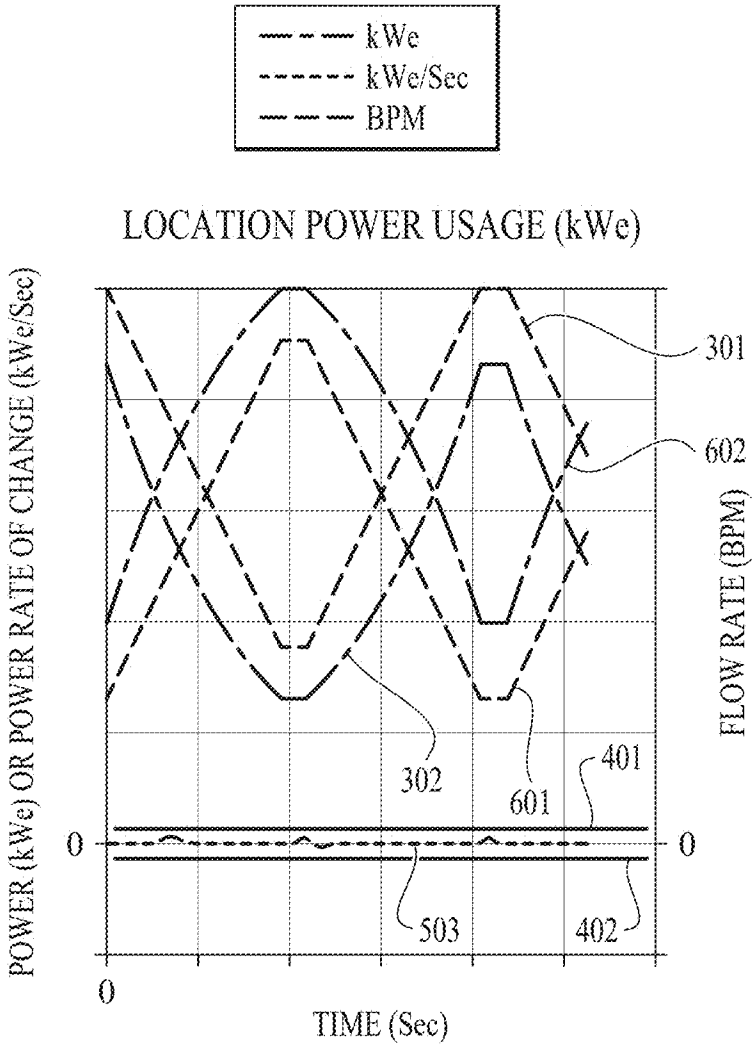
FIG. 17B1
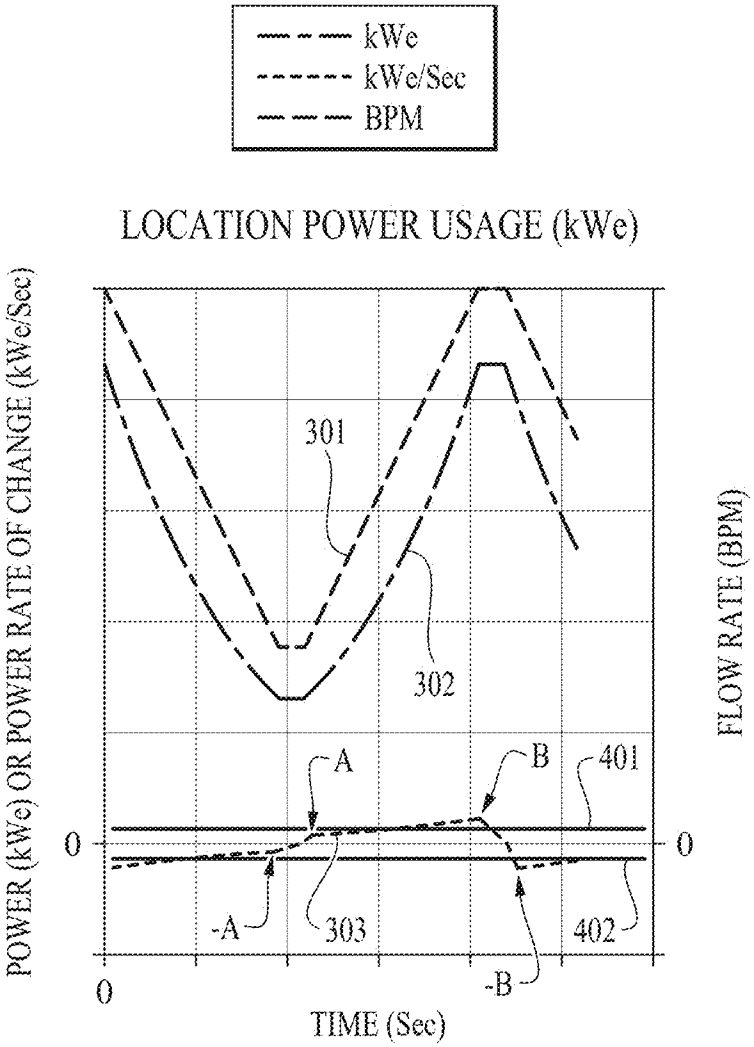
FIG. 17A1

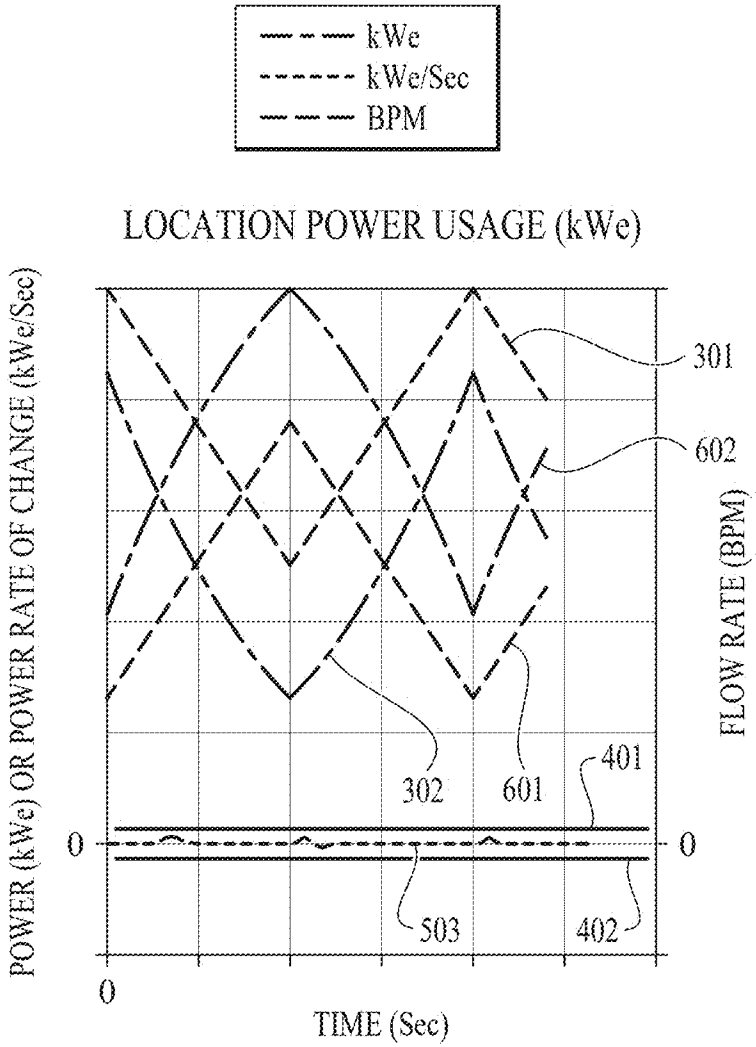
FIG. 17B2
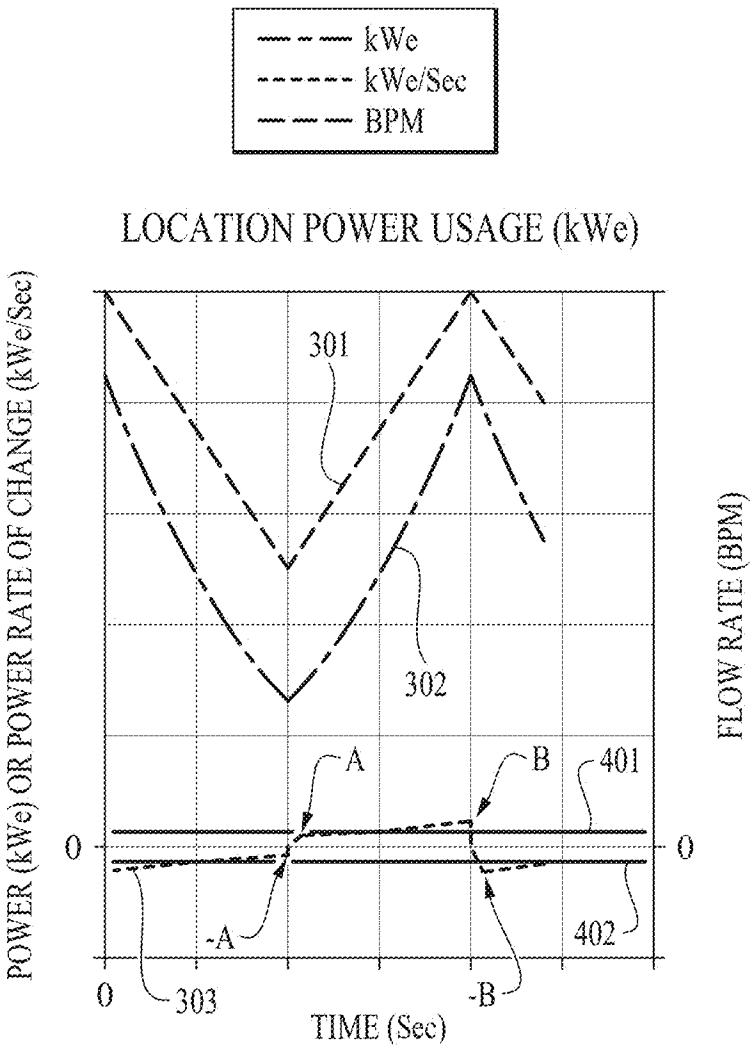
FIG. 17A2

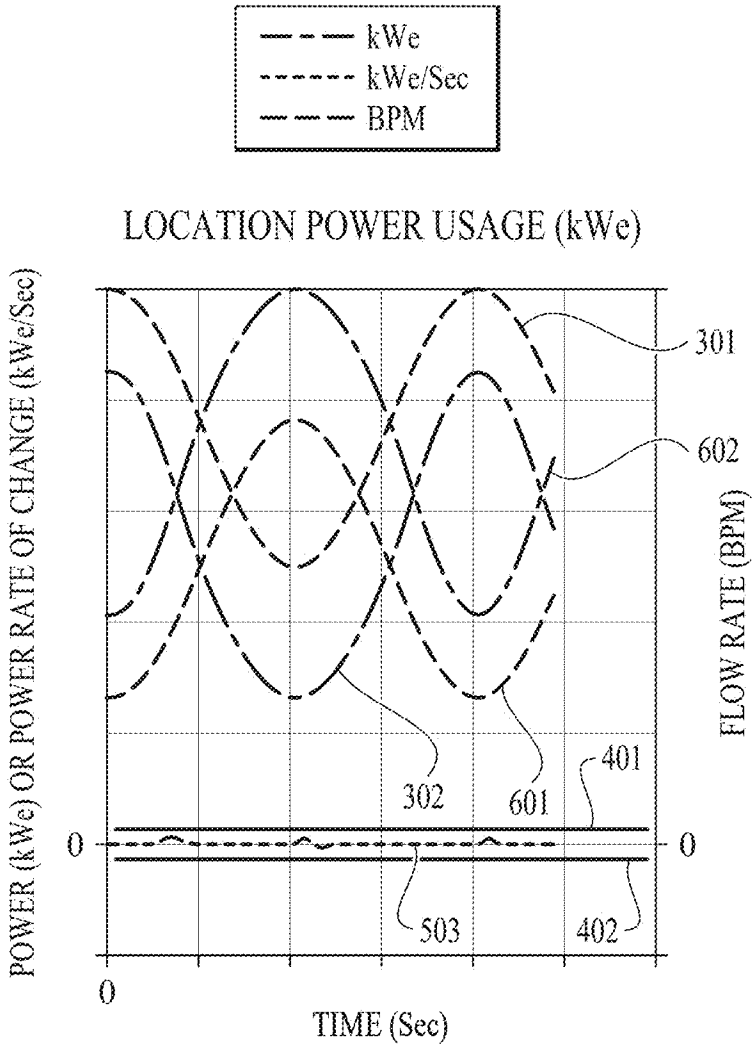
FIG. 17B3
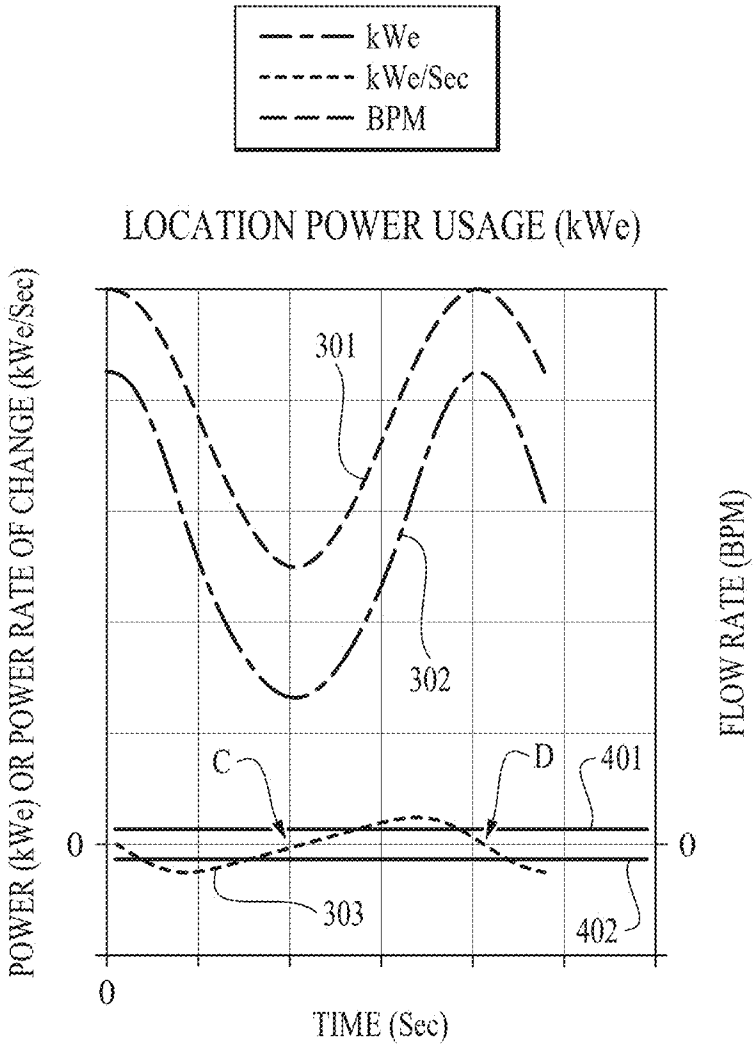
FIG. 17A3

HYDRAULIC FRACTURING WITH MODULATING INJECTION FLOW RATE

CROSS REFERENCE TO RELATED APPLICATIONS

The present application claims priority to U.S. Provisional Patent Application No. 63/733,847 filed on Dec. 13, 2024, which is hereby incorporated by reference in its entirety.

INCORPORATION BY REFERENCE

The contents of the following patents are incorporated herein by reference in their entirety: U.S. Pat. Nos. 11,346,197, 11,143,005, and 11,373,058.

BACKGROUND

Monitoring hydraulic fracturing progress can be challenging. According to the conventional art, radionuclide and microseismic monitoring have been used. However, these methods have shortcomings. For example, radionuclide monitoring may present environmental hazards due to the use of radioactive material. Microseismic monitoring may have a high degree of error.

In electric fracturing operations, sudden changes in loading, such as stopping, produce surges in the electrical supply system that may damage equipment or cause power generation equipment to shut down or fail. When the power generation or supply shuts down, an electrical blackout may occur which can take hours to rectify. With no electrical power available, the fracturing operation is not able to pump fluid, allowing any suspended materials such as proppant in the wellbore to fall out of suspension. This can result in damage to the well and may require remedial actions such as coiled tubing if the shutdowns are unplanned and proppant is in suspension. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 14C1 is a graph of an exemplary first pump system pressure over time of the simulfrac pumping operation, according to an embodiment;

FIG. 14C2 is a graph of an exemplary second pump system pressure over time of the simulfrac pumping operation, according to the embodiment of FIG. 14C1;

FIG. 14D1 is a graph of an exemplary first pump system flow rate over time of the simulfrac pumping operation, according to another embodiment;

FIG. 14D2 is a graph of an exemplary second pump system flow rate over time of the simulfrac pumping operation, according to the embodiment of FIG. 14D1;

FIG. 14E1 is a graph of an exemplary first pump system flow rate over time of the simulfrac pumping operation, according to yet another embodiment;

FIG. 14E2 is a graph of an exemplary second pump system flow rate over time of the simulfrac pumping operation, according to the embodiment of FIG. 14E1;

FIG. 15C1 is a graph of an exemplary first pump system pressure over time of the trimulfrac pumping operation, according to an embodiment;

FIG. 15C2 is a graph of an exemplary second pump system pressure over time of the trimulfrac pumping operation, according to the embodiment of FIG. 15C1;

FIG. 15C3 is a graph of an exemplary third pump system pressure over time of the trimulfrac pumping operation, according to the embodiment of FIG. 15C1;

FIG. 15D1 is a graph of an exemplary first pump system flow rate over time of the trimulfrac pumping operation, according to another embodiment;

FIG. 15D2 is a graph of an exemplary second pump system flow rate over time of the trimulfrac pumping operation, according to the embodiment of FIG. 15D1;

FIG. 15D3 is a graph of an exemplary third pump system flow rate over time of the trimulfrac pumping operation, according to the embodiment of FIG. 15D1;

FIG. 15E1 is a graph of an exemplary first pump system flow rate over time of the trimulfrac pumping operation, according to yet another embodiment;

FIG. 15E2 is a graph of an exemplary second pump system flow rate over time of the trimulfrac pumping operation, according to the embodiment of FIG. 15E1;

FIG. 15E3 is a graph of an exemplary third pumping system flow rate over time of the trimulfrac pumping operation, according to the embodiment of FIG. 15E1;

FIG. 16A is a schematic diagram of a quadfrac operation, according to an embodiment;

FIG. 16B is a graph of an exemplary flow rate of the quadfrac pumping operation over time, according to an embodiment;

FIG. 16C1 is a graph of an exemplary first pumping system pressure over time of the quadfrac pumping operation, according to an embodiment;

FIG. 16C2 is a graph of an exemplary second pump system pressure over time of the quadfrac pumping operation, according to the embodiment of FIG. 16C1;

FIG. 16C3 is a graph of an exemplary third pump system pressure over time of the quadfrac pumping operation, according to the embodiment of FIG. 16C1;

FIG. 16C4 is a graph of an exemplary fourth pump system pressure over time of the quadfrac pumping operation, according to the embodiment of FIG. 16C1;

FIG. 16D1 is a graph of an exemplary first pump system flow rate over time of the quadfrac pumping operation, according to another embodiment;

FIG. 16D2 is a graph of an exemplary second pump system flow rate over time of the quadfrac pumping operation, according to the embodiment of FIG. 16D1;

FIG. 16D3 is a graph of an exemplary third pump system flow rate over time of the quadfrac pumping operation, according to the embodiment of FIG. 16D1;

FIG. 16D4 is a graph of an exemplary fourth pump system flow rate over time of the quadfrac pumping operation, according to the embodiment of FIG. 16D1;

FIG. 16E1 is a graph of an exemplary first pump system flow rate over time of the quadfrac pumping operation, according to yet another embodiment;

FIG. 16E2 is a graph of an exemplary second pump system flow rate over time of the quadfrac pumping system, according to the embodiment of FIG. 16E1;

FIG. 16E3 is a graph of an exemplary third pump system flow rate over time of the quadfrac pumping system according to the embodiment of FIG. 16E1;

FIG. 16E4 is a graph of an exemplary fourth pump system flow rate over time of the quadfrac pumping system, according to the embodiment of FIG. 16E1;

FIG. 17A1 is a graph of an exemplary power usage over time of a frac operation, according to an embodiment;

FIG. 17B1 is a graph of an exemplary power usage over time of a simulfrac operation, according to an embodiment;

FIG. 17A2 is a graph of an exemplary power usage over time of a frac operation, according to an embodiment;

FIG. 17B2 is a graph of an exemplary power usage over time of a simulfrac operation, according to an embodiment;

FIG. 17A3 is a graph of an exemplary power usage over time of a frac operation, according to an embodiment;

FIG. 17B3 is a graph of an exemplary power usage over time of a simulfrac operation, according to an embodiment;

DETAILED DESCRIPTION

Figure 1:
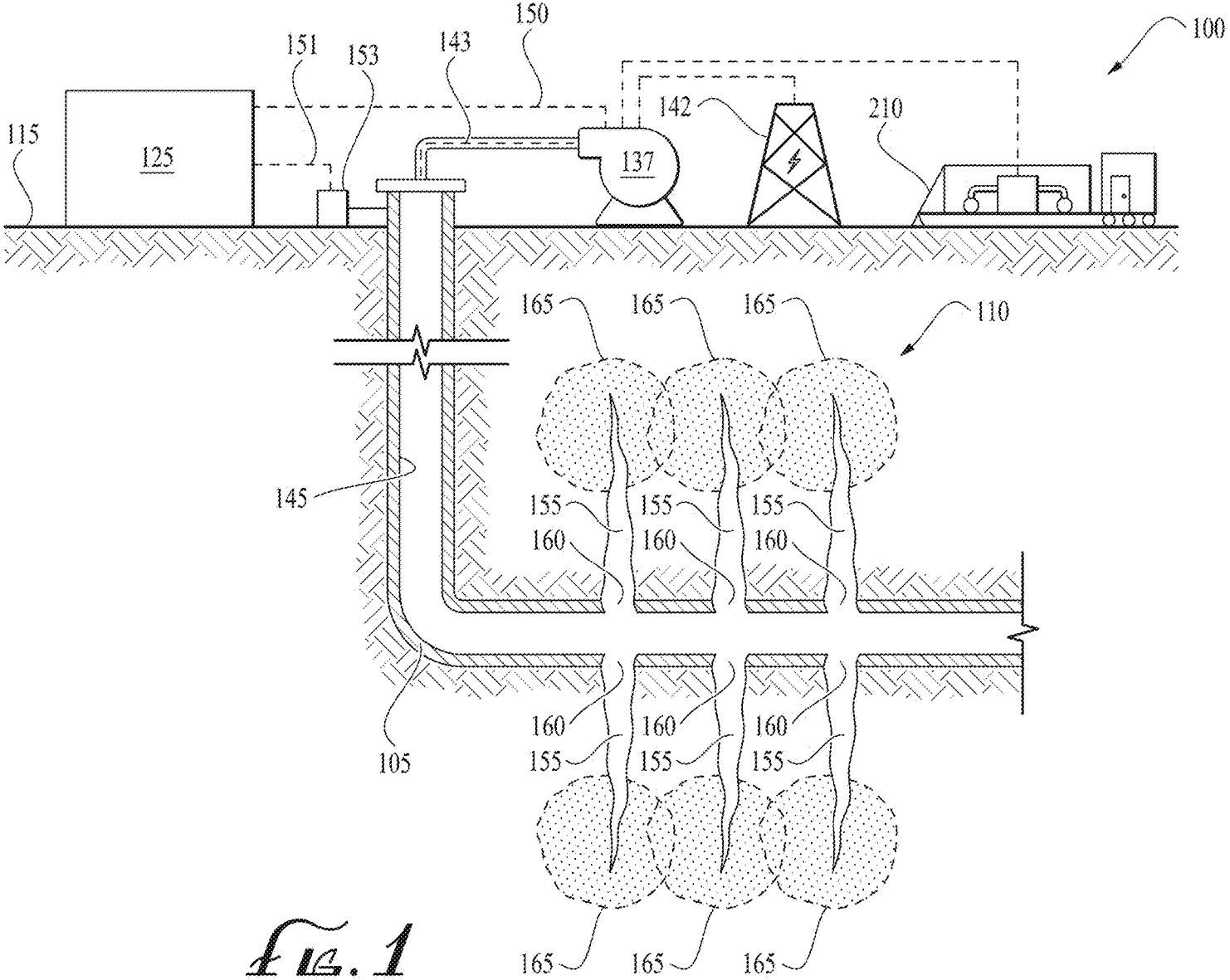
FIG. 1 is a schematic diagram of an exemplary well system, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

The present disclosure is related to equipment and methods to induce pressure pulses by means of fluid flow modulation. Such pulses can be used for well bore and formation diagnostics. Other forms of fluid flow profiles can also be generated through various modulation schemes. Pressure pulse modulation may be analyzed to help better understand wellbore and formation characteristics. Equipment for generating the pulses may be configured and controlled to generate the desired flow and/or pressure profiles. Diagnostics can provide insights into stimulation effectiveness.

Pressure in a well is a function of fluid flow rate since the well acts as a variable restriction. Fluid rate variations into a well bore can be used to generate various pressure responses which can be used to help determine characteristics of the well bore and surrounding formations. Such pressure waves can be initiated by surface pumping equipment including electrical power generation units, well servicing pumps, blenders, manifolding, flow-pulsing devices, and/or flow-control devices. A single pump may be used, or a plurality of pumps can be used to further expand flow/pressure pulsing and/or modulation capabilities. In some embodiments, other responses can be detected, such as seismic, acoustic, and/or any other types of responses that are caused by the pressure wave input through the fluid in the wellbore.

FIG. 1 illustrates an exemplary well system 100. The well system 100 may include a wellbore 105 in a subterranean formation 110 beneath a ground surface 115. The wellbore 105 may include a horizontal wellbore. The well system may include any combination of horizontal, vertical, slant, curved, and/or other wellbore orientations. Additionally, wellbore 105 may be disposed or positioned in a subsea environment. The well system 100 may include one or more additional treatment wells, observation wells, or other types of wells. A processor 125 be located at the wellbore 105 or at another location. The processor 125 may be or may be part of a controller, a computer, a control station, or any other apparatus designed to receive, processes, and output information. The processor 125 may be located at a data processing center, a computing facility, or another suitable location.

The subterranean formation 110 may include a reservoir that contains hydrocarbon resources, such as oil, natural gas, or others. For example, the subterranean formation 110 may include all or part of a rock formation (for example, shale, coal, sandstone, granite, or others) that contains natural gas. The subterranean formation 110 may include naturally fractured rock or natural rock formations that are not fractured to a significant degree. In one or more embodiments, the subterranean formation 110 may include tight gas formations that include low permeability rock (for example, shale, coal, or others).

The well system 100 may comprise a pump system 137. The pump system 137 may be used to perform an injection treatment, whereby fluid is injected into the subterranean formation 110 through the wellbore 105. In some embodiments, the injection treatment may fracture and/or stimulate part of a rock formation or other materials in the subterranean formation 110. In such embodiments, fracturing the rock may increase the surface area of the formation, which may increase the rate at which the formation conducts fluid resources to the wellbore 105. For example, a fracture treatment may augment the effective permeability of the rock by creating high permeability flow paths that permit native fluids (for example, hydrocarbons) to flow out of the reservoir rock into the fracture and flow through the reservoir to the wellbore 105. The processor 125 may utilize selective fracture valve control, information on stress fields around hydraulic fractures, real time fracture mapping, real time fracturing pressure interpretation, and/or combinations thereof to control the pump system 137 to achieve desirable complex fracture geometries in the subterranean formation 110.

The pump system 137 may inject a treatment fluid into the subterranean formation 110 from the wellbore 105. The pump system 137 may comprise one or more electrically driven pumps and/or one or more engine (e.g., gas) driven pumps. The pump system 137 may be disposed on a truck. The pump system 137 may apply injection treatments that include, for example, a multi-stage fracturing treatment, a single-stage fracture treatment, a mini-fracture test treatment, a follow-on fracture treatment, a re-fracture treatment, a final fracture treatment, other types of fracture treatments, and/or any combination thereof. The pump system 137 may be one of multiple pump systems configured to collectively execute the injection treatment.

In some embodiments, the pump system 137 may have any suitable range of revolutions per minute and may not require the use of a transmission. The pump system 137 may be manually operated, controlled by the processor 125, and/or combinations thereof. The pump system 137 may inject fluid 143 into the wellbore 105 at or near the level of the ground surface 115. The fluid 143 may be pumped through the wellbore 105 from the ground surface 115 level by a conduit 145 installed in the wellbore 105. The conduit 145 may include casing cemented to the wall of the wellbore 105. In some embodiments, all or a portion of the wellbore 105 may be left open, without casing. The conduit 145 may include a working string, coiled tubing, sectioned pipe, and/or other types of conduit.

The processor 125 may be disposed on an instrument truck, for example, a mobile vehicle, an immobile installation, or any other suitable structure. The processor may be a controller, for example, that controls and/or monitors the injection treatment applied by the pump system 137. The processor may be any type of computer, digital system, and/or analog system. The processor 125 may be in communication with the pump system 137 via a communication link 150. The communications link 150 may comprise a direct or indirect, wired or wireless connection. In some embodiments, the communication link 150 allows the processor 125 to communicate with the pump system 137. In some embodiments, the communication link 150 allows the processor 125 to communicate with other equipment at the ground surface 115.

A sensor 153 may be disposed at the surface 115. Additional sensor(s) may be disposed downhole. The sensor 153 may measure pressure. The sensor 153 may be a discreet sensor or it may be a continuous sensor, such as a fiber optic sensing system. In some embodiments, the sensor 153 and/or other sensors may measure pressure, flow rate, fluid density, temperature, and/or other parameters of treatment and/or production. For example, the sensor 153 may include one or more pressure meters or other equipment that measures the pressure of fluid 143 in the wellbore 105 at or near the ground surface 115 and/or at other locations such as downhole. In some embodiments, a communication link 151 allows the sensor 153 to send data to and/or communicate with the processor 125. The sensor 153 may be located at or near the well head. The sensor 153 may be a surface gauge. In some embodiments, the sensor 153 is a fiber optic system (e.g., distributed acoustic sensor) distributed through the well.

Hydraulic pressure by the pump system 137 may fracture the subterranean formation 110. The one or more fractures 155 may include one or more fractures of any length, shape, geometry or aperture, that extend from one or more perforations 160 along the wellbore 105 in any direction or orientation. The one or more fractures 155 may be formed by one or more hydraulic injections at multiple stages or intervals, at different times or simultaneously. The one or more fractures 155 may extend from the wellbore 105 and terminate in the subterranean formation 110. The one or more fractures 155 may extend through one or more regions that include one or more natural fracture networks 165, one or more regions of un-fractured rock, or both. In the illustrated embodiment, the one or more fractures 155 may intersect the one or more natural fracture networks 165.

The processor 125 may be configured to control the pump system 137, wherein the processor 125 may be programmed with a suitable algorithm, software application and/or one or more executable instructions to modulate the injection rate during a hydraulic fracture treatment to control one or more aspects of fracture growth. The processor 125 may instruct the pump system 137 to adjust or alter the injection flow rate to effectively produce simple and planar fracture growth and/or complex and branched fracture growth.

Multiple methods can be used to generate pressure waves during wellbore treatments. These methods may include, but not limited to, pump valve manipulation, omitted pump valves, selectable pump by-pass circuits, pump unloading devices, and pump rate modulation. Pump flow rate modulation can include changing parameters such as discharge flow rate, ramp-rate (the rate at which flow rate is changed) and/or starting/stopping of pumps. For example, the flow rate of the pump system 137 may be modulated to generate a pressure wave inside the wellbore 105.

In some embodiments, a dedicated pulsing device is used. The dedicated pulsing device can also be used in conjunction with the pump system 137 to modulate flow/pressure. Similarly, the pump system 137 pumps may have specialized valves and/or plungers to generate pulsing flow. In some embodiments, the flow rate changes are near-instantaneous. In some embodiments, the flow rate changes take place over several minutes. The faster the change, the more drastic the related pressure pulse may be. Sharp, near-instantaneous pressure pulses can be used for diagnostic methods. Longer flow rate modulation may be used to interact with a formation. In some embodiments, the pump system 137 may output a pressure wave at the natural frequency of the formation 110. In some embodiments, diversion aids are used to close off portions of the well bore that is taking fluid. Diversion materials can include viscous liquids, granular or shaped solids (such as perforation ball sealers).

There may be continuously variable rate changes to follow a desired flow/pressure profile. The flow/pressure profile may range from very simple linear ramped rate changes to complex geometric forms. In some embodiments, the pump system 137 does not stop but only changes rate. The more abruptly the flow rate of the pump system 137 changes, the stronger the pressure inflection that can be generated. Some pump types can start and stop more quickly than others. For instance, engine-driven pumps can often stop more quickly than electrically driven pumps. Therefore, engine driven pumps can be used to suddenly stop or change flow rate very rapidly to cause sharp pressure waves even to the point of causing a "water-hammer." Electric pumping units may have the advantage of being able to generate virtually infinitely-variable flow rate within their rate capability ranges. This is in contrast to engine-driven pumps that may have to shift transmission ranges to move from one flowrate to another.

Figure 2:
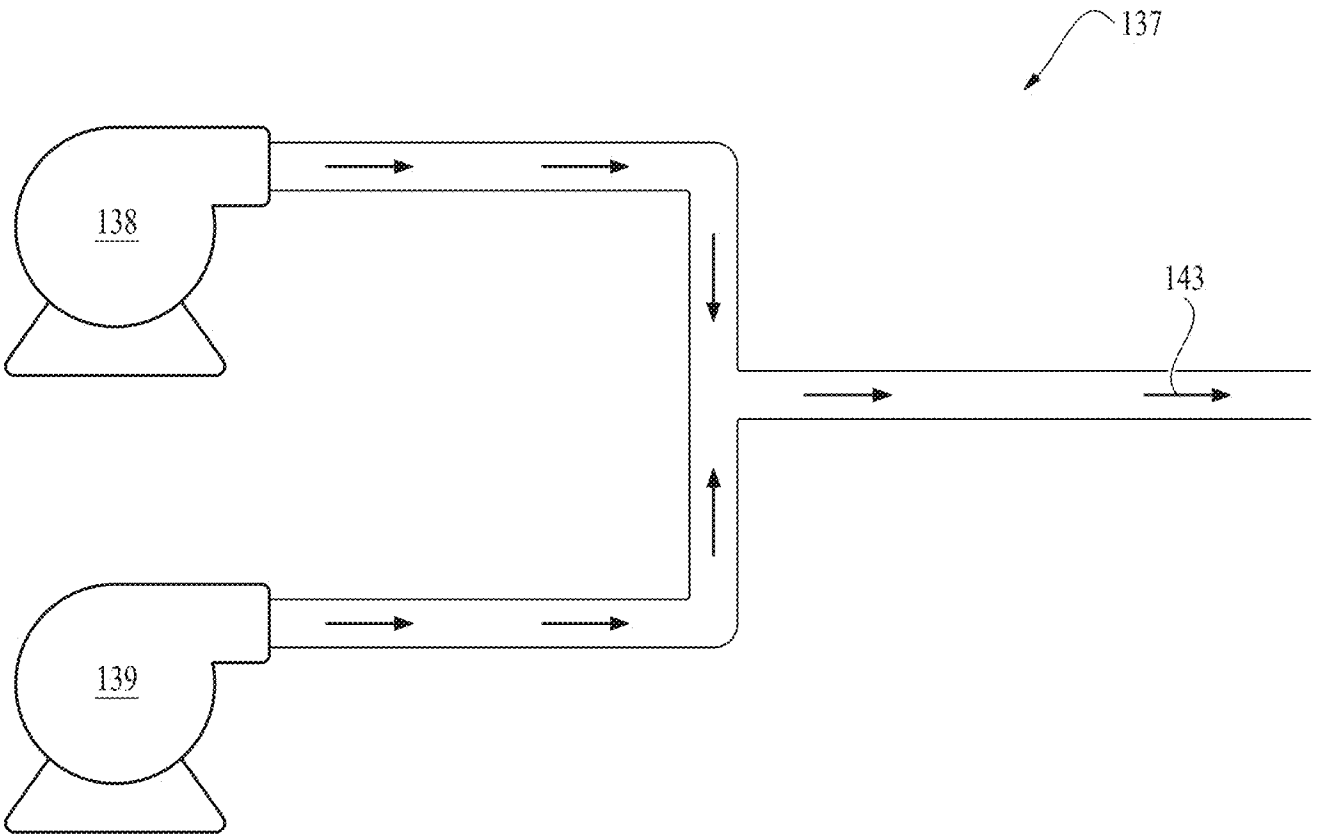
FIG. 2 is a schematic diagram of an exemplary pump system, according to an embodiment.

In some embodiments, combinations of electrically driven pumps and engine-driven pumps can be used to gain the benefits of both quick inflections and higher rangeability without shifting gears. For example, FIG. 2 shows the pump system 137, which may comprise an electrically driven pump 138 and an engine driven pump 139. The pumps 138,139 may be fluidly coupled in parallel and may be in fluid communication with the wellbore 105. To achieve the desired flow rate, both pumps 138,139 may work together. To achieve a rapid decrease in flow rate, the engine driven pump 139 may be stopped or sharply reduced in speed. The electrically driven pump 138 may also be slowed but not to the same extent as the engine driven pump 139. The electrically driven pump 138 may vary flow rate with a smoothness and/or a complexity beyond the capability of the engine driven pump 139. The flow rate of the engine driven pump 139 may also be varied according to its capability. Stopping an electric pump too suddenly could cause the electric pump to overspeed (e.g., the pump may go over the control window) or cause a voltage will spike because the amperage is no longer being consumed. The engine driven pump 139 may have the capability to stop more suddenly than the electrically driven pump 138.

The systems and methods described herein may be used for controlling an injection treatment. For example, the injection treatment may be modified by modulating the flow rate of the treatment fluid with the pump system 137. Without limitations, the amplitude, frequency, and/or rate function may be varied to enable variable modulation. Modulating the flow rate in real-time may create a pressure response that enables pressure diagnostics that can be relied upon to improve fracture growth parameters (e.g., near the wellbore and far field growth), wellbore conditions, and/or well performance. In some embodiments, the electrically driven pump 138 may be actuated to increase or decrease the flow rate. The pressure response may be measured by the sensor 153. The diagnostics (e.g., parameters) can include perforation quality, cluster efficiency, formation connectivity, and/or number of openings.

The system for monitoring hydraulic fracturing of a well may include an apparatus (e.g., the pump system 137) that may generate a pressure wave in the wellbore 105 of the well. The pressure wave may reflect off of the formation 110 surrounding the wellbore 105 (e.g., cause a pressure response off of the formation 110). The sensor 153 may detect the reflected pressure wave (e.g., pressure response) and output a signal based on the detected pressure waves. The processor 125 may receive the signal, analyze the signal to determine a characteristic of the formation 110, and/or output the determined characteristic. A fracking operation of the well system 100 may be altered based on the determined characteristic.

In some embodiments, the apparatus may include an electrical power generator, a pump, a blender, a manifold, a flow-pulsing device, and/or a flow control device. The apparatus may include an electrically driven pump 138 and the pressure wave may be generated by modulating a flow rate output by the electrically driven pump 138. The apparatus may comprise an engine driven pump 139 and the pressure wave may be generated by modulating a flow rate output by the engine driven pump 139. The engine driven pump 139 may be disposed at a surface 115 of the well and/or the electric driven pump 138 may be disposed at the surface 115 of the well. A combined output of the engine driven pump and the electric driven pump may form the pressure wave. The pressure wave may be at a natural frequency of the formation 110. The pressure wave may be generated by modulating amplitude, frequency, phase-shift, rate-of-change flow, wave form shape, duration, and/or period. The apparatus may be disposed at a surface 115 of the well, the formation 110 may be disposed proximate to a horizontal portion of the wellbore 105, and the apparatus may be configured to fracture the formation 110. The processor 125 may be further configured to analyze the signal by comparing the signal to a model, and control a rate at which the pump injects fluid into the well based on a result of the comparison. The characteristic may be a degree of fracturing of the formation.

In some embodiments, pressure pulses may be generated for the purpose of creating a response in the formation. A return signal may be listened to and that return signal may be used to determine something about the well based on how the signal is reflected from the formation. The modulation (e.g., pressure wave) can cause a response that can be detected. The resultant signal from the modulation may be received. The liquid may be used as a communication medium (e.g., the fluid carries the signal).

Figure 3:
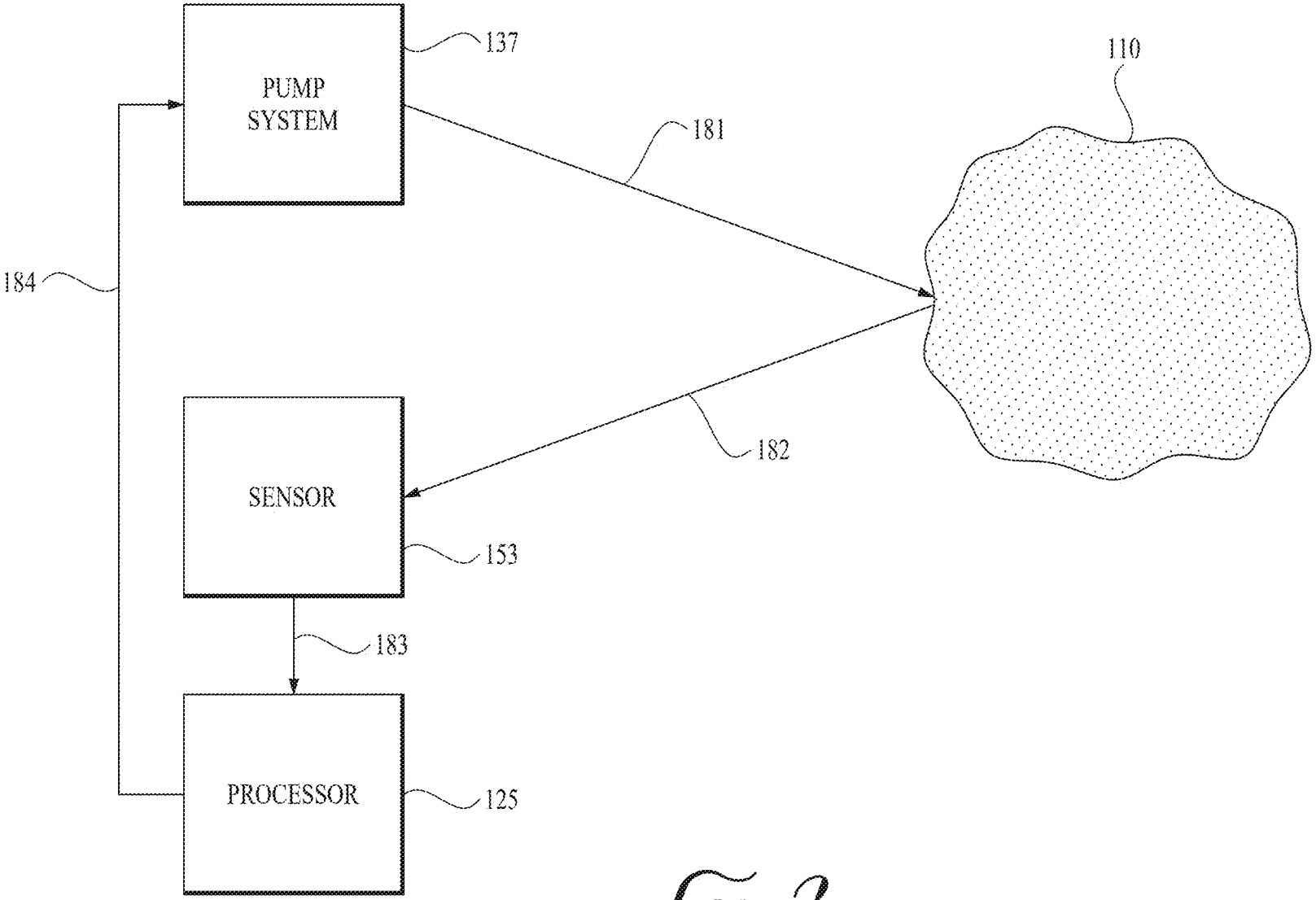
FIG. 3 is a schematic diagram of an exemplary control system, according to an embodiment.

Referring to FIG. 3, the pump system 137 may output a pressure signal 181 down the wellbore, the pressure signal 181 may interact with and/or be reflected by the formation 110, and the reflected pressure signal 182 may return up the wellbore and be detected by the sensor 153. The sensor 153 may send sensor data 183 to the processor 125, which may analyze the pressure signal and infer the state of the formation 110. For example, the processor 125 may predict a characteristic such as an extent of the fracture, a change in fracture length or size, permeability or change of permeability in the formation 110, and/or any other discernable characteristic of the formation 110. The processor 125 may send that characteristic information to a display where a technician may base a decision (e.g., regarding injection pressure or flow rate) on the characteristic information. For example, the technician may determine that the fracture is not large enough and decide to increase pressure or flow rate of the pump system 137. Or, the technician may see that the degree of fracturing is sufficient and halt the fracking operation (i.e., shut down the pumps). Alternatively, any of these processes may be automated by the processor 125. For example, the processor 125 may compare the fracturing characteristic to a threshold. In response to determining that the fracturing characteristic exceeds the threshold, the processor 125 may send a control signal 184 to the pump system 137 to halt the fracking operation (e.g., to shut down the pump and/or stop flow from the pump). In some embodiments, in response to determining that the fracturing characteristic falls below a threshold, the processor 125 may send a control signal 184 to the pump system 137 to increase pressure and/or flow rate (e.g., amplitude of the pressure signal and/or flow rate signal). The threshold may be a floating threshold that changes with time according to a fracking program.

In some embodiments, the processor 125 may determine cluster efficiency of the perforations 160 (e.g., what percentage of them are open) based on the reflected pressure signal 182. The pump system 137 may be controlled based on the cluster efficiency. For example, the processor 125 may control the pump system 137 based on cluster efficiency values generated by a model. In some examples, a complexity factor and/or a proximity index may be determined by the processor 125. The processor 125 may control the pump system 137 based on the determined cluster efficiency, the determined complexity factor, the determined proximity index, and/or other factors.

Modulating the injection rate may be used to perform real-time pressure diagnostics regarding the wellbore 105. In some embodiments, amplitude, frequency, and/or combinations thereof of the injection rate may be varied, for example, according to an injection treatment plan, to modulate the flow rate of the pump system 137. With variability of the injection flow rate, a phase of an input function may be controlled relative to a phase of a response of the subterranean formation 110. In some embodiments, the input function to be controlled is the injection flow rate which has a given rate function that can be observed for a response in pressure.

Flow modulation may be used to create specific pressure profiles. Flow rate modulations may include starts and stops, pulses, and/or rapid changed in flowrate with respect to time (dQ/dt). Flow rate modulations may also be induced by driving pumping equipment (e.g., pump system 137) to a specified profile. Driven profiles may vary for each pumping unit. Sufficient electrical power supply may be required to accelerate electrically driven pumping units. Sharp inflections may require as much as 200-300% normally available power in order to perform quick flow rate changes. Sufficient power (either generated, supplied from the utility grid, or both) may be provided to enable the electrically driven pump 138 to change flow rates rapidly. This may require special preparation, as this may be different from typical operation where acceleration rates (i.e. ramp rates) are governed to be compatible with typical power supplies. As faster acceleration rates are desired to created higher amplitude pulse profiles, higher performance power supplies may be required to enable the rapid changes in pumping flow rate.

Pressure pulses can also be generated during shutdown of pumping units. Suddenly stopping flow into a wellbore may cause a pressure wave to propagate through the well. Engine-driven pumps can typically be stopped quickly, while electrically driven pumps can be more difficult to stop quickly without risk of damage to either electrical or mechanical components. Thus, it can be beneficial to use a combination of pumping units (e.g., one or more electrically driven pumps 138 and one or more engine driven pumps 139) depending on desired flow rate and pressure modulation profile. Total rate changes at the spread level may be created by specific timing of flow profiles between pumping units, causing them to intentionally be in- or out-of-phase, or varied to create beat-frequency-oscillations.

In some embodiments, one or more rate functions may be incorporated into an injection treatment plan monitored by the processor 125. The rate function may be the mode of rate of change or modulation. In some embodiments, the one or more rate functions may include changes in amplitude, frequency, and/or function of the change in rate. The change in function may be a near-instantaneous change in rate, a step function change in rate with a plurality of step changes, a linear function change over a time period, and/or a given mathematical function to increase or decrease flow rate over a time period. The injection rate may have a square rate function at an initial position. In some embodiments, the processor 125 (e.g., a computer subsystem) may actuate the pump system 137 to change the rate function to any other suitable rate function, such as a polynomial rate function or a linear rate function. In addition to varying the rate functions, the processor 125 (e.g., computer subsystem) may actuate the pump system 137 to vary the amplitude and/or frequency of the injection rate.

Figure 4A:
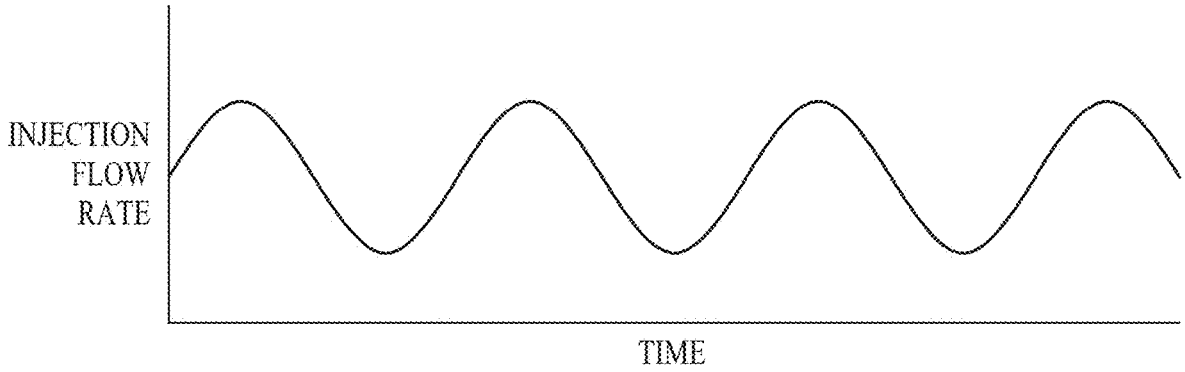
FIG. 4A is a graph of an exemplary injection flow rate, according to an embodiment.
Figure 4B:
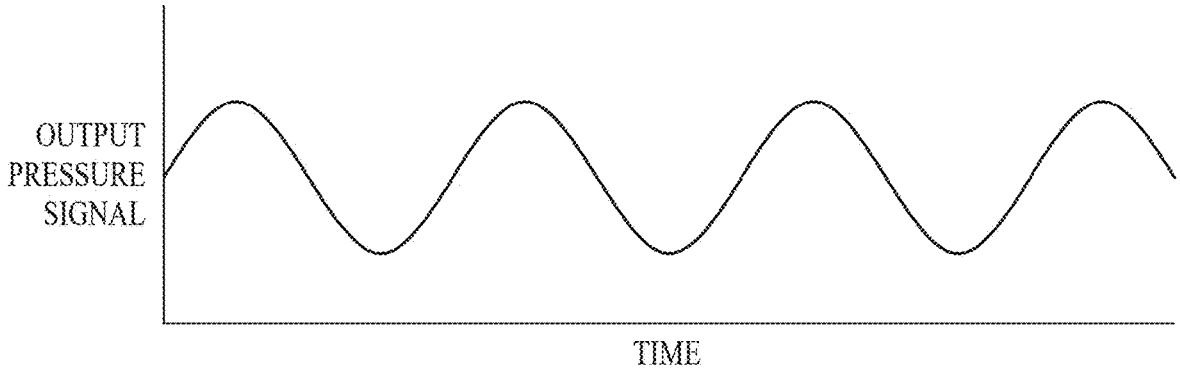
FIG. 4B is a graph of an exemplary output pressure signal, according to the embodiment of FIG. 4A.
Figure 4C:
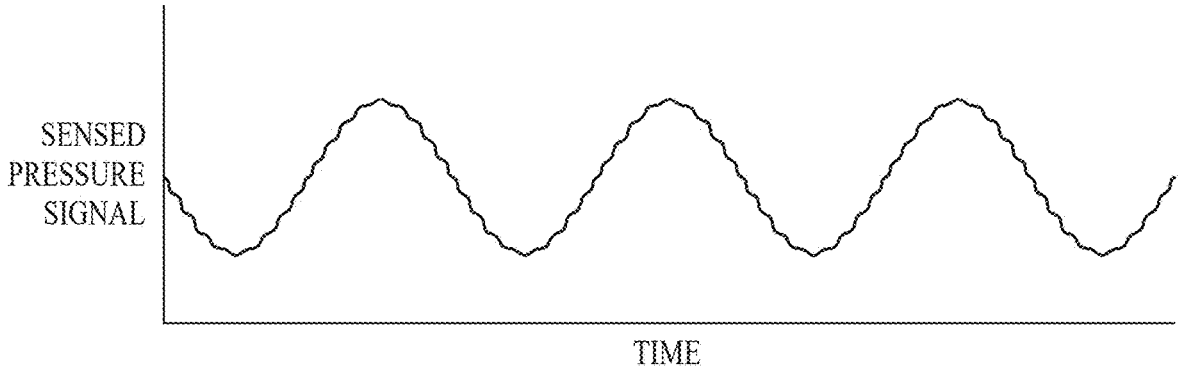
FIG. 4C is a graph of an exemplary sensed pressure signal, according to the embodiment of FIG. 4A.

FIG. 4A shows an exemplary output flow rate 180. The output flow rate may be generated by one or more electric pumps 137, flapper valves, and/or any other devices capable of modulating flow rate. FIG. 4B shows the output pressure signal 181 (as shown in FIG. 3) resulting from the modulated output flow rate 180. The output pressure signal 181 (i.e., pressure wave) may interact with the formation 110 and be reflected by it. FIG. 4C shows the reflected pressure signal 182 that is received by the sensor 183. In some embodiments, the output pressure wave 181 may be transient. For example, the output pressure wave may be last for a certain period of time and then be stopped but pumping may continue in steady state. That is, the output flow rate 180 may be oscillated and then the oscillations may stop such that the output flow rate 180 is constant. In some embodiments, the processor controls an oscillation of a flow rate of the pump to alternate between a first frequency and a second frequency, wherein the first frequency is below a natural frequency of the formation and the second frequency is above the natural frequency of the formation. In some embodiments, envelope of the oscillation increases over time. In some embodiments, an envelope of the oscillation decreases over time.

Figure 5A:
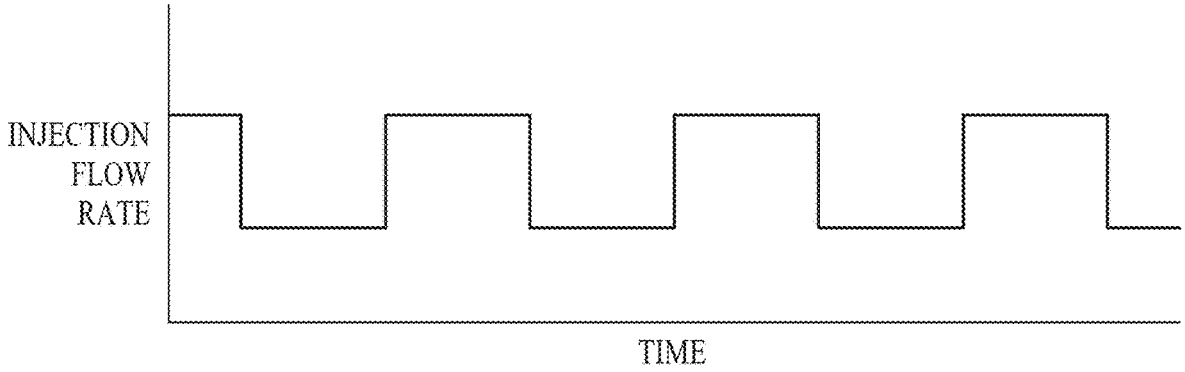
FIG. 5A is a graph of an exemplary injection flow rate according to another embodiment.
Figure 5B:
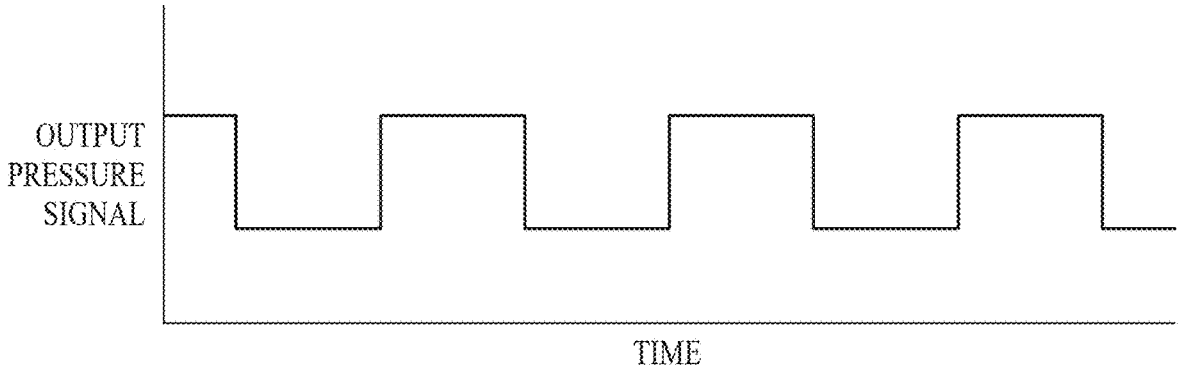
FIG. 5B is a graph of an exemplary output pressure signal according to the embodiment of FIG. 5A.
Figure 5C:
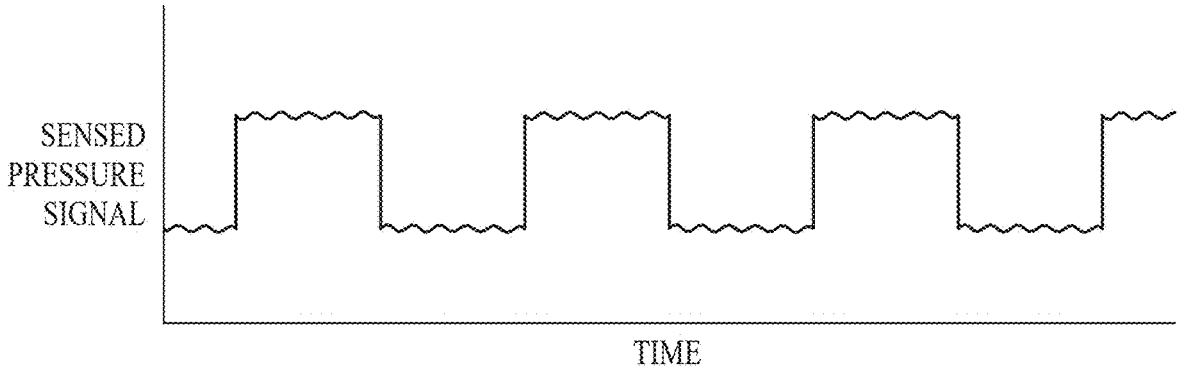
FIG. 5C is a graph of an exemplary sensed pressure signal according to the embodiment of FIG. 5A.

FIGS. 5A-5C are related to FIGS. 4A-4C except that instead of a sine wave the injection flow rate is a square wave. The rapid change in flow rate necessary to achieve a square wave or near square wave flow rate may be very difficult or impossible to achieve with conventional electric pumps. However, using a combination of electrically driven pumps 138 and engine driven pumps 139 as shown in FIG. 2 may enable such a flow rate to be achieved. The square wave may be particularly effective for making inferences about the state of the fracture based on a pressure response from the formation (e.g., the square wave being reflected off of the formation and detected by the sensor 153). In some embodiments, the processor 125 controls the electrically driven pump such that a flow rate change of the electrically driven pump causes a current consumption rate of change that is less than a maximum current rate of change the power supply is capable of providing, and controls the engine driven pump such that a flow rate change of the engine driven pump occurs concurrently with the flow rate change of the electrically driven pump.

Figure 7:
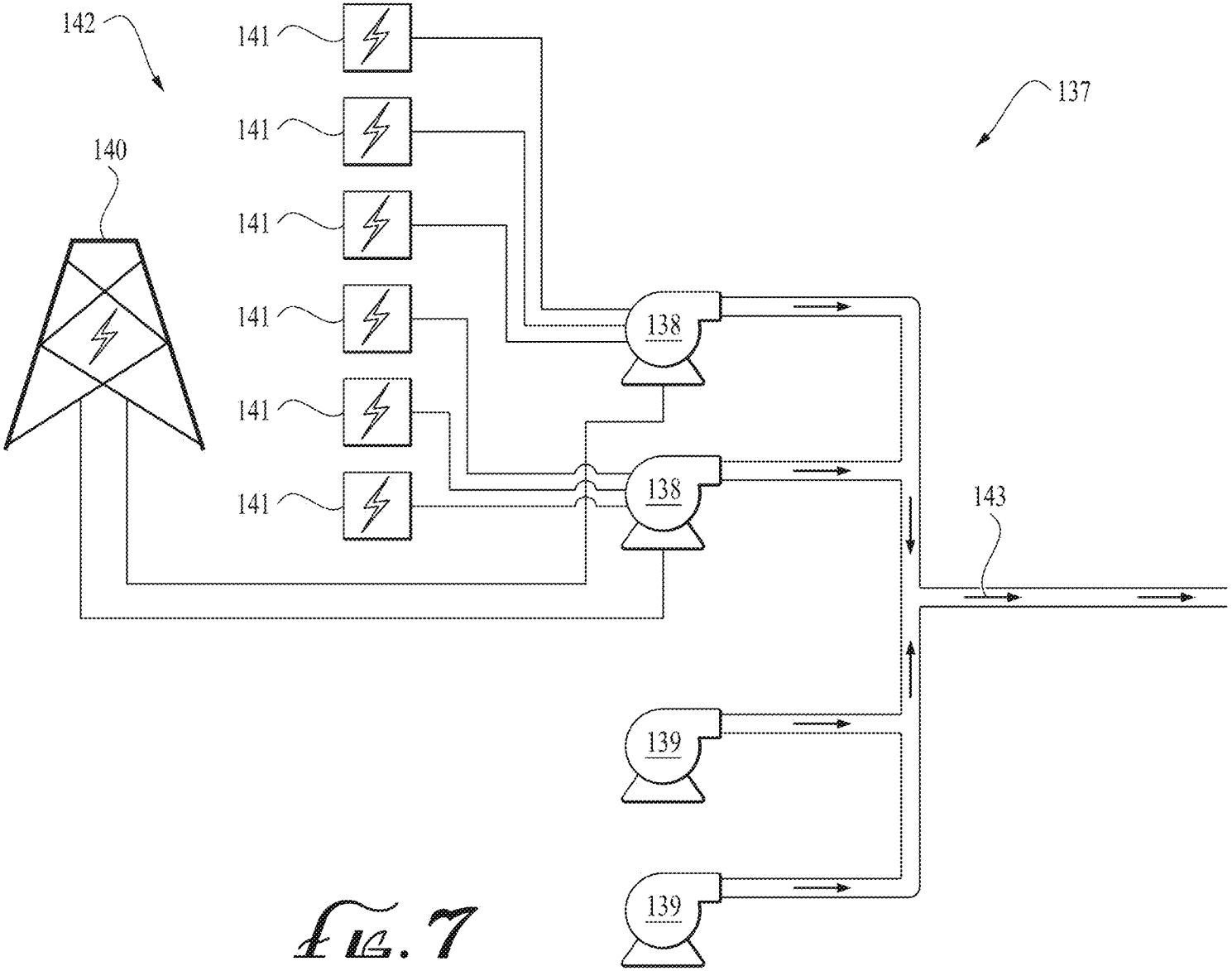
FIG. 7 is a schematic diagram of an exemplary pump system according to another embodiment.
Figure 8A:
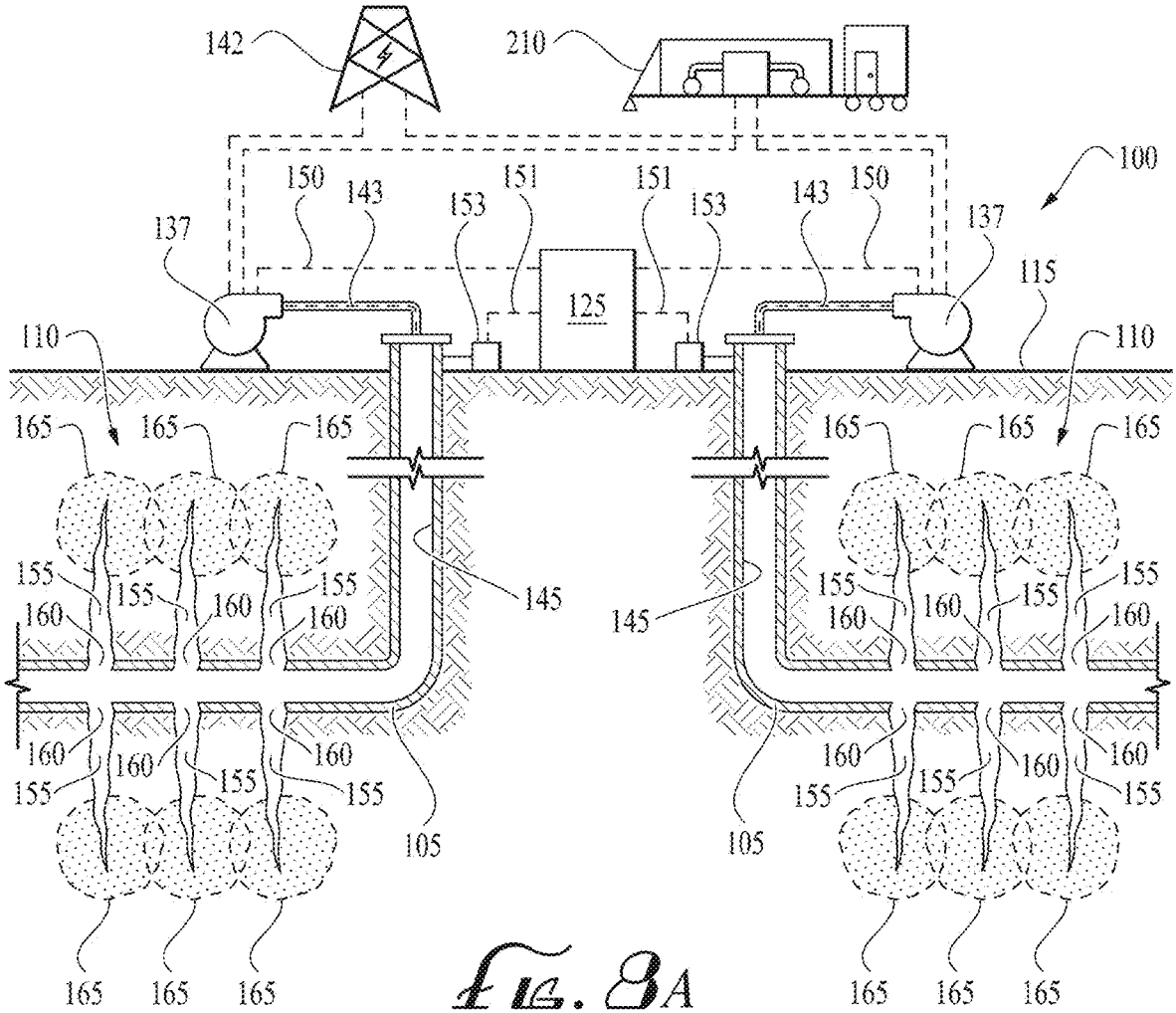
FIG. 8A is a schematic diagram of an exemplary well system according to another embodiment.
Figure 8B:
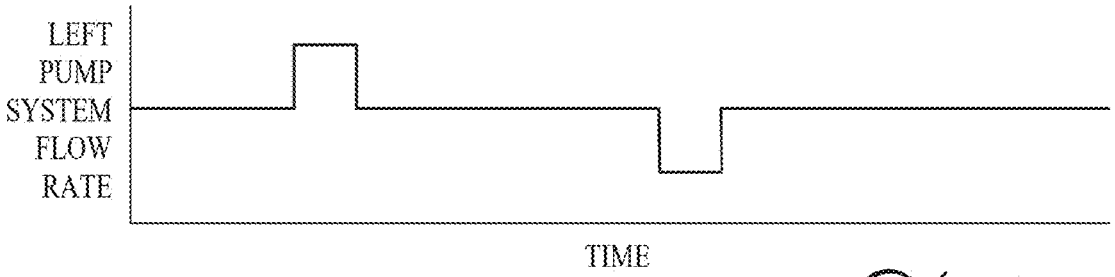
FIG. 8B is a graph of an exemplary injection flow rate of the left pump of FIG. 8A.
Figure 8C:
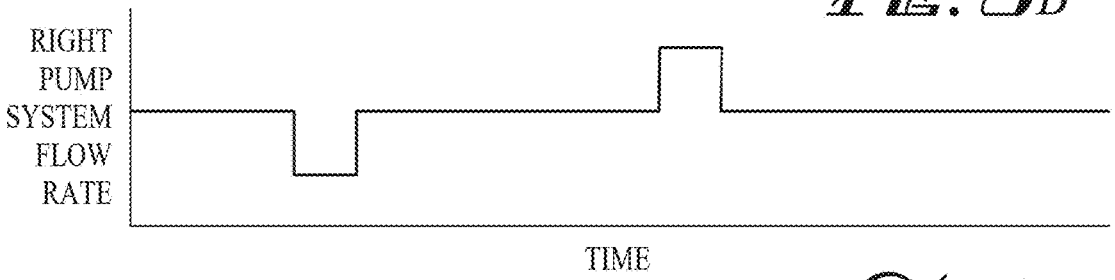
FIG. 8C is a graph of an exemplary injection flow rate of the right pump of FIG. 8A.
Figure 8D:
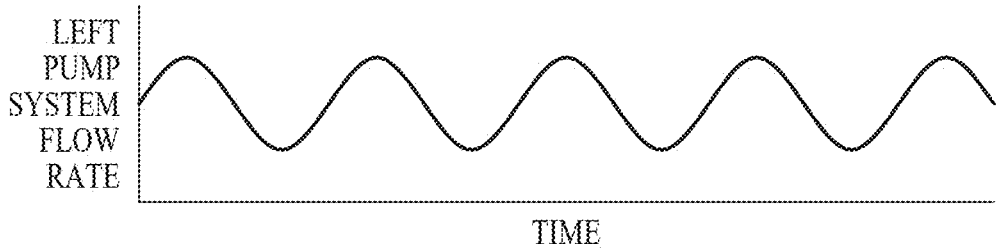
FIG. 8D is a graph of another exemplary injection flow rate of the left pump of FIG. 8A.
Figure 8E:
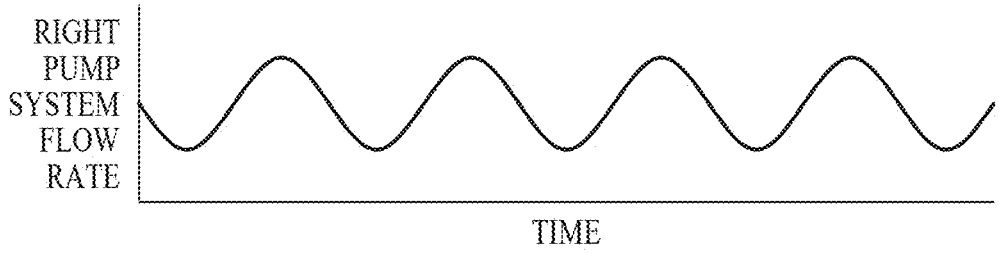
FIG. 8E is a graph of another exemplary injection flow rate of the right pump of FIG. 8A.
Figure 8F:
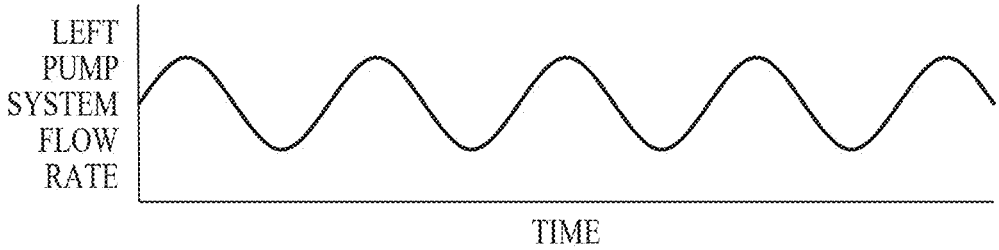
FIG. 8F is a graph of yet another exemplary injection flow rate of the left pump of FIG. 8A.
Figure 8G:
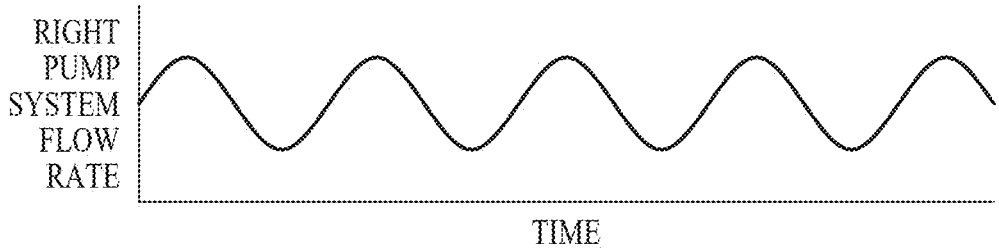
FIG. 8G is a graph of yet another exemplary injection flow rate of the right pump of FIG. 8A.

FIG. 7 shows an exemplary configuration of pumps and power supplies. There may be electric driven pumps 138 and engine driven pumps 139 fluidly coupled in parallel. Each electric driven pump 138 may be connected to multiple generators 141 (e.g., gas turbine generators). Multiple generators 141 may be provided for supplying extra power during sharp increases in flow rates executed by the electric driven pump 138. In some embodiments, the electric driven pumps 138 are also connected to a power grid 140 (e.g., a power plant). In some embodiments, the power grid 140 supplies the electric power for constant flow rates or slowly changing flow rates of the electric driven pumps 138 and the generators 141 supply power only during sharp rises in energy demand when the electric driven pumps 138 sharply increase flow rate. In some embodiments, one generator 141 supplies electric power for each electric driven pump 138 for constant flow rates and gradually changing flow rates of the electric driven pumps 138, and one or more additional generators 141 and/or the power grid 140 supplies additional power to each electric driven pump 138 when the electric driven pumps 138 sharply increase their power consumption to achieve a sharp rise in flow rate.

Although the configuration shown in FIG. 7 includes two engine driven pumps 139, two electric driven pumps 138, six generators 141, and one electric power grid 140, any number of these elements may be present and/or one or more of these elements may be absent. For example, there may be 0, 1, 2, 3, 4, 5, 6, 7, 8, 9, 10 or more electric driven pumps 138; 0, 1, 2, 3, 4, 5, 6, 7, 8, 9, 10 or more engine driven pumps 139; and/or 0, 1, 2, 3, 4, 5, 6, 7, 8, 9, 10 or more generators 141 per electric driven pump 138. The electric driven pumps 138 may additionally or alternatively draw power from multiple power grids 140 and/or other power sources. The electric power plant 140 may have ramp rate limits (e.g., kilowatts per second). The processor 125 can instruct the electric driven pumps 138 to follow a flow-rate curve, e.g., provided that at any point along the curve the electric power supply has the capability to match the power level change per second (e.g., kilowatts per second) requirement without going outside of the bounds of voltage. For example, the steepest incline may be less than the maximum capability of the electric power grid 140 and/or the generators 141 (e.g., their stiffness). To achieve a very steep increase in flow rate, multiple power supplies may be combined in any suitable manner. In some embodiments, a clutch can be used to enable an abrupt reduction in flow rate in the electric pumps 138.

Using both electric driven pumps and engine driven pumps can be advantageous. Engine driven pumps can have the advantage in that they can be stopped rapidly without sustaining damage or causing power outages, but they may not capable of outputting complex pressure waveforms. On the other hand, electric driven pumps can more quickly and precisely adjust speed and may have a faster response time due to the direct control of electric current. The configuration of FIG. 7 can take advantage of both pumps' advantages while compensating for their disadvantages. For example, FIGS. 6A-6C shows an exemplary injection flow rate according to an embodiment that may be performed by the configuration of FIG. 7.

Figure 6A:
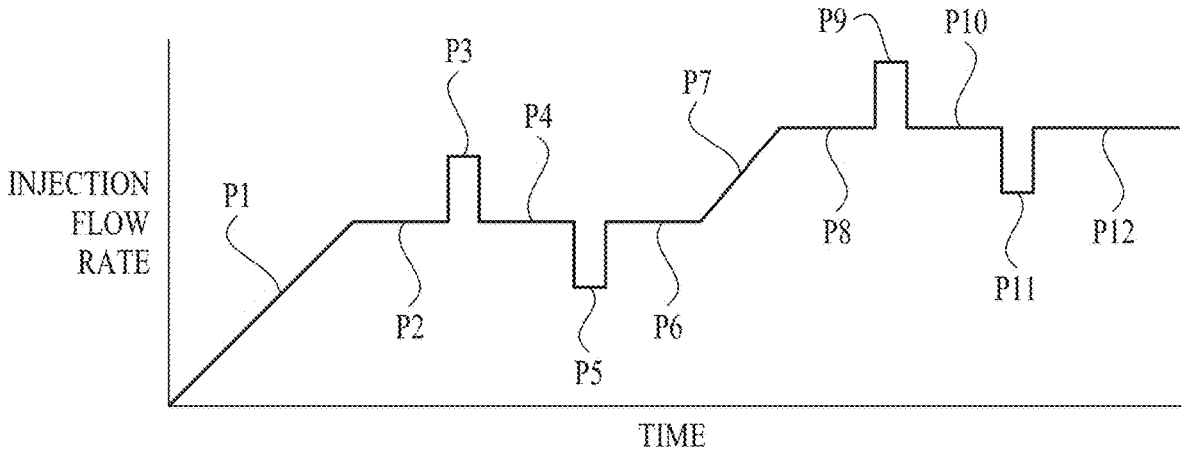
FIG. 6A is a graph of an exemplary injection flow rate according to yet another embodiment.

In FIG. 6A, a first phase P1 may involve ramping up flow rate output by the electric driven pumps 138 and the engine driven pumps 139 (e.g., from zero). Power may be gradually increased to the electric driven pumps 138 and the engine driven pumps 139 may be gradually throttled up. In a second phase P2, flow rate may be held constant (e.g., for half an hour or more). In a third phase P3, there may be a pulse. The pulse could be, for example, a square pulse in which flow rate is sharply increased for a brief period of time and then reduced to its previous level. To achieve the beginning of the pulse, the flow rate of the engine driven pumps 139 may be held constant and the flow rate of the electric driven pumps 138 may be rapidly increased by increasing a number of generators 141 supplying power to each of the electric driven pumps 138 and/or increasing a total amount of power supplied by the generators 141 and/or power supply. To achieve the end of the pulse, the flow rate of the engine driven pumps 139 may be sharply decreased (e.g., by disengaging a clutch). The flow rates of the electric driven pumps 138 may then gradually decrease and the flow rates of the engine driven pumps 139 may gradually increase to restore their previous flow rates before the pulse.

In the fourth phase P4, the flow rate may be held constant (e.g., at the same flow rate as in the second phase P2). In the fifth phase P5, there may be a pulse in which the flow rate is decreased sharply and then increases sharply to its previous level. To achieve the start of pulse in the fifth phase P5, the flow rate of the electric driven pumps 138 may be held constant while the flow rate of engine driven pumps 139 is sharply decreased. To achieve the end of the pulse of the fifth phase P5, the flow rate of the engine driven pumps 139 may be held constant while the flow rate of the electric driven pumps 138 may be sharply increased (e.g., by increasing the combined power provided by the generators 141/power supply and/or increasing the number of generators 141 providing power to each electric driven pump 138). The flow rate of the engine driven pumps 139 may then be gradually increased and the flow rate of the electric driven pumps 138 may be gradually decreased so that flow rates from the engine driven pumps 139 and electric driven pumps 138 are the same as before the pulse of the fifth phase P5. During the sixth phase P6, the flow rate output by the pumps 138,139 may be held constant (e.g., for half an hour or more).

Figure 6B:
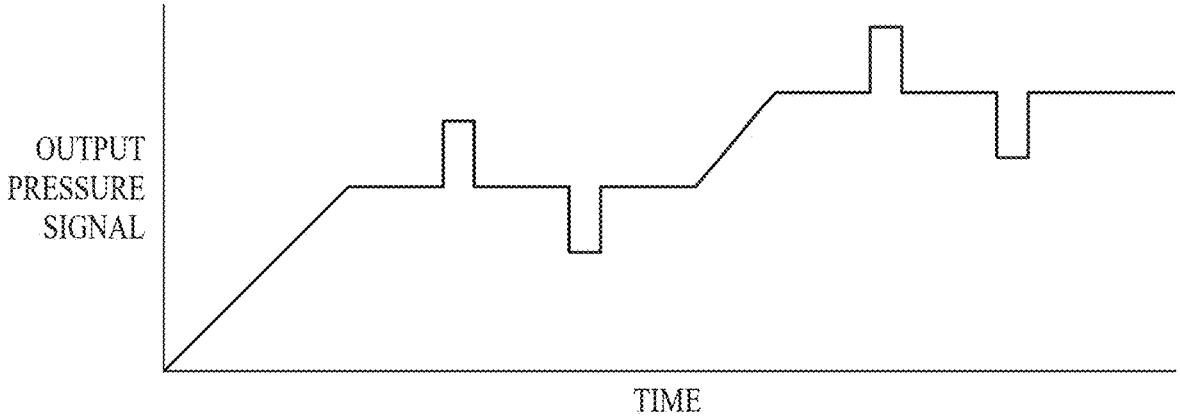
FIG. 6B is a graph of an exemplary output pressure signal according to the embodiment of FIG. 6A.
Figure 6C:
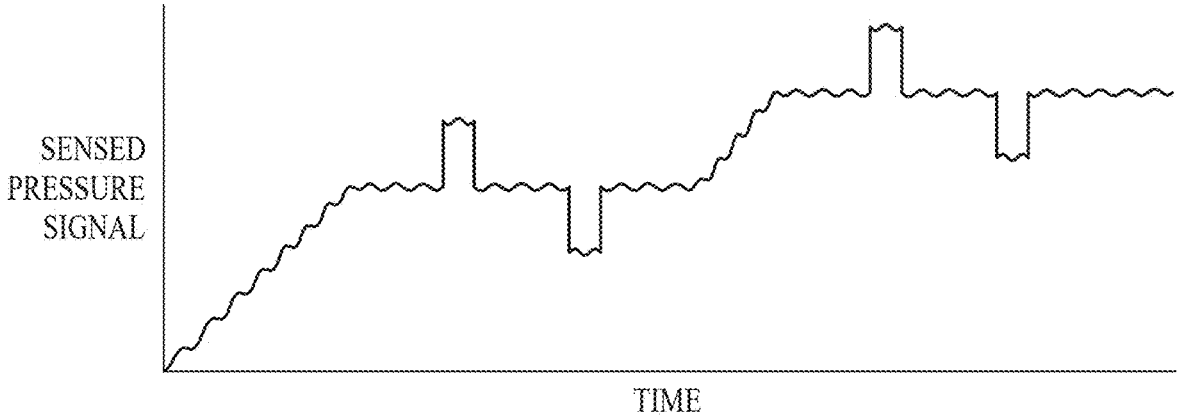
FIG. 6C is a graph of an exemplary sensed pressure signal according to the embodiment of FIG. 6A.

As can be seen in FIG. 6B, the pulses in injection flow rate may cause pulses in pressure as part of a pressure signal. As shown in FIG. 3, the output pressure signal 181 may be reflected off of the formation 110 and the reflected pressure signal 182 may be detected by the sensor 153. The sensor data 183 may be fed into a processor 125 that analyzes the sensor data 183. In response to the processor 125 determining, based on the sensor data 183, that fracking progress in the well is insufficient, a seventh phase P7 may be initiated in which injection flow rate is ramped up (e.g., the pumps 138,139 increase their flow rate gradually). Injection flow rate may then be held constant in the eighth phase P8. Phases P9, P10, P11, and P12 may then be initiated, which include pulses for again determining the state of the fracture. Phases P9, P10, P11, and P12 may be the same as phases P3, P4, P5, and P6, respectively, except that the pressures in the phases P9, P10, P11, and P12 are respectively higher than the pressures in the phases P3, P4, P5, and P6. After the pulses of phases P9 and P11 have been sent out as the output pressure signal 181, the processor 125 may assess the reflected pressure signal 182 to determine whether further adjustment to the injection flow rate is required.

The signals shown in FIGS. 6A-6C are an example of many possible signals. Any of the phases may be omitted and/or additional phases may be added. In addition, the pulses may be added on a carrier wave. In some embodiments, the pulses are on top of an oscillation at or near a natural frequency of the formation. Flow rate, and thus pressure modulations may be driven at low frequencies with long periods and/or may be driven repeatedly over long durations. Oscillation period can be, for example, several minutes and/or have durations of several hours. In some embodiments, the oscillation period may be 10 seconds, 30 seconds, 1 minute, 2 minutes, 3 minutes, or more. In some embodiments, duration may be 10 minutes, 30 minutes, 1 hour, 2 hours, 3 hours, or more. Electrically driven pumping units are especially well-suited for this type of modulation.

Pressure waves may be attenuated as they travel down the wellbore, and thus the desired downhole waveform may require a different initial waveform on the surface. Surface waveforms may also be modulated by changing parameters such as amplitude, frequency, phase-shift, rate-of-change flow, waveform shape, duration, period, etc. Such surface modulation may be implemented to cause downhole waveforms to "sweep" through a shape or area of interest. Flow rates can be controlled dynamically to achieve a particular downhole target pressure, dynamic downhole pressure, and/or a rate profile in coordination with particulate and/or chemical concentrations in a pumped treatment fluid to achieve arrival at particular locations in the formation, such as along a network of fractures. Multiple waves and their reflected forms may also be used to collide at areas of interest in the wellbore. Rate modulation may be used to target specific well depths for potential wave interference from reflected waves and pumping waves to create high magnitude pressure pulses within the wellbore. The frequencies may be varied to target different depths that may correspond to different perforated intervals.

Multiple waveforms may also be additive to create more complex forms. For example, a sinusoidal wave may ride on a longer period square wave. Different pumps may output different flow rate or pressure waveforms that are additive to achieve the desired injection flow rate or injection pressure waveform. Pressure modulations may be created to remain in certain regimes relative to wellbore and formation parameters, such as staying consistently about a fracture-propagation threshold, intentionally going above and/or below fracture-propagation threshold, and/or spanning fracture closure pressure of primary or secondary fractures. Selection of parameter ranges can help enable diagnostics across a length of wellbore and formation characteristics. Such modulation may also assist fracture growth and complexity by fatiguing the formation, resulting in improved stimulation, fluid and proppant placement, and greater Stimulated Reservoir Volume (SRV). In some embodiments, the oscillations comprise accelerating undulations. In some embodiments, the oscillations comprise decelerating undulations. In some embodiments, the oscillations have an increasing envelope. In some embodiments, the oscillations have a decreasing envelope. In some embodiments, the oscillation can be a decelerating undulation to continuously match the natural frequency of the formation as it decreases. As the fracturing progresses, the natural frequency of the formation tends to decrease. In some embodiments, the oscillations last two hours, three hours, or more. The natural frequency of the formation may be the natural frequency of the formation surrounding the wellbore and also the wellbore itself.

Any shape of wave (or oscillation) is within the scope of the present disclosure. For example, the wave may be a square wave (e.g., a non-sinusoidal periodic waveform represented by a combination of various waveforms (e.g., an infinite summation of sinusoidal waves) having an amplitude that alternates at a steady frequency between fixed minimum and fixed maximum values and a fixed duration at the minimum and maximum altitude values (i.e., forming square wave shapes)). The wave may be a sawtooth wave (e.g., a non-sinusoidal periodic waveform having sharp slanted ramps upward and sharp drops, or sharp slanted ramps downward and sharp drops). The wave may be a triangle wave (e.g., a non-sinusoidal periodic waveform having sharp slanted ramps upward and sharp slanted ramps downward, or sharp slanted ramps downward and sharp slanted ramps upward (i.e., forming triangle wave shapes)). The wave may be a rectangle wave (e.g., a non-sinusoidal periodic waveform having an amplitude that alternates at a steady frequency between fixed minimum and fixed maximum values, but a varying duration at the minimum and maximum altitude values (i.e., forming rectangle wave shapes)). The wave may have an irregular waveform of any amplitude, duration, and periodicity. The wave may be a combination of existing waveshapes.

In some embodiments, pressure waves may be generated additionally or alternatively by changing flow restrictions. Devices such as valves and chokes may be used to alter fluid flow into or out of the wellbore. A choke setting may be changed suddenly to increase or decrease fluid entering or exiting the wellbore 105 which may create a pressure wave. Multiple fluids can also be used to induce a pressure change, for instance, loading a wellbore with a gaseous material with liquid below, then flowing the well back through a restriction. As the gas flows through a given restriction such as a choke, orifice, or other such restriction, a given pressure will be generated. Then, when the liquid gets to the same flow restriction, pressure may spike due to the change thus creating a significant pulse (e.g., a "water-hammer"). Pumping equipment may be engine-driven or driven with electric motors. Engine driven equipment/generators can be fueled with gaseous or liquid fuels such as diesel, gasoline, kerosene, Compressed Natural Gas (CNG), Liquified Natural Gas (LNG), conditioned field gas, hydrogen, or combinations thereof.

Hydraulic fracturing may be most effective when the pressure wave output by the pumps matches the natural frequency of the formation (e.g., the wellbore and the formation surrounding the wellbore). Feedback from the well can help determine if the oscillation is staying in sync with the natural frequency of the fracture formation and adjustments can be made if necessary (e.g., automated by the processor). For example, if it is detected that the natural frequency of the formation has been reduced, the frequency of the oscillation can be set to match the reduced natural frequency. In some embodiments, sweeps are done between frequencies above and below the estimated natural frequencies of the well. For example, the pumps may be controlled to start the oscillation at a frequency at below the estimated natural frequency of the formation and then slowly ramp of the frequency of the oscillation to above the estimated natural frequency of the formation. The natural frequency could have, for example, a period of thirty seconds. Matching the natural frequency can enhance the complexity of the fracture, fatigue the formation, and/or create secondary fractures. For any embodiment involving a pulse, a wave can be used alternatively or additionally. For any embodiment involving a wave, a pulse can be used alternatively or additionally.

To generate pressure pulses, oscillations, or other waveforms, two or more independent electric frac pumps may be each hydraulically connected to two or more independent wells while connected to the same electrical supply. While pumping into one or more wells, electrical energy may be diverted from a frac pump or group of frac pumps into one or more frac pumps on one or more different wells. The rate or energy of the frac pump or pumps on the first well or group of wells may be ramped down to a lower power level as the power level of the frac pump or pumps on the second well or group of wells is ramped up to a new higher power level so that the electrical load is transferred from first pump group to second pump group without significantly changing the load on the overall electrical supply or generators powering the frac equipment. Additionally, the flow rate through the frac blender(s) supplying frac fluid to all well groups may not significantly change so that the overall fluid delivery rate and output pressures remain within the capabilities of the blending system. More specifically, the rate of change of power may not exceed the capabilities of the power supply, and the rate of change of flow rate may not exceed the capabilities of the fluid supply.

Referring to FIG. 8, a simultaneous fracking (simulfrac) operation in a well system 100 is shown. The configuration may be similar to that of FIG. 1 except there are two wellbores 105 and two pump systems 137, one for each wellbore 105. In some embodiments, there are multiple pump systems 137 fluidly coupled to each wellbore. The pump system 137 could take the form shown in FIG. 2, the form shown in FIG. 7, or any other suitable configuration. The pump system 137 may be controlled by the processor 125 (e.g., part of a controller). Each pump system 137 may draw power from a common power generation system (e.g., generators and/or a power grid). As shown in FIG. 8B, the processor 125 may control the pump systems 137 such that as the left pump system 137 executes a positive pulse (e.g., in flow rate and/or pressure) and concurrently the right pump system 137 executes a negative pulse. As shown in FIG. 8C, at another instant in time, as the left pump system 137 may execute a negative pulse and concurrently the left pump system 137 may execute a positive pulse. This may balance the change in power demand from the pump pulsing to the positive with a decrease in power demand from the pump pulsing to the negative. This principle is not limited to pulses. Any abrupt increase/decrease in the flow rate of one of the pumps systems 137 may be mirrored by a decrease/increase of another of the pump systems 137. For example, the left pump and the right pump could output waveforms (e.g., sine waves) phase shifted with respect to each other such that the sum of the waveforms is constant (or approximately constant) at all points in time. In another example, each pump may output a pressure signal individually exceeding the stiffness of the power supply but when the signals are added the stiffness of the power supply is not exceeded. Thus, the configuration of FIG. 8A may avoid the need for engine driven pumps and/or power sources with enhanced stiffness for the pump systems 137.

Referring again to FIG. 8A, an exemplary system 100 for hydraulic fracturing with a modulating flow rate may include a first electric pump system 137 (e.g., left pump system) electrically coupled to a power supply 142 and configured to pump fluid down one or more first wellbores 105 (e.g., left wellbore); a second electric pump system 137 (e.g., right pump system) electrically coupled to the power supply 142 and configured to pump fluid down one or more second wellbores 105 (e.g., right wellbore); and a controller (e.g., processor 125) configured to control the first electric pump system 137 to increase a flow rate of the first electric pump system 137 and concurrently control the second electric pump system 137 to decrease a flow rate of the second electric pump system 137 such that a combined rate of change of electric power demand of the first electric pump system and the second electric pump system is less than a stiffness of the power supply 142 (e.g., the maximum rate of change of power that the power supply is capable of providing). In other words, the first time derivative of power demand by the first and second pump systems 137 combined may be within a tolerance band of the first derivative of power that the power supply 142 is capable of providing (e.g., the tolerance band comprising an upper limit (e.g., a maximum rate of increase of power that the power supply is capable of providing) and a lower limit (e.g., a maximum rate of decrease of power that the power supply is capable of providing)). The combined rate of change of the electric power demand of the first electric pump system 137 and the second electric pump system 137 may be controlled to be less than a threshold. The threshold may be set based on the stiffness of the power supply. "Stiffness" may be the ability of the power supply to support demand variations without going outside of performance parameters (i.e. voltage and frequency). For example, the threshold may be a maximum rate of change the power supply can tolerate without shutting down and/or sustaining damage. The stiffness of the power supply may be different depending on whether it is a grid, one or more engine-driven generators, or a combination of the two. The stiffness may also depend on where the generator is on its power curves. The stiffness in the positive direction may be different than the stiffness in the negative direction.

In some embodiments, an energy storage system (e.g., one or more batteries, capacitors, supercapacitors, etc.) may be used to absorb energy or supply energy. An energy storage system does not require simulfrac operations to be used, but it can supplement the power source in any well pumping configuration. The energy storage system may be part of the power supply so that the rate of change of power demanded by the pump systems 137 does not exceed the stiffness of the power supply. The battery may absorb energy and supply energy in times of need (e.g., for peak shaving). The addition of the energy storage system to the power supply may decrease the stiffness of the power supply (e.g., improve its ability to take up and shed power).

The processor 125 can be part of any digital or analog control system and may be configured to control variable frequency drives that are configured to provide power to the electric pump systems 137. For example, the processor 125 may control set points of speed demand and/or torque limits of the electric pump systems 137. The set points may affect voltage and/or frequency supplied by the variable frequency drives to the electric pump systems 137. The torque limit may affect a current limit of electric power supplied by the variable frequency drives to the pump systems 137. In some embodiments, data from the sensors 153 and/or other sources (e.g., data from sources other than sensors) are used by the processor 125 in a control loop to tune pressure and/or flow rate according to a desired waveform. For example, the data may include a signal (digital value or otherwise) from a power source that includes relevant information such as power output (e.g. kW). Based on this data, the power source rate-of-change may be controlled in a desired manner.

In some embodiments, the first electric pump system 137 comprises a plurality of first electric pumps and/or the second electric pump system 137 comprises a plurality of second electric pumps. The rate of change of electric power demand of the first electric pump system 137 may individually exceed the stiffness of the power supply and/or the rate of change of electric power demand of the second electric pump system 137 may individually exceed the stiffness of the power supply, but the combined rate of change of electric power demand by the first and second electric pump systems 137 may not exceed the stiffness of the power supply. For example, an absolute value of the rate of change of electric power demanded by the first electric pump system may be within 50%, 30%, 10%, 5%, or 1% of an absolute value the rate of change of electric power demanded by the second electric pump system at all points during an increase in flow rate of the first electric pump system and a decrease in flow rate of the second electric pump system. The increase in the flow rate of the first electric pump system 137 may be part of a flow rate oscillation executed by the first electric pump system 137 and/or the decrease in the flow rate of the second electric pump system 137 may be part of a flow rate oscillation executed by the second electric pump system 137. Alternatively, the increase in the flow rate of the first electric pump system 137 may be part of a positive pressure pulse executed by the first electric pump system 137 and/or the decrease in the flow rate of the second electric pump system 137 may be part of a negative pressure pulse executed by the second electric pump system 137.

The increase in the flow rate of the first electric pump system 137 may be simultaneous with the decrease in the flow rate of the second electric pump system 137. That is, the increase in flow rate of the first electric pump system 137 may begin at the same time as the decrease in flow rate of the second electric pump system 137 and the increase in flow rate of the first electric pump system 137 may end at the same time as the decrease in flow rate of the second electric pump system 137. In some embodiments, the first time derivative of power demanded by the first electric pump system 137 is equal to (or within 1%, 5%, 10%, 30%, or 50%) of the negative of the first time derivative of power demanded by the second electric pump system 137 at all points in time (e.g., at all points during a change of power demand).

The controller may be configured to control the first electric pump system 137 to decrease the flow rate of the first electric pump system 137 and concurrently control the second electric pump system 137 to increase a flow rate of the second electric pump system 137 such that the combined rate of change of electric power demanded by the first electric pump system 137 and the second electric pump system 137 is less than a stiffness of the power supply 142. The decrease in the flow rate of the first electric pump system 137 may be simultaneous with the increase in the flow rate of the second electric pump system 137. The power supply 142 may include a power plant and/or engine-driven generators.

The first electric pump system 137 and the second electric pump system 137 may be fluidly coupled to a common fluid supply 210. The fluid supply 210 may include a blender. A combined rate of change of the flow rate (e.g., first time derivative of flow rate) of the first electric pump system 137 and the second electric pump system 137 may be less than a stiffness of the fluid supply 210 (e.g., a first time derivative of flow rate that the fluid supply 210 is capable of providing). The first time derivative of input flow rate demanded by the first electric pump system 137 may be equal to (or within 1%, 5%, 10%, 30% or 50%) of the negative of the first time derivative of input flow rate demanded by the second electric pump system 137 at all points in time (e.g., all points in time during a change of input flow rate demand). A maximum rate of change of the flow rate of the first electric pump system 137 during the increase of the flow rate of the first electric pump system 137 may individually exceed the stiffness of the fluid supply and/or a maximum rate of change of the flow rate of the second electric pump system 137 during the decrease of the flow rate of the second electric pump system 137 may individually exceed the stiffness of the fluid supply 210, but the combined rate of change of flow rate of the first and second electric pump systems 137 may be less than the stiffness of the fluid supply 210 (e.g., less than the maximum rate of change of flow that the fluid supply is capable of providing, e.g., without failing, sustaining damage and/or shutting down). In some embodiments, an increase in flow rate of the first electric pump system 137 may offset a decrease in flow rate of the second electric pump system 137 (e.g., without going to zero) and/or a decrease in flow rate of the first electric pump system 137 may offset an increase in flow rate of the first electric pump system 137 (e.g., without going to zero).

Figure 14A:
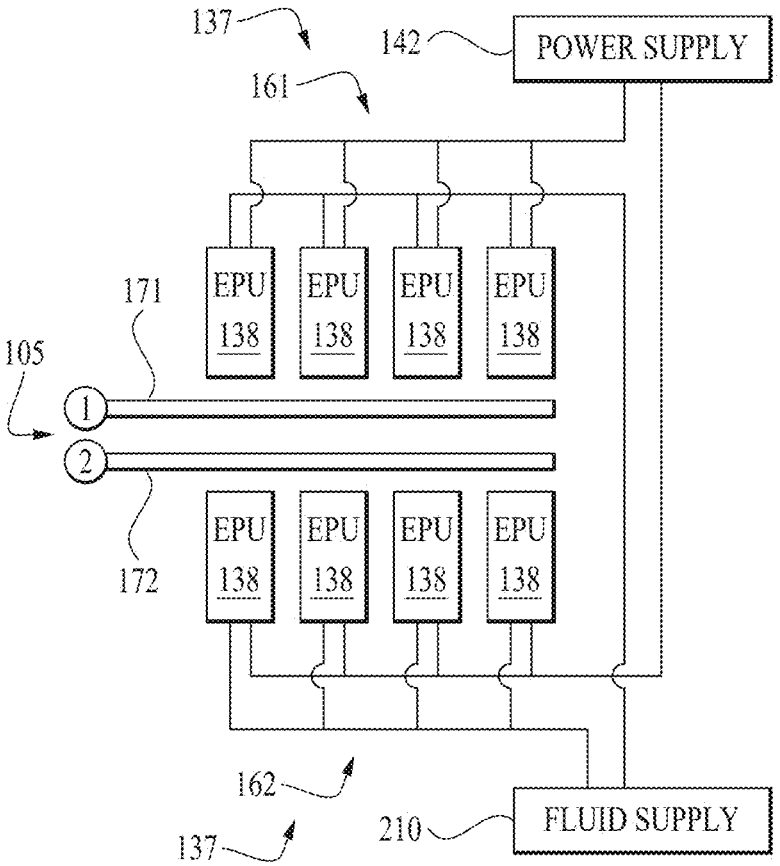
FIG. 14A is a schematic diagram of a simulfrac pumping operation, according to an embodiment.
Figure 14B:
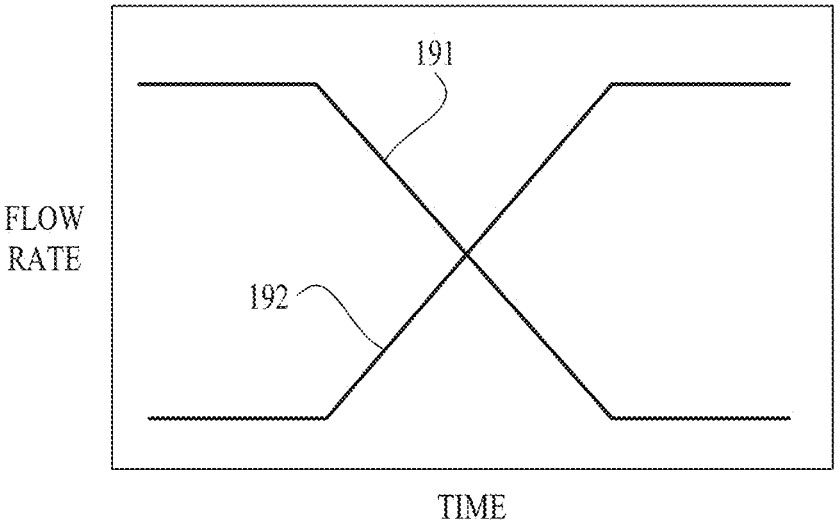
FIG. 14B is a graph of an exemplary flow rates of the simulfrac pumping operation over time, according to an embodiment.

Referring to FIG. 14A, the first electric pump system 137 may include a first group 161 of electric pumps 138 fluidly coupled to a first wellbore 171 of the one or more first wellbores 105 and a second group 162 of electric pumps fluidly coupled to a second wellbore 172 of the one or more second wellbores 105. The electric pumps 138 may be electrically coupled to a common power supply 142 and/or fluidly coupled to a common fluid supply 210. Referring to FIG. 14B, the flow rate 191 of the first group 161 of electric pumps 138 may be inversely related to the flow rate 192 of the second group 162 of electric pumps 138. That is, the rate of change of flow rate 191 of the first group 161 of electric pumps 138 may be equal to (or within 1%, 5%, 10%, 30%, or 50% of) the negative of the rate of change of the flow rate 192 of the second group 162 of electric pumps 138 at all points in time. The difference in these rates of changes may be less than a stiffness of the power supply 142, even though they may individually exceed the stiffness of the power supply 142 at times. The stiffness of the power supply may be the stiffness in relation to rates of change of power events of durations on the order of seconds (e.g., as opposed to millisecond). For example, the power supply may be able to accommodate greater rates of change of power demand for event durations on the order of milliseconds than rates of change of power demand for event durations on the order of seconds.

Figure 15A:
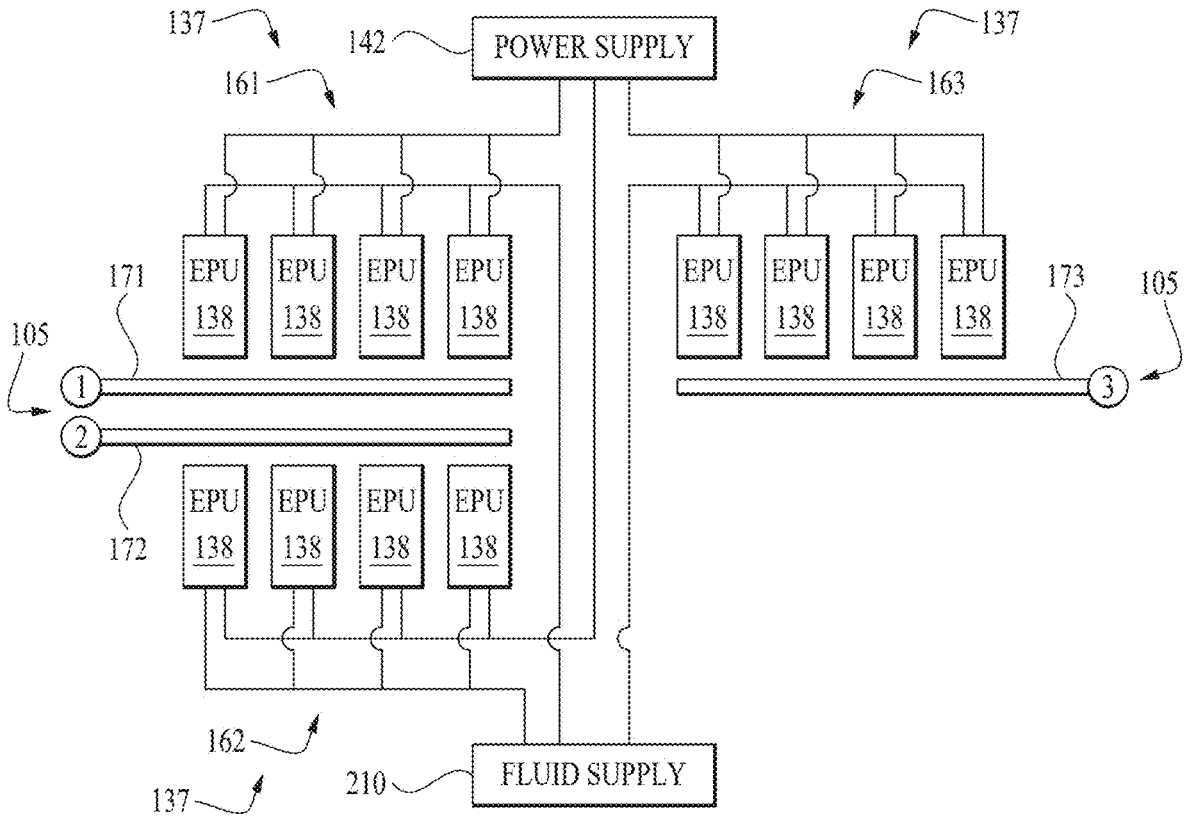
FIG. 15A is a schematic diagram of a trimulfrac operation, according to an embodiment.
Figure 15B:
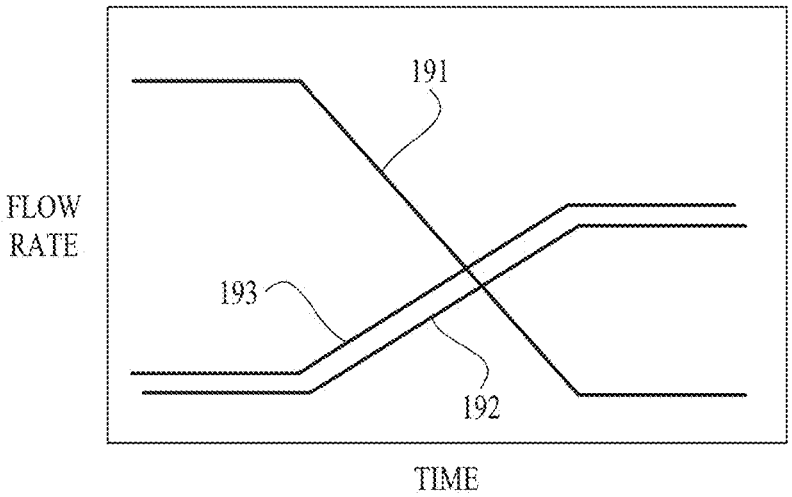
FIG. 15B is a graph of an exemplary flow rate of the trimulfrac pumping operation over time, according to an embodiment.
Figure 10A:
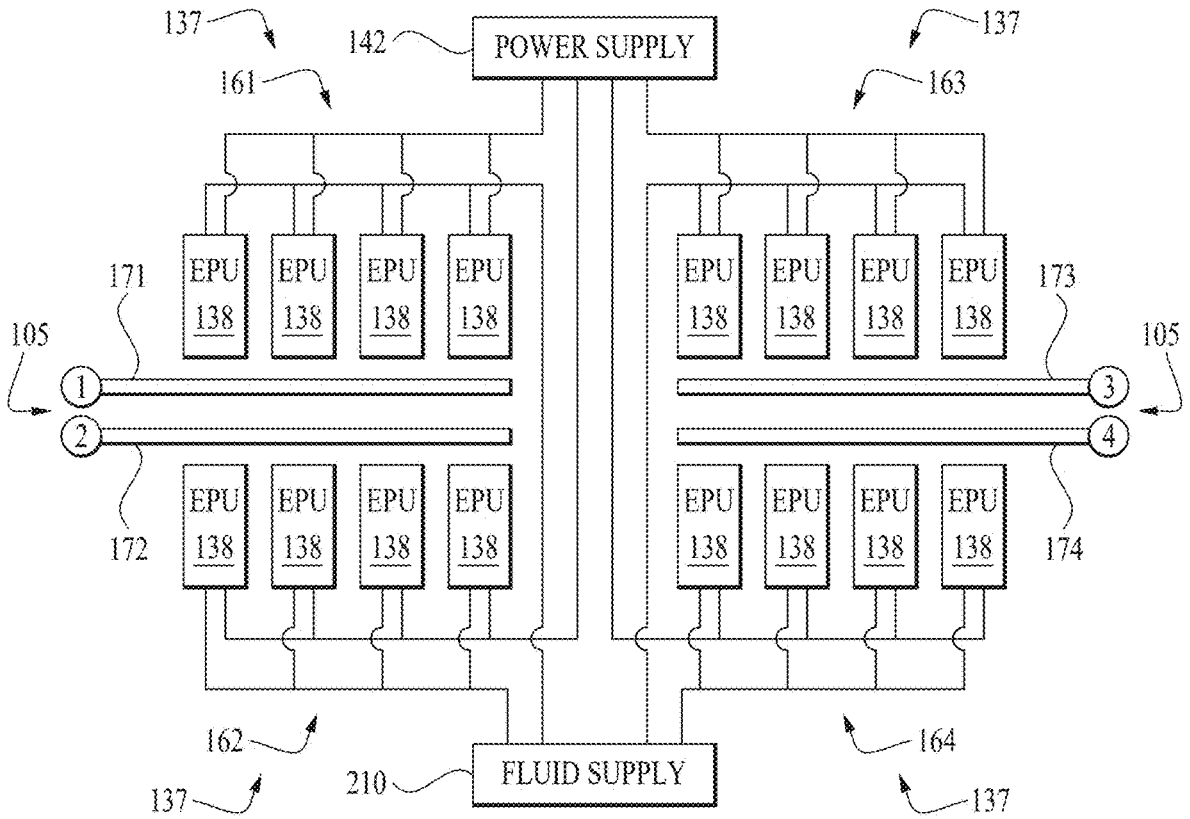
Figure 10B:
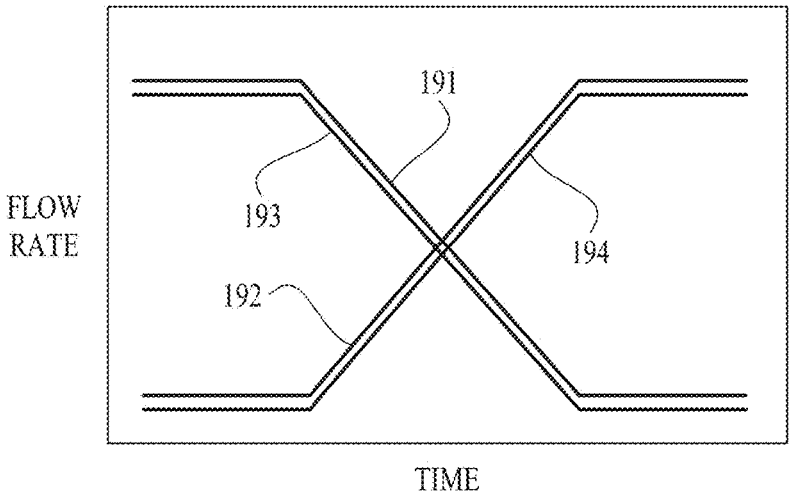

Referring to FIG. 15A, the first electric pump system 137 may include a first group 161 of electric pumps 138 fluidly coupled to a first wellbore 171 of the one or more first wellbores 105 and a second group 162 of electric pumps 138 fluidly coupled to a second wellbore 172 of the one or more first wellbores 105, and the second electric pump system 137 may comprise a third group 163 of electric pumps 138 fluidly coupled to a third wellbore 173 of the one or more second wellbores 105. The electric pumps 138 may be electrically coupled to a common power supply 142 and/or fluidly coupled to a common fluid supply 210. Referring to FIG. 15B the waveform of flow rate 191 of the first group 161 of electric pumps 138 may be inversely related to a sum of the waveforms of the flow rate 192 of the second group 162 of electric pumps 138 and the flow rate 193 of the third group 163 of electric pumps 138. That is, the rate of change of the flow rate 191 of the first group 161 of electric pumps 138 may be equal to (or within 1%, 5%, 10%, 30% or 50% of) the negative of the sum of the rate of change of the flow rate 192 of the second group 162 of electric pumps 138 and the rate of change of the flow rate 193 of the third group 163 of electric pumps 138 at all points in time (e.g., all points in time during a change in power demand). The difference in these rates of changes may be less than a stiffness of the power supply 142, even though at least one of them (e.g., flow rate 191) may individually exceed the stiffness of the power supply 142 at times. A flow rate 192 waveform of the second group 162 of electric pumps 138 may correspond to a flow rate waveform 193 of the third group 163 of electric pumps 137 (e.g., they may be the same waveform). In this particular example, there is the same number of pumps in the first group 161, the second group 162, and the third group 163, and to achieve a balance of the rate of change of power demand, the absolute value of the rate of change of flow rates of the first group 161 of pumps 138 is twice that of the sum of the absolute value of the rates of changes of the second group 162 of pumps 138 and the third group 163 of pumps 138. In other examples, the difference in the rate of change of power demand is due to the first group 161 having a greater number of pumps 138. Although the inflection points between steady state and changing flow rates are shown as sharp for the purpose of illustration, in some embodiments, these inflection points are rounded or even part of a sine wave, which may be advantageous for providing a consistently low rate of change of power demand by the electric pump systems 137.

Referring to FIG. 16A, the first electric pump system 137 may include a first group 161 of electric pumps 138 fluidly coupled to a first wellbore 171 of the one or more first wellbores 105 and a second group 162 of electric pumps 138 fluidly coupled to a second wellbore 172 of the one or more first wellbores 105, and the second electric pump system 137 may include a third group 163 of electric pumps 138 fluidly coupled to a third wellbore 173 of the one or more second wellbores 105 and a fourth group 164 of electric pumps 138 fluidly coupled to a fourth wellbore 174 of the one or more second wellbores 105. The electric pumps 138 may be electrically coupled to a common power supply 142 and/or fluidly coupled to a common fluid supply 210. Referring to FIG. 16B, the sum of the rate of change of flow rate 191 of the first group 161 of electric pumps 138 and the rate of change of the flow rate 193 of the third group 163 of electric pumps 138 may be equal to (or within 1%, 5%, 10%, 30%, or 50% of) the negative of the sum of the rate of change of the flow rate 192 of the second group 162 of electric pumps 138 and the rate of change of the flow rate 194 of the fourth group 164 of electric pumps 138 at all points in time (e.g., at all points in time during a change in electric power demand by the pumps 138). The difference in these sums of rates of changes may be less than a stiffness of the power supply 142, even though at least some of them may individually exceed the stiffness of the power supply 142 at times. A flow rate 191 waveform of the first group 161 of electric pumps 138 may correspond to (e.g., be the same as) a flow rate 192 waveform of the second group 162 of electric pumps 138, and a flow waveform 193 of the third group 163 of electric pumps 138 may correspond to (e.g., be the same as) a flow rate 194 output of the fourth group 164 of electric pumps 138.

Referring to FIG. 8A, 14D1, and 14D2, a system 100 for hydraulic fracturing with an oscillating flow rate may include a first electric pump system 137 (e.g., left pump system) electrically coupled to a power supply 142 and configured to pump fluid down one or more first wellbores 105 (e.g., left wellbore); a second electric pump system 137 (e.g., right pump system) electrically coupled to the power supply 142 and configured to pump fluid down one or more second wellbores 105 (e.g., right wellbore); and a controller (e.g., processor 125) configured to control the first electric pump system 137 to oscillate a flow rate of the first electric pump system 137 and control the second electric pump system 137 to oscillate a flow rate of the second electric pump system 137 such that there is a phase shift between the oscillation of the flow rate of the first electric pump system 137 and the oscillation of the flow rate of the second electric pump system 137.

In some embodiments, the phase shift prevents a combined rate of change of power demand of the first electric pump system 137 and the second electric pump system 137 from exceeding a stiffness of the power supply 142. In some embodiments, a maximum rate of change of power demand of the first electric pump system 137 during the oscillation of the flow rate of the first electric pump system 137 individually exceeds the stiffness of the power supply 142 and a maximum rate of change of power demand of the second electric pump system 137 during the oscillation of the flow rate of the second electric pump system 137 individually exceeds the stiffness of the power supply 142, but the combined rate of change of power demand of the first and second pump systems 137 does not exceed the stiffness of the power supply 142. The phase shaft may be 180 degrees (e.g., 175 to 185 degrees, 160 to 200 degrees, or 150 to 210 degrees). The oscillation of the flow rate of the first electric pump system 137 may include a first sine wave, and the oscillation of the flow rate of the second electric pump system 137 may include a second sine wave (e.g., that is phase shifted from the first sine wave). An amplitude of the first sine wave may be the same as an amplitude of the second sine wave. The principles described herein are not limited to sine waves. For example, the oscillation of the flow rate of the first electric pump system 137 may include a first square wave, and the oscillation of the flow rate of the electric pump system 137 may include a second square wave (e.g., phase shifted from the first square wave). An amplitude of the first square wave may be the same as an amplitude of the second square wave. In other embodiments, the oscillations may comprise irregular waves that are phase shifted with respect to each other. In some embodiments, an absolute value of the rate of change of electric power demanded by the first electric pump system 137 is within 1%, 5%, 10%, 30%, or 50% of an absolute value of the rate of change of electric power demanded by the second electric pump system 137 at all points during the oscillation in the flow rate of the first electric pump system 137 and the oscillation in the flow rate of the second electric pump system 137.

The phase shift may also prevent a combined rate of change of flow rate of the first electric pump system 137 and the second electric pump system 137 from exceeding the stiffness of the fluid supply 210. A maximum rate of change of flow rate of the first electric pump system 137 during the oscillation of the flow rate of the first electric pump system 137 may individually exceed the stiffness of the fluid supply 210 and/or a maximum rate of change of the flow rate of the second electric pump system 137 during the oscillation of the flow rate of the second electric pump system may individually exceed the stiffness of the fluid supply 210, but the combined rate of change of flow rate of the first and second electric pump systems 137 may not exceed the stiffness of the fluid supply 210 (e.g., the stiffness of the fluid supply 210 may be an ability of the fluid supply 210 to accommodate rates of changes of flow rate, e.g., there may be an acceptable band of first time derivative of flow rate demand that will not cause the fluid supply 210 to fail, become damaged, and/or shut down).

The oscillations may be for the purpose of enhancing fracturing effectiveness (e.g., according to any of the methods disclosed herein). In some examples, the duration of oscillations may be less than one minute, 5 minutes, 10 minutes, 30 minutes, or more than 60 minutes. The period of the oscillations may be 10 seconds to greater than 200 seconds. The period of the oscillations may vary over time.

Referring to FIG. 8A, 14C1, and 14C2, a system 100 for sending pulses into wellbores may include a first electric pump system 137 (e.g., left pump system) electrically coupled to a power supply 142 and configured to pump fluid down one or more first wellbores 105 (e.g., left wellbore); a second electric pump system 137 (e.g., right pump system) electrically coupled to the power supply 142 and configured to pump fluid down one or more second wellbores 105 (e.g., right wellbore); and a controller (e.g., processor 125) configured to control the first electric pump system 137 to execute a first positive pulse and control the second electric pump system 137 to execute a first negative pulse concurrently with the first positive pulse. The pulse may be for diagnostic purposes (e.g., according to any of the diagnostic examples discussed herein).

In some embodiments, the controller is further configured to control the first electric pump system 137 to execute a second negative pulse, and control the second electric pump system 137 to execute a second positive pulse concurrently with the second negative pulse. The first positive pulse, the first negative pulse, the second positive pulse, and/or the second negative pulse may be pressure pulses. Alternatively, the first positive pulse, the first negative pulse, the second positive pulse, and/or the second negative pulse may be flow rate pulses. The first positive pulse, the first negative pulse, the second positive pulse, and the second negative pulse may comprise square pulses, trapezoidal pulses, an irregular shaped pulse, or any other suitable type of pulse. The first positive pulse may occur simultaneously with the first negative pulse, and the second positive pulse may occur simultaneously with the second negative pulse. The first positive pulse may have a same duration as the first negative pulse. The second positive pulse may have a same duration as the second negative pulse.

A combined rate of change of power demand of the first electric pump system 137 and the second electric pump system 137 may remain less than a stiffness of the power supply during the first positive pulse, the first negative pulse, the second positive pulse, and the second negative pulse. The rate of change of power demand of the first electric pump system 137 during at least a portion of the first positive pulse and at least a portion of the second negative pulse may be individually greater than the stiffness of the power supply 142 and the rate of change of power demand of the second electric pump system 137 during at least a portion of the first negative pulse and at least a portion of the second positive pulse may be individually greater than the stiffness of the power supply 142, but the combined rate of change of the first and second electric pump system 137 may not exceed the stiffness of the power supply 142 (e.g., the combined rate of change may not exceed the power supply's ability to accommodate it without failing, sustaining damage, or shutting down).

Additionally or alternatively, a rate of change of flow rate of the first electric pump system 137 during the first positive pulse and a rate of change of flow rate of the second electric pump system 137 during the first negative pulse combined may be less than a stiffness of the fluid supply 210. That is, the combined rate of change may not exceed a threshold. The threshold may be based on the fluid supply's ability to accommodate rates of changes of flow rate demand without failing, sustaining damage, and/or shutting down. A maximum rate of change of the flow rate of the first electric pump system 137 during the first positive pulse may be individually greater than the stiffness of the fluid supply 210 and/or a maximum rate of change of the flow rate of the second electric pump during the first negative pulse may be individually greater than the stiffness of the fluid supply 210, but the combined rate of change of the flow rate may not exceed the stiffness of the fluid supply 210.

Referring to FIGS. 8A, 14E1, and 14E2, the first positive pulse may be added to an oscillation output by the first electric pump system 137 and/or the first negative pulse may be added to an oscillation output by the second electric pump system 137. The pulse may be for the purpose of wellbore diagnostics, and the oscillation may be for the purpose of fracking effectiveness. Pulses and oscillations may be used together according to any of the embodiments disclosed herein. For example, information gleaned from a response from the pulse reflected off of the wellbore may be used to tune a frequency of the oscillation for greater fracking effectiveness (e.g., by matching or more closely approximating a natural frequency of the wellbore). In various embodiments, amplitude, duration, and/or period of the oscillations may be based on analysis by the processor 125 about the condition of the wellbore (e.g., based on a response signal from the pulse).

Referring to FIGS. 15A, 15C1, 15C2, and 15C3, the pulses (e.g., pressure pulses) of the first group 161 of pumps 138 may coincide with the pulses (e.g., pressure pulses) of the second group 162 of pumps 137 and the third group 163 of pumps 138 such that a total rate of change of power demand is less than a stiffness of the power supply 142 and/or a total rate of change of fluid demand is less than the stiffness of the fluid supply 210.

Referring to FIGS. 15A, 15D1, 15D2, and 15D3, the oscillations (e.g., flow rate oscillations) of the first group 161 of pumps 138 may be phase shifted from the oscillations (e.g., flow rate oscillations) of the second group 162 of pumps 138 and the third group 163 of pumps 138 such that a total rate of change of power demand is less than a stiffness of the power supply 142 and/or a total rate of change of fluid demand is less than a stiffness of the fluid supply 210.

Referring to FIGS. 15A, 15E1, 15E2, and 15E3, the pulses of the first group 161 of pumps 138 may coincide with the pulses of the second group 162 of pumps 138 and the third group 163 of pumps 138 and the oscillations of the first group 161 of pumps 138 may be phase shifted from the oscillations of the second group 162 of pumps 138 and the third group 163 of pumps 138 such that a total rate of change of power demand is less than a stiffness of the power supply 142 and/or a total rate of change of fluid demand is less than a stiffness of the fluid supply 210.

Referring to FIGS. 16A, 16C1, 16C2, 16C3, and 16C4, the pulses of the first group 161 of pumps 138 and the third group 163 of pumps 138 may coincide with the pulses of the second group 162 of pumps 138 and the fourth group 164 of pumps 138 such that a total rate of change of power demand is less than a stiffness of the power supply 142 and/or a total rate of change of fluid demand is less than a stiffness of the fluid supply 210.

Referring to FIGS. 16A, 16D1, 16D2, 16D3, and 16D4, the oscillations of the first group 161 of pumps 138 and the third group 163 of pumps 138 may be phase shifted from the oscillations of the second group 162 of pumps 138 and the fourth group 164 of pumps 138 such that a total rate of change of power demand is less than a stiffness of the power supply 142 and/or a total rate of change of fluid demand is less than a stiffness of the fluid supply 210.

Referring to FIGS. 16A, 16E1, 16E2, 16E3, and 16E4, the pulses of the first group 161 of pumps 138 and the third group 163 of pumps 138 may coincide with the pulses of the second group 162 of pumps 138 and the fourth group 164 of pumps 138 and the oscillations of the first group 161 of pumps 137 and the third group 163 of pumps 138 may be phase shifted from the oscillations of the second group 162 of pumps 138 and the fourth group 164 of pumps 138 such that a total rate of change of power demand is less than a stiffness of the power supply 142 and/or a total rate of change of fluid demand is less than a stiffness of the fluid supply 210.

Any of the waveforms discussed with respect to the examples of FIGS. 14-16 may be expressed in terms of electrical power, pressure, or flow rate. The waveforms may prevent a first time derivative and/or a second time derivative of power exceeding an ability of a power supply to adapt/accommodate it and/or prevent a first time derivative and/or a second time derivative of power exceeding an ability of a fluid supply to adapt/accommodate it.

The fluid supply 210 may comprise for example, a blender, a system for providing slurry, a boost pump, and/or any other system for supplying fracking fluid. The advantage of using a single fluid supply 210 for the both the first and second pumping systems 137 may be to maintain a forward momentum of fluid within a pipeline, which may prevent damage to low pressure manifolds.

The system and method of the present disclosure may be performed with clean fluid or with slurry. In the embodiments in which the pressure or flow rate fluctuations are performed with slurry, connecting both pumping systems 137 to the same blender may prevent the blender from having to rapidly change concentration. Because combined the rate of change of flow rate may remain below a threshold, the blender may be able to accommodate the small fluctuations in concentration requirements. That is, the phase-shifted oscillations may maintain the rate of change of fluid flow from the fluid supply within an acceptable band.

In some embodiments, the oscillation of the flow rate may be a finishing operation. That is, the oscillation of flow rate may be performed with clean fluid (e.g., with friction reducers but without proppant) after proppant had already been introduced into the well as part of a previous operation. In other embodiments, the oscillation may be performed after breakdown or during the sand stage. In more detail, the fracturing operation may begin with an initial fracturing step involving pumping high-pressure fracturing fluid with water, friction reducer, and without proppant for the purpose of creating fractures. Next, fracturing fluid with water, friction reducer, and proppant may be pumped down the wellbore to create new fractures and to keep the fractures open using the proppant. Next, a finishing operation may be performed in which fluid with water, friction reducer, and without proppant is pumped down the well to flush out proppant and ensure that the fractures remain open. The oscillations of flow rate with the multifrac configuration may be performed during any of these fracturing operations.

Referring to FIG. 17A1, an exemplary flow rate 301 of a first pump system (e.g., bpm), an associated power demand 302 of the first pump system (e.g., kWe), and a rate of change of the power demand 303 (i.e., the first derivative of the power demand 302) of the first pump system (e.g., kWe/Sec) is shown on the graph. A maximum rate of change of power to the positive 401 and a maximum rate of change of power to the negative 402 that the power supply can provide (e.g., the stiffness of the power supply) is also shown. In this particular example, the first pump system is executing a flow rate oscillation (e.g., at or near a natural frequency of the wellbore). As shown, if this pump were acting alone, the stiffness of the power supply would be exceeded in both the takeup and the shed (i.e., line 303 crosses lines 401 and 402), and the power supply may experience a failure (e.g., a blackout, a rejection, damage to components, etc.). In addition, the magnitude of the second derivative of power is very high between points-A and A and between points-B and B, which can also contribute to a power failure. Referring to FIG. 17B1, in some embodiments, two pump systems oscillate their flow rate at a phase shift (e.g., 180 degrees), wherein the pump systems are fluidly coupled to different wells but to the same power supply and/or fluid supply. The rate of change of flow rate 301 of the first pump system and the associated rate of change of power demand 302 of the first pump system may be offset by the rate of change of flow rate 601 of the second pump system and the associated rate of change of power demand 602 of the second pump system. Although the rate of change of power demand of both of the first pump system and the second pump system may individually exceed the stiffness of the power supply, the combined rate of change of power demand 503 of the first pump and the second pump does not exceed the stiffness of the power supply (i.e., line 503 does not cross line 401 nor line 402 and the power supply is able to takeup and shed without a rejection, becoming damaged, or otherwise failing).

The upper limit for load take (e.g., the upper limit for take-up represented by line 401) and the lower limit for load dump (e.g., the lower limit for load shed represented by 402) is shown in the graph as being of the same magnitude, however, in some embodiments, load dump is of lesser magnitude than load take. That is, the power supply may be capable of increasing power faster than it is capable of decreasing power. In some embodiments, load take and load dump are each at 1 megawatt per second.

FIG. 17A2 shows a similar operation as in FIG. 17A1 except that the flow rate and power demand are in the form of a triangle wave. This can lead to an even greater magnitude of second derivative of power between points-A and A and between points-B and B. Referring to FIG. 17B2, by utilizing two pump systems that oscillate their flow rates at a phase shift (e.g., 180 degrees) wherein the pump systems are fluidly coupled to different wells but to the same power supply and/or fluid supply, the magnitude of the first and/or second derivative of power demand can be reduced, e.g., such that the first derivative of power demand does not cross line 401 nor line 402.

FIG. 17A3 shows a similar operation as in FIG. 17A1 except that the flow rate is in the form of a sine wave and the power demand generally resembles a sine wave. This can lead to a relatively low maximum magnitude of second derivative of power (e.g., at points C and D). Referring to FIG. 17B3, by utilizing two pump systems that oscillate their flow rates at a phase shift (e.g., 180 degrees) wherein the pump systems are fluidly coupled to different wells but to the same power supply and/or fluid supply, the magnitude of the first and/or second derivative of power demand can be reduced, e.g., such that the first derivative of power demand does not cross line 401 nor line 402.

In some embodiments, the rate on a first frac group may be ramped from a certain flow rate and pressure to a lower flow rate and pressure in 120 seconds (e.g., 10 to 400 seconds, 50 to 300 seconds, 100-200 seconds, or 110 to 130 seconds) as the rate on a second frac group is ramped from a certain flow rate and pressure to a higher flow rate and pressure in the same period. The overall electrical load of the system may be held approximately constant during the transition such that the voltage and frequency of the electrical supply generation equipment stays within acceptable operating conditions and no blackout or equipment damage occurs. This may allow for very fast rate changes in an electrical frac spread without damaging the electrical components and while keeping the energy state of the power source and/or the fluid system approximately constant. Frac blenders may be run at approximately same rate to minimize impacts on the mixing system prior to the frac pumps. This may allow for formation analysis with electric frac spreads on simulfrac operations. As a result, cyclic pulsing on multiple wells may be achieved with an electric fracturing system.

The period of the oscillations could be 10 to 20 seconds, 5 to 30 seconds, or even greater than 30 seconds. Oscillations at these frequencies may enhance the effectiveness of hydraulic fracking. The amplitude could be, for example, 50 to 70 bmp, 30 to 90 bpm, less than 30 bpm, or greater than 90 bpm. The range of the oscillations could be 40 to 100 bmp, 20 to 160, or 10 to 200 bpm. The amplitude of the oscillations could be 50 to 70, 20 to 120, 10 to 200, or greater than 200 bpm.

A pump system comprising two or more independent electric frac pumps performing multifrac (e.g., simulfrac, trifrac, quadfrac, etc.) or similar operations may have a common power supply. The electric frac system may move pumping energy from a first well group (e.g., one or more well) to a second well group (e.g., one or more other wells). The second well group's formations may have already been opened up by pumping to the point that fracture is initiated such that second well group is able to receive the pumping energy transfer from the first well group. In other words, the wells may be capable of taking on the addition flow rate without over pressuring. Various pressure profiles may be created by oscillating power from first well group to second well group and vice versa.

The first and second well group may include more than one stage with one or more wells, and thus one or more pumping systems with a common energy source. In some embodiments, a large load bank could be used to absorb the load during the described transfer as heat or other forms of energy. A load bank could be used to change the stiffness of the power system for a single well as well as for simulfrac pumping operations.

Figure 18:
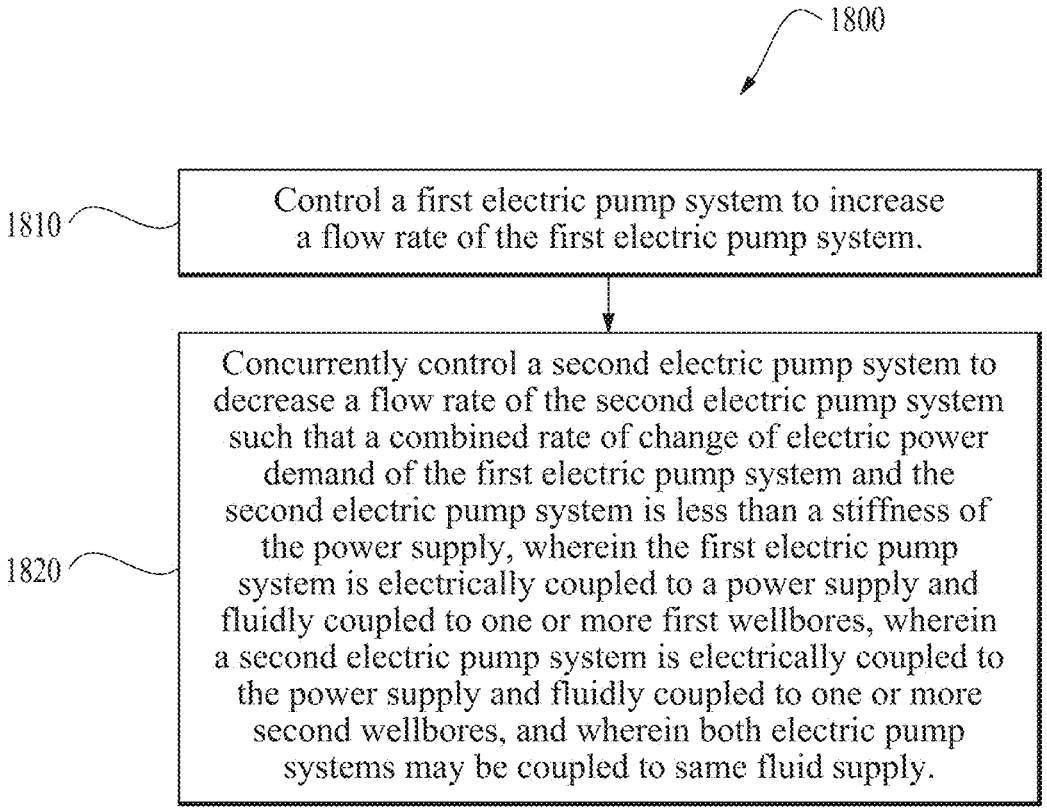
FIG. 18 is a flow diagram of an exemplary method for hydraulic fracturing with a modulating flow rate, according to an embodiment.

Referring to FIG. 18, a method 1800 for hydraulic fracturing with a modulating flow rate may include the step 1810 of controlling a first electric pump system to increase a flow rate of the first electric pump system and the step 1820 of concurrently controlling a second electric pump system to decrease a flow rate of the second electric pump system such that a combined rate of change of electric power demand of the first electric pump system and the second electric pump system is less than a stiffness of the power supply, wherein the first electric pump system is electrically coupled to a power supply and fluidly coupled to one or more first wellbores, and wherein a second electric pump system is electrically coupled to the power supply and fluidly coupled to one or more second wellbores.

Figure 19:
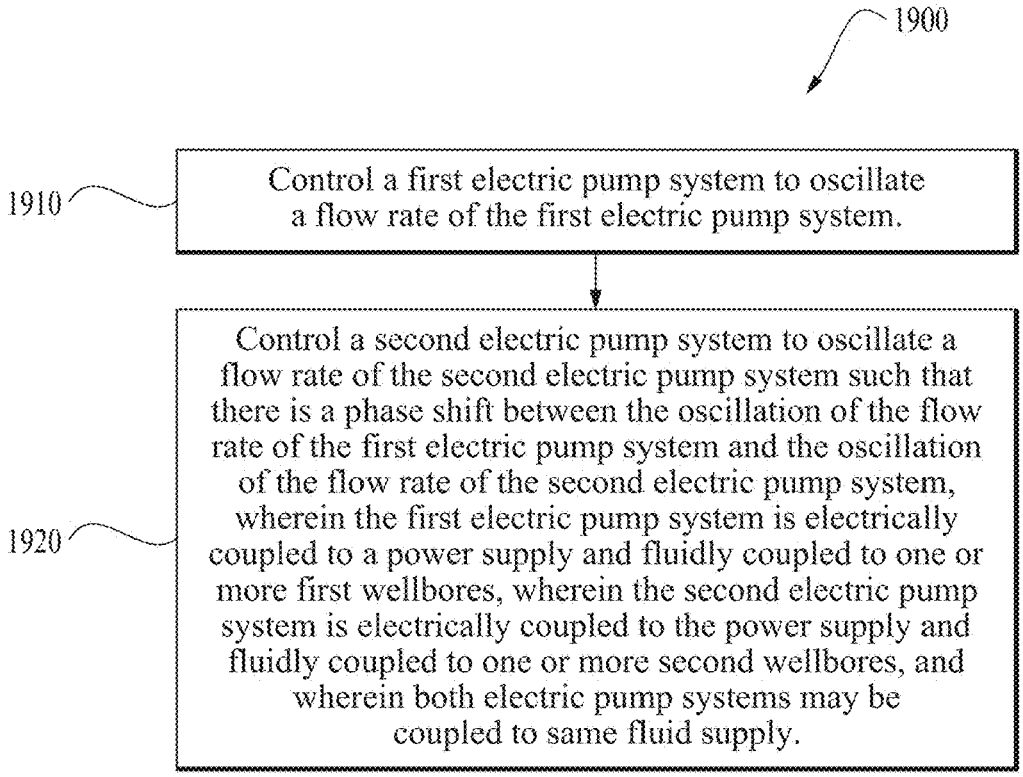
FIG. 19 is a flow diagram of an exemplary method for hydraulic fracturing with an oscillating flow rate, according to an embodiment.

Referring to FIG. 19, a method 1900 for hydraulic fracturing with an oscillating flow rate may include the step 1910 of controlling a first electric pump system to oscillate a flow rate of the first electric pump system and the step 1920 of controlling a second electric pump system to oscillate a flow rate of the second electric pump system such that there is a phase shift between the oscillation of the flow rate of the first electric pump system and the oscillation of the flow rate of the second electric pump system, wherein the first electric pump system is electrically coupled to a power supply and fluidly coupled to one or more first wellbores, and wherein the second electric pump system is electrically coupled to the power supply and fluidly coupled to one or more second wellbores.

Figure 20:
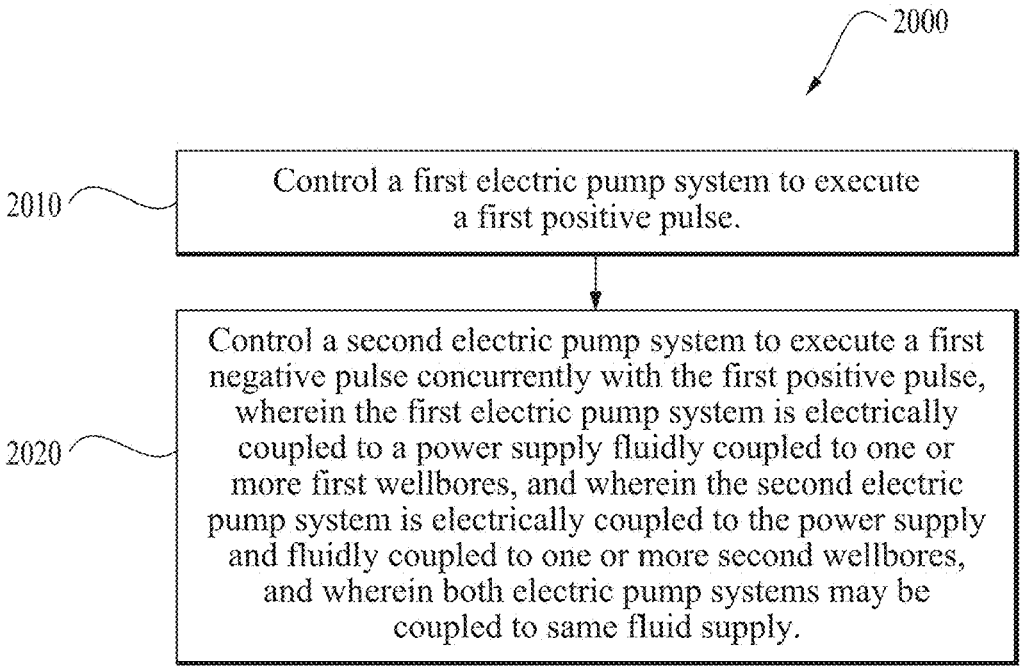
FIG. 20 is a flow diagram of an exemplary method for sending pulses into wellbores, according to an embodiment.

Referring to FIG. 20, a method 2000 for sending pulses into wellbores may include the step 2010 of controlling a first electric pump system to execute a first positive pulse, and the step 2020 of controlling a second electric pump system to execute a first negative pulse concurrently with the first positive pulse, wherein the first electric pump system is electrically coupled to a power supply and fluidly coupled to one or more first wellbores, and wherein the second electric pump system is electrically coupled to the power supply and fluidly coupled to one or more second wellbores.

Figure 21:
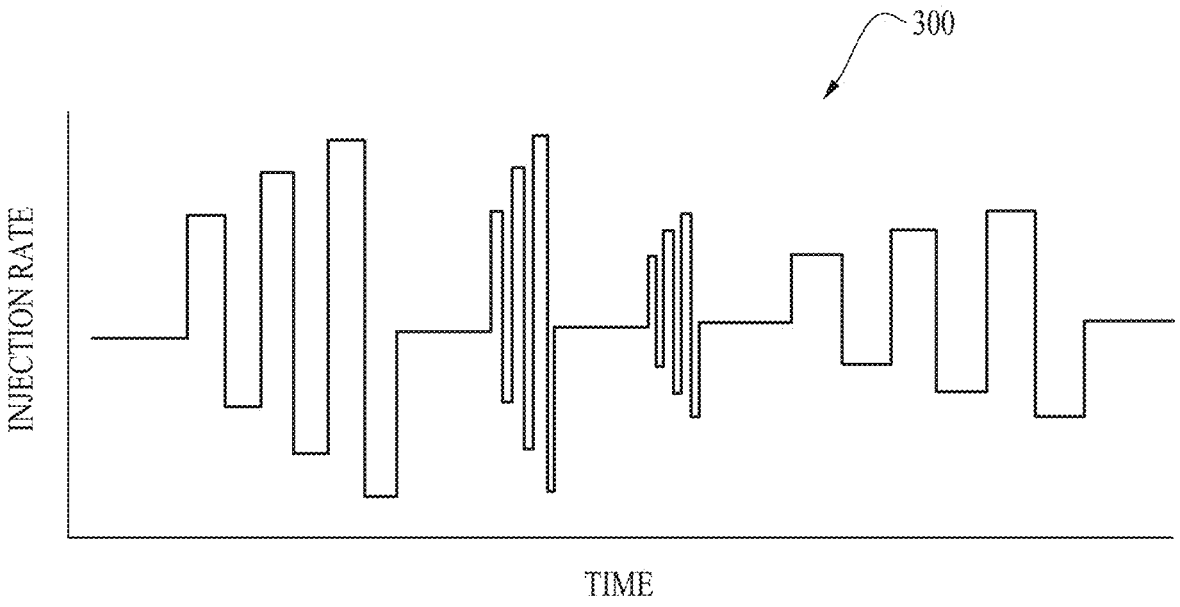
FIG. 21 is a graph of a square wave function of injection rate, according to an embodiment.
Figure 22:
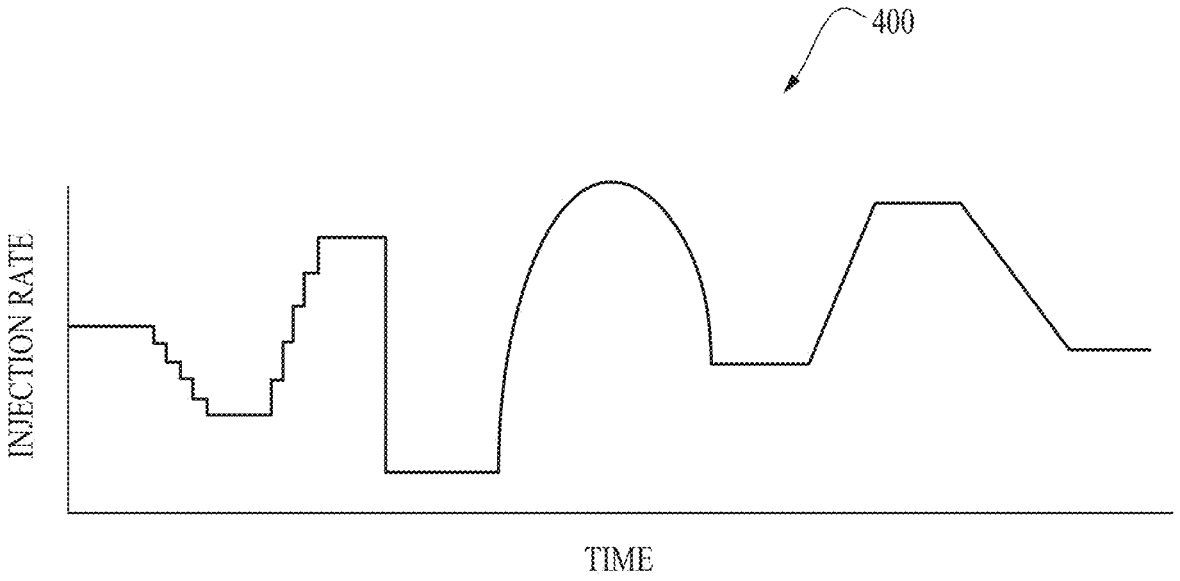
FIG. 22 is a graph of a varying wave function of injection rate, according to an embodiment.
Figure 23:
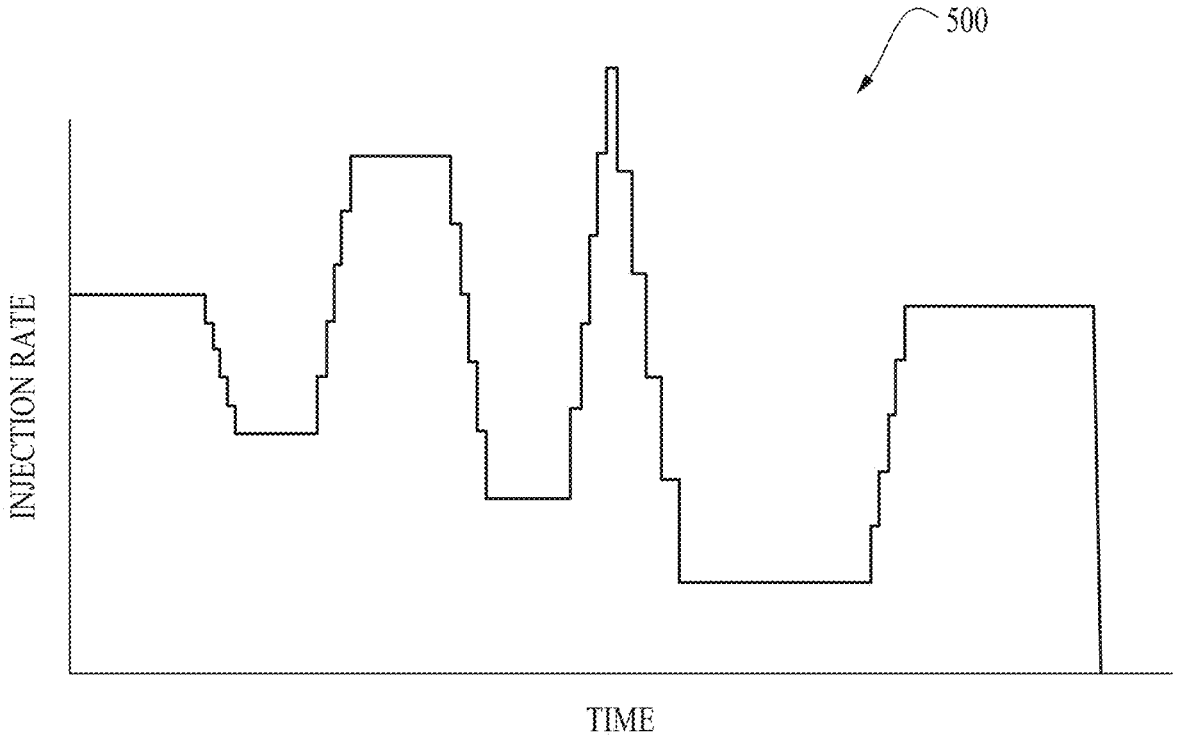
FIG. 23 is a graph of a wave function of injection rate with multiple steps, according to an embodiment.

Any of the multifrac systems and methods (e.g., the methods of FIGS. 18-20) may be used with any waveform disclosed herein or any other suitable waveform. For example, FIGS. 21-23 illustrate graphs of example modulations of the electric pump. FIG. 21 illustrates a graph 300 of a square rate function being modulated. The processor 125 (see, for example, FIG. 8) may actuate the electric pump system 137 to vary the amplitude, frequency, or both. FIG. 22 illustrates a graph 400 of different rate functions being modulated. As illustrated, the injection rate may have a square rate function at an initial position. In some embodiments, the processor 125 may actuate the electric pump 137 to change the rate function to any other suitable rate function, including, but not limited to, a polynomial rate function or a linear rate function. In addition to varying the rate functions, the processor 125 may actuate the electric pump system 137 to vary the amplitude, frequency, or both of the injection rate. FIG. 23 illustrates a graph 500 wherein multiple step rate tests and step down tests are performed. Each step rate or step down test may comprise modulating the injection rate in stepped increments. The modulation may occur by varying the amplitude, frequency, or both of the injection rate.

In the examples illustrated in FIGS. 21-23, the different amplitudes of the rate functions may be used to evaluate fracture growth parameters based on the separation of perforation friction and tortuosity friction to determine the actual net treating pressure within the fracture. Changing the rate function may be performed to try to separate different parameters, such as perforation friction and near-wellbore tortuosity. The control for changing rate in exact increments may reduce the uncertainty in separating the perforation friction and tortuosity friction.

The frequency of the rate functions may be utilized for multiple purposes. One example purpose may be to utilize the natural frequency of the wellbore 105 and the frequency of rate modulation to target specific well depths for potential wave interference from reflected waves and pumping waves to create high magnitude pressure pulses within the wellbore 105. The frequencies may be varied to target different depths that may correspond to different perforated intervals to enable improved perforation breakdown to be achieved.

Pressure monitoring may be performed in offset wellbores to detect fracture communication between different wells and a treatment well. There may be limited information regarding the poroelastic response or direct pressure communication between wells. In one or more embodiments, the direct pressure communication may be the detection of a pressure change in a treatment well from an offset well. The modulation of the flow rate in both amplitude and frequency may assess the communication between wells by examining the buffering that may occur within a system of fractures 155. In one or more embodiments, buffering may either be the attenuation of the amplitude of a signal or the changes in the phases between the signal at a treatment well and a offset well. The degree of buffering may be directly related to the degree of communication.

Any of the methods disclosed herein of managing power using a multifrac configuration may be combined with any of the methods of sending pressure waves down a wellbore (e.g., pressure pulses for diagnostics, flow rate oscillations for enhanced fracturing, etc.) and/or oscillating flow rate down a wellbore. The oscillation waveform may be any suitable waveform such as a sinusoidal, square, trapezoidal, or an irregular waveform. In some embodiments, the waveform may change frequency and/or amplitude and/or shape over time. The power supply may be according to any of the configurations disclosed herein or any other suitable configuration. For example, the power supply may comprise a grid, one or more mobile generators, and/or a hybrid configuration (e.g., a hybrid power source that is part grid and part mobile generators).

In certain fracking operations, such as geothermal and chemical mining, interconnected fractures may be desirable. Without wishing to be bound by any theory, because the oscillations between adjacent wells may be out of phase (e.g., 180 degrees), communication between the fractures of adjacent wellbores may be enhanced.

Various systems and methods are described herein as preventing an overall or combined rate of change of power demand (e.g., first derivative of power demand) from exceeding a stiffness of a power source (e.g., the maximum rate of change of power the power source is able to provide, e.g., first derivative of available power supply). However, it is also within the scope of the present disclosure to prevent an overall second derivative of power demand from exceeding an ability of the power supply to provide the corresponding second derivative of power supply using the same or similar methods. For example, in some embodiments, a method includes controlling a first electric pump system to increase a rate of change of rate of change of flow rate of the first electric pump system and concurrently controlling a second electric pump system to decrease a rate of change of rate of change of flow rate of the second electric pump system such that a combined rate of change of rate of change of electric power demand of the first electric pump system and the second electric pump system is less than a rate of change of rate of change of power that the power supply is capable of providing, wherein the first electric pump system is electrically coupled to a power supply and fluidly coupled to one or more first wellbores, and wherein a second electric pump system is electrically coupled to the power supply and fluidly coupled to one or more second wellbores. Similarly, all of the disclosure described herein with respect to the first time derivative of fluid demand and the first time derivative of the fluid supply may be adapted (e.g., in a similar manner) to the second time derivative of fluid demand and the second time derivative of fluid supply.

In addition to the methods described herein involving controlling waveforms of the electric pumps in a multifrac configuration to mitigate a rate of change of power demand (see, for example, FIG. 8), diesel pumps can also be used in combination with the electric pumps (see, for example, FIG. 7) according to any of the embodiments described herein to further mitigate the rate of change of power demand while achieving a desired waveform.

Figure 9:
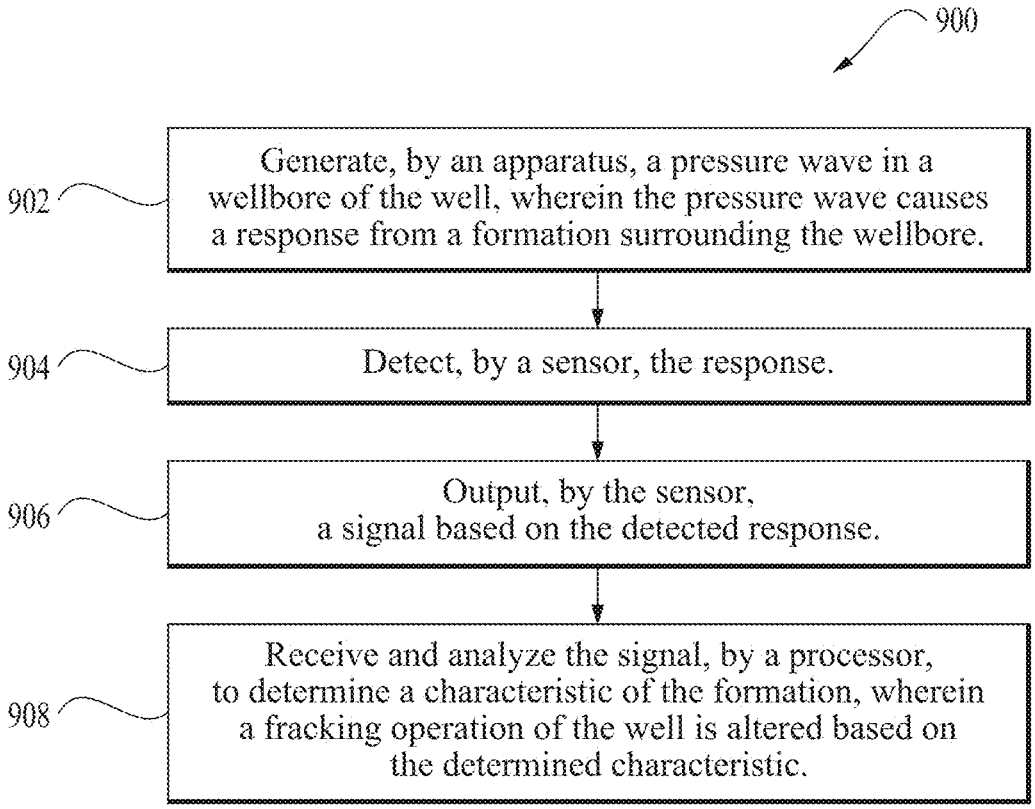
FIG. 9 is a flow diagram of an exemplary method for monitoring hydraulic fracturing of a well.

Referring to FIG. 9, an exemplary method 900 of monitoring hydraulic fracturing of a well is shown. The method 900 may include the step 902 of generating, by an apparatus, a pressure wave in a wellbore of the well, wherein the pressure wave causes a response from a formation surrounding the wellbore. The method 900 may further include the step 904 of detecting, by a sensor, the response. The method 900 may further include the step 906 of outputting, by the sensor, a signal based on the detected response. The method 900 may further include the step 908 of receiving and analyzing the signal, by a processor, to determine a characteristic of the formation, wherein a fracking operation of the well is altered based on the determined characteristic. This method 900 may present the advantage of enhancing the effectiveness of fracking by gaining information about the state of the fracture and taking appropriate action.

Figure 10:
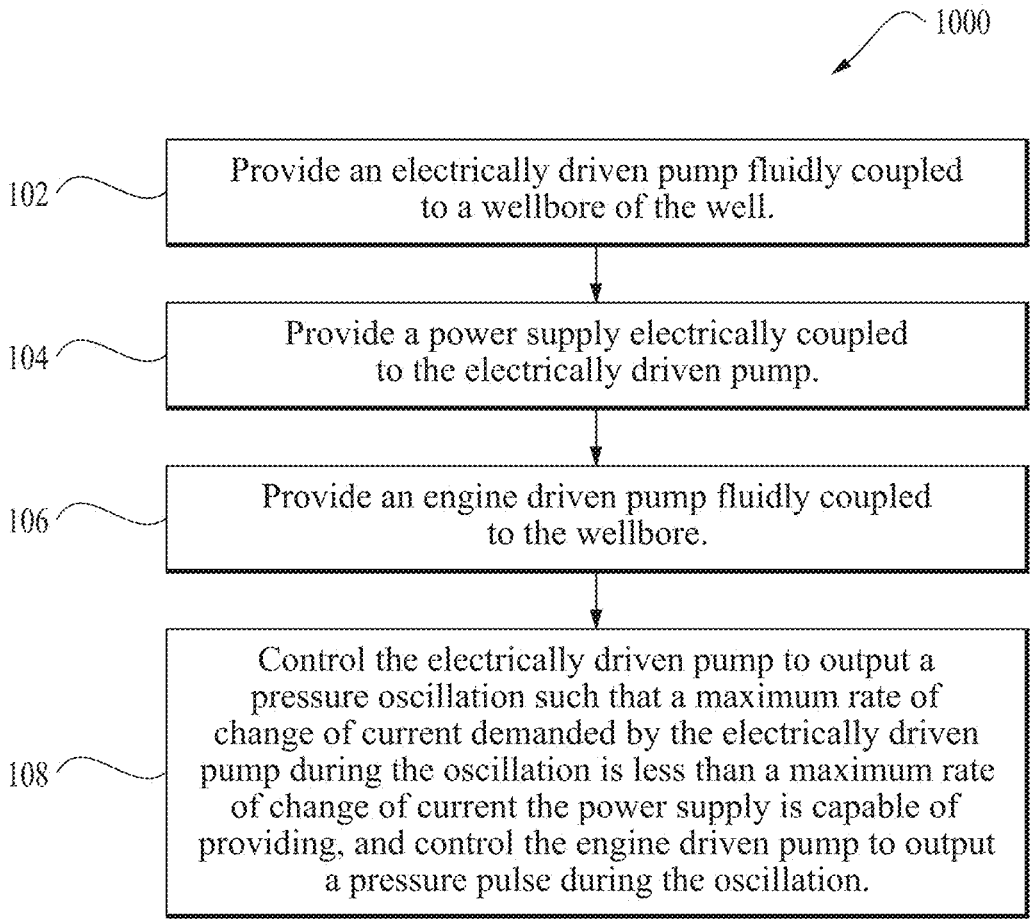
FIG. 10 is a flow diagram of an exemplary method for sending a diagnostic pressure signal into a well.

Referring to FIG. 10, an exemplary method 1000 of sending a diagnostic pressure signal into a well is shown. The method 1000 may include the step 102 of providing an electrically driven pump fluidly coupled to a wellbore of the well. The method 1000 may further include the step 104 of providing a power supply electrically coupled to the electrically driven pump. The method 1000 may further include the step 106 of providing an engine driven pump fluidly coupled to the wellbore. The method 1000 may further include the step 108 of controlling the electrically driven pump to output a pressure oscillation such that a maximum rate of change of current demanded/consumed by the electrically driven pump during the oscillation is less than a maximum rate of change of current the power supply is capable of providing, and controlling the engine driven pump to output a pressure pulse during the oscillation. The pressure pulse executed by the engine driven pump may be steeper than the electric driven pump could execute without exceeding the stiffness of the power supply. Thus, this method may enable simultaneous diagnostic of the formation via the pulse and fracturing of the formation via the oscillation.

Figure 12A:
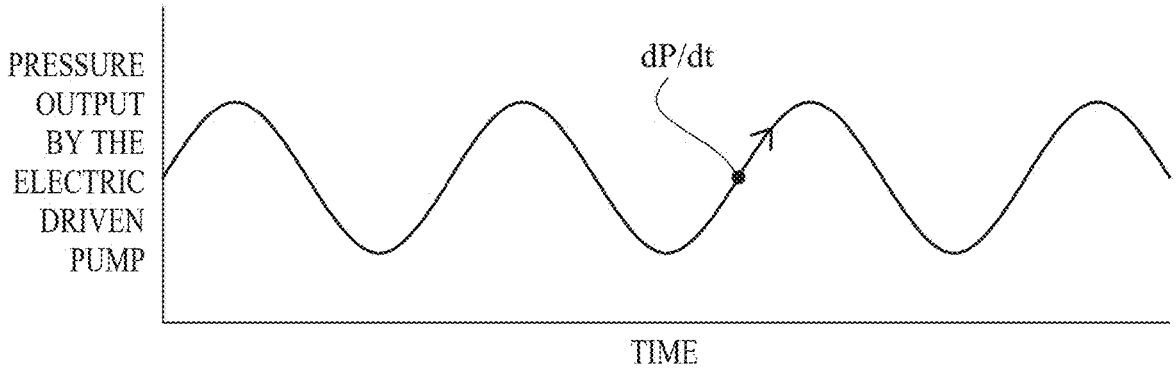
FIG. 12A is a graph of pressure output by the electric driven pump, according to an embodiment.
Figure 12B:
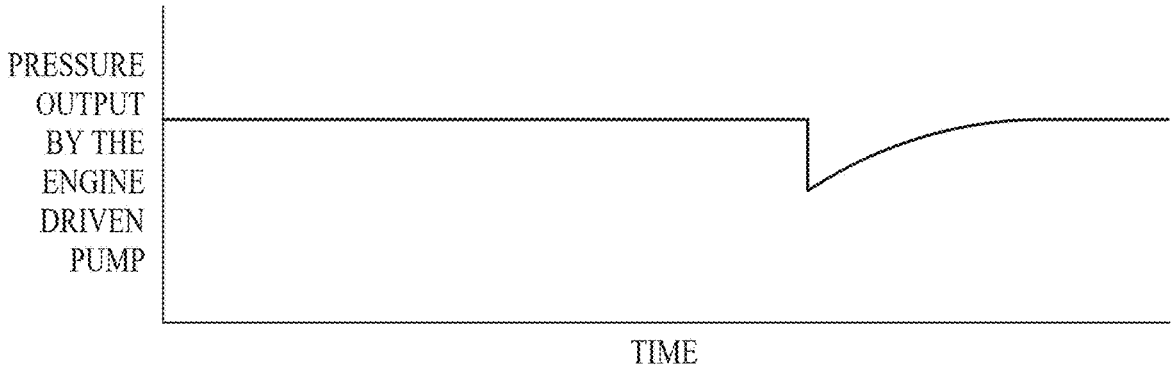
FIG. 12B is a graph of pressure output by the engine driven pump, according to an embodiment.
Figure 12C:
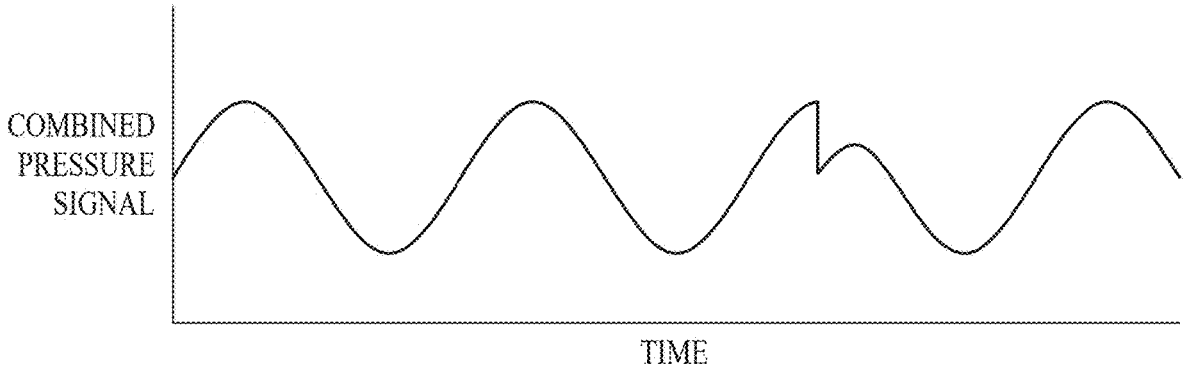
FIG. 12C is a graph of a combined pressure signal of the electric driven pump of FIG. 12A and the engine driven pump of FIG. 12B.

FIGS. 12A-12C illustrate an example of the implementation of the method of FIG. 10. In FIG. 12A, the pressure output by the electric driven pump is shown. In FIG. 12A, the pressure oscillations are shown as a sine wave, but any waveform is within the scope of the present disclosure. The graph is labeled dP/dt at a point in time at which the change in pressure (e.g., pressure change per time) is at maximum. This may also be the point in time at which the rate of change of flow rate (e.g., change in flow rate per time dQ/dt) is at maximum. This may also be the point in time at which the rate of change in electrical current demanded by the electric driven pump is at maximum. The controller may control the oscillation such that dP/dt and/or dQ/dt does not cause a demand of a rate of change in the electrical current (e.g., change in current per time) that exceeds the capability (e.g., stiffness) of the power source (e.g., power grid and/or generators). FIG. 12B shows the pressure output by the engine driven pump having a downward spike during the oscillation of the pressure output by the electric driven pump which is shown in FIG. 12A. In this example, the downward spike in FIG. 12B may be accomplished by rapidly stopping or slowing down the engine driven pump and then more slowly increasing (e.g., ramping up) the flow rate of the engine driven pump. In some embodiments, the pulse is caused by various other methods (e.g., by a flapper valve or modulating pump valves). Because the electric driven pump and the engine driven pump may be both fluidly coupled to the wellbore of the well, the pressure signal of the electric driven pump and the pressure signal of the engine driven pump may be additive to yield the combined pressure signal. In this example, the combined pressure signal feature oscillations designed to fracture the formation and a pulse designed to be reflected by the formation, detected by a sensor upon reflection, and analyzed to determine a state of the fracturing of the formation. The determined state of fracturing of the formation can then be used to adjust the frequency and/or amplitude of the oscillation and/or adjust another operation related to the fracking.

Figure 11:
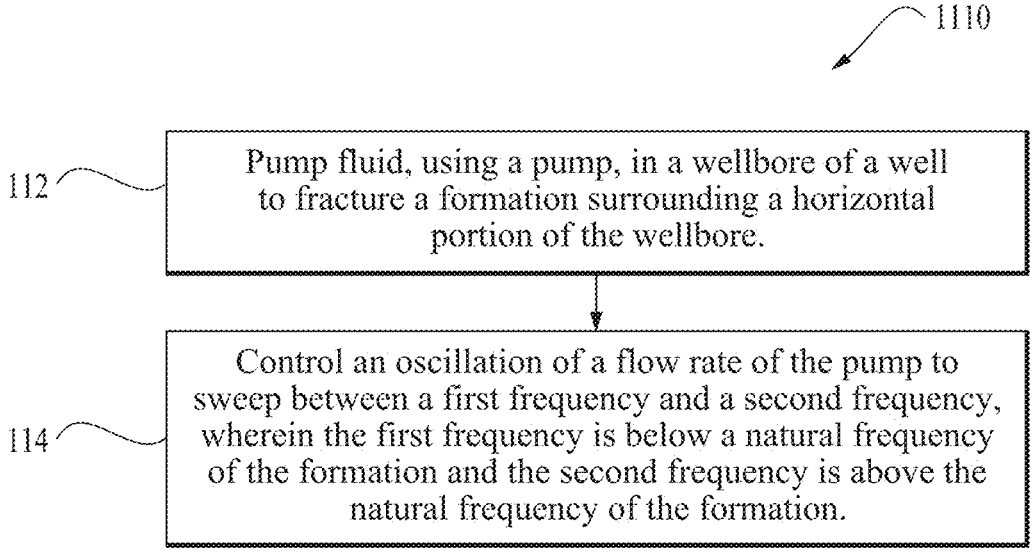
FIG. 11 is a flow diagram of an exemplary method for hydraulic fracturing.

Referring to FIG. 11, an exemplary method 1100 of hydraulic fracturing is shown. The method 1100 may include the step 112 of pumping fluid, using a pump, in a wellbore of a well to fracture a formation surrounding a horizontal portion of the wellbore. The method 1100 may further include the step 114 of controlling an oscillation of a flow rate of the pump to sweep or alternate between a first frequency and a second frequency, wherein the first frequency is below a natural frequency of the formation and the second frequency is above the natural frequency of the formation. The oscillation between the first frequency and the second frequency may be gradual so that there is a high likelihood that the natural frequency of the formation will be covered by this sweep. This may enhance fracturing effectiveness. In some embodiments, the transition from the first frequency to the second frequency may be done continuously over thirty minutes or more; and the transition from the second frequency to the first frequency may be done continuously over thirty minutes or more. In some embodiments, the oscillation may be a sine wave and the pulse may be a square wave. Sweeping between the first frequency and the second frequency may ensure that the natural frequency of the formation is attained at least for part of the fracking duration.

Figure 13A:
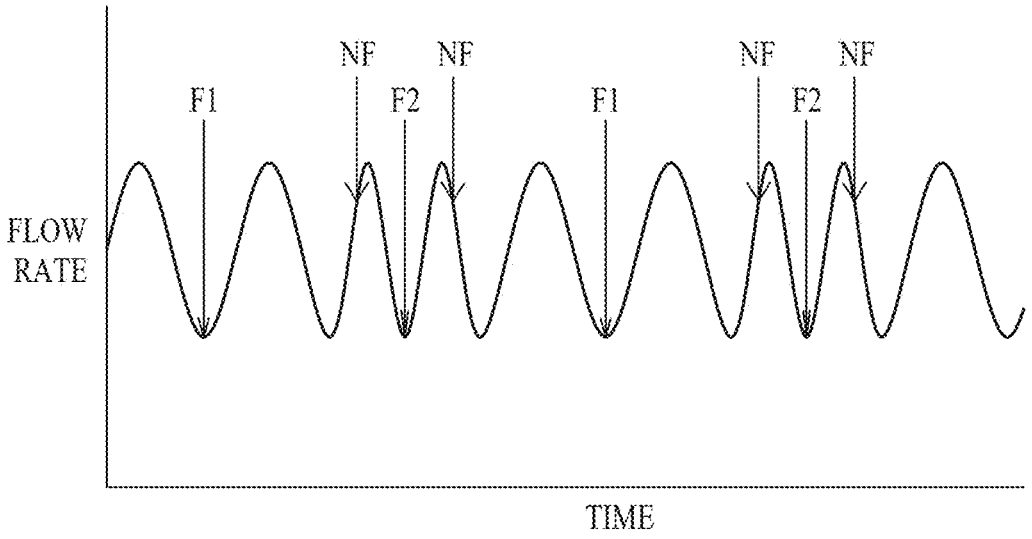
FIG. 13A is a graph conceptually illustrating the oscillation of flow rate, according to an embodiment.
Figure 13B:
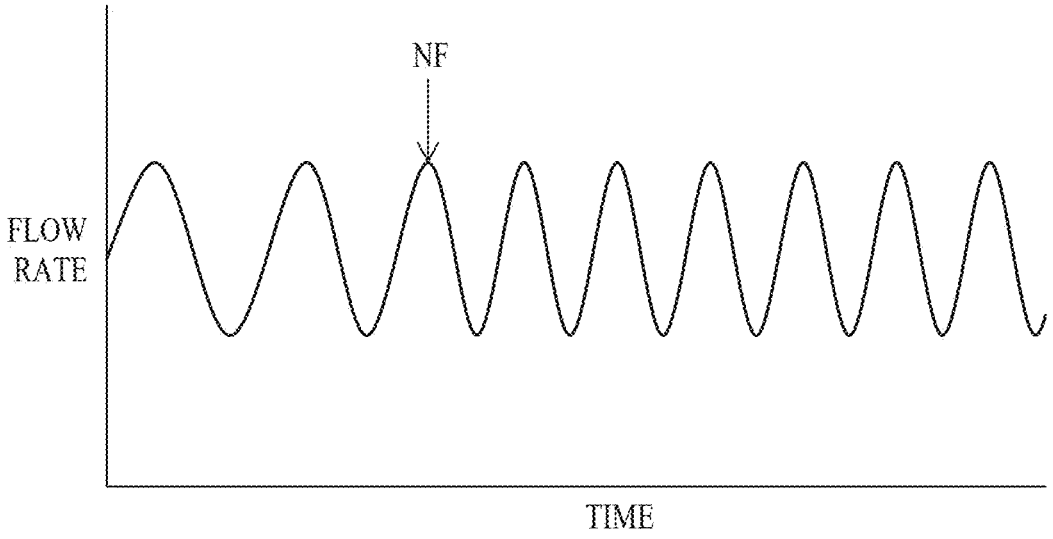
FIG. 13B is a graph conceptually illustrating an adjustment of the oscillation of flow rate to match the natural frequency of the formation, according to an embodiment.

FIGS. 13A-13B illustrate an example implementation of the method of FIG. 11. It should be apparent that graph of FIG. 13 is only for conceptual illustration and is not to scale. As shown in FIG. 13A, the electrically driven pump may output a flow rate that oscillates. The oscillation may sweep (in this example, alternate) between a first frequency F1 and a second frequency F2. That is, the frequency of the oscillation (in this example, a sine wave) may change over time. The first frequency may be below a natural frequency NF of the formation and the second frequency may be above the natural frequency NF of the formation. During the sweep, the natural frequency may be reached at various points. This may be advantageous because it may promote fracturing of the formation. In the example of FIG. 13B, pressure waves may be output at a certain frequency and may be reflected off of the formation and may be analyzed by a processor (e.g., using the method discussed with relation to FIG. 3). The pressure waves may be increasing in frequency, decreasing in frequency, part of an alternation, part of a sweep, or any other suitable wave. Once the natural frequency of the formation is estimated, the flow rate oscillations may be adjusted to have a frequency that matches (e.g., is the same as) the estimated natural frequency NF of the formation. In this example, the estimated natural frequency is matched at the point in time indicated by NF, and then the pump continues to output that natural frequency (e.g., frequency in terms of flow rate). In some embodiments, this is an iterative process in which the natural frequency is estimated multiple times and followed by an adjustment if necessary. In some embodiments, the frequency of the oscillations is set at the estimated natural frequency and then increased or decreased according to a predicted increase or decrease in natural frequency of the formation. Matching the frequency of the formation may enhance fracking effectiveness.

The system and method of the present disclosure may create cyclical pressure waves in a wellbore by modulating flow rate while staying within equipment limitations. The system and method may use various algorithms, open-loop control, and/or closed-loop control to generate a desired waveform. The system and method may apply stress/strain cycles to a wellbore (e.g., by pumping fluid down the wellbore at an oscillating flow rate). This may fatigue the formation and improve some aspect of hydrocarbon production. The fatigue in the formation caused by the oscillating flow rate may be enhanced as compared with the conventional art. Other advantageous physical effects besides fatigue may also be achieved.

Referring to FIG. 24, an example oscillation induced on a wellbore is shown. Referring to FIG. 24A, flow rate (of one or more pumps in fluid communication with one or more wellbores) may be controlled to oscillate, for example, in a sine wave. Pressure at the wellhead and/or downhole pressure (e.g., bottomhole pressure) may be monitored. For example, FIG. 24B shows wellhead pressure which may be measured with a pressure gauge. FIG. 24C shows downhole pressure which may be measured with a downhole pressure gauge, measured with a fiber optic cable, or estimated numerically based on wellbore geometry. In some embodiments, bottomhole pressure is calculated based on the pressure applied by the pumps and the hydrostatic pressure inside the wellbore. The flow rate, wellhead pressure, and downhole pressure may have the same frequency and phase.

Figure 24A:
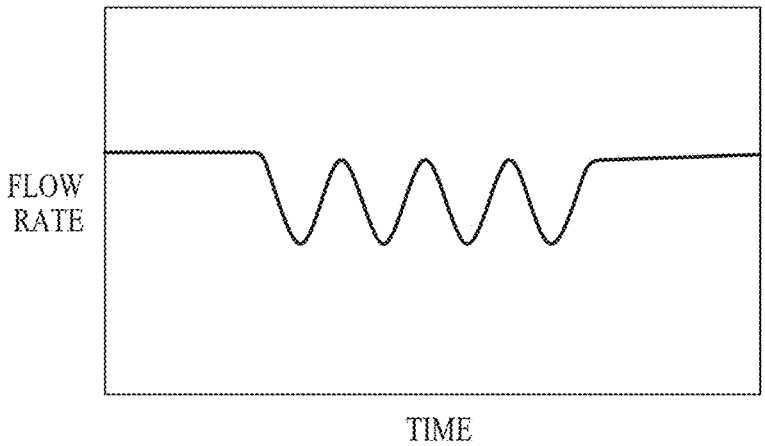
FIG. 24A is a graph of flow rate over time, according to an embodiment.
Figure 24B:
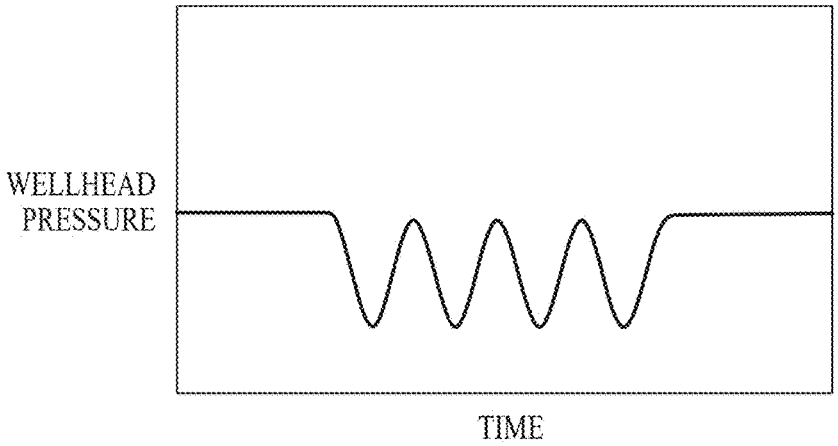
FIG. 24B is a graph of wellhead pressure over time, according to an embodiment.
Figure 24C:
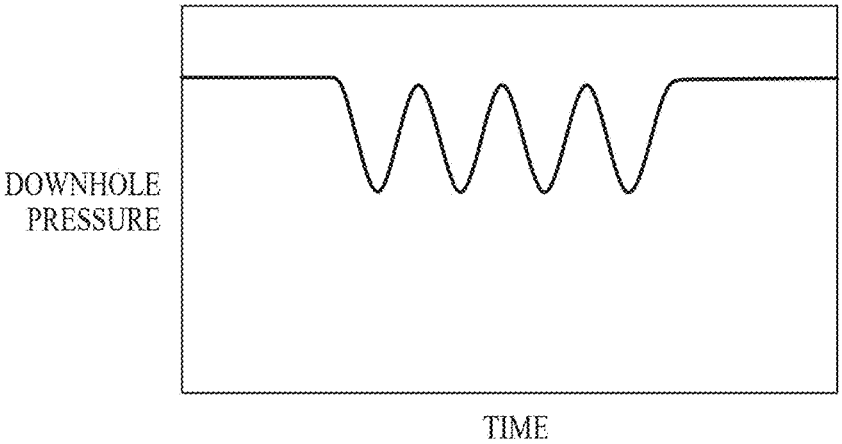
FIG. 24C is a graph of downhole pressure over time, according to an embodiment.
Figure 24D:
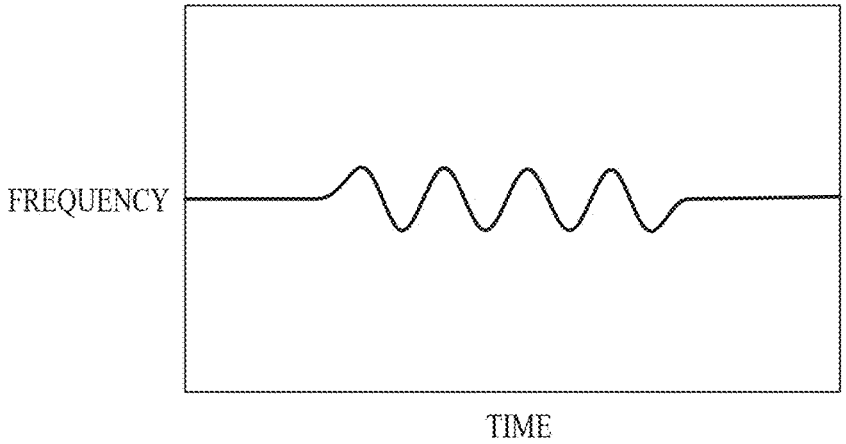
FIG. 24D is a graph of frequency over time, according to an embodiment.
Figure 24E:
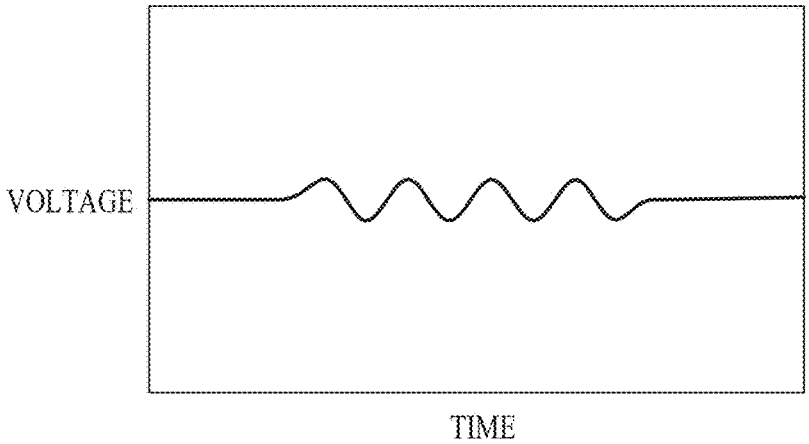
FIG. 24E is a graph of voltage over time, according to an embodiment.

In some embodiments, the method includes imparting oscillating downhole pressure to the wellbore by controlling the flow rate from the pumping system. The pumping system may include one or more electric pumps and/or one or more diesel pumps. In the embodiments in which electric pumps are used, the oscillating flow rate from the pumps may cause the supplied voltage and frequency to the pump to vary significantly. For example, FIG. 24D shows an exemplary frequency of electric power supplied to the pump system (e.g., by a variable frequency drive). The frequency of the oscillation of the frequency of the supplied electric power may be the same as the frequency of the oscillation in flow rate but phase shifted (e.g., by approximately 180 degrees). This may be because as the flow rate goes down, the gensets are being unloaded, which may cause them to speed up. Regulation may then try to bring the speed back down. This process may repeat during the oscillation of the flow rate, which may create the oscillation of the frequency of the supplied electric power. FIG. 24E shows an exemplary voltage of electric power supplied to the pump system (e.g., by a variable frequency drive). The frequency of the oscillation in voltage may be the same as the frequency of the flow rate but may be out of phase (e.g., by approximately 180 degrees). The varying frequency and voltage of electric power required by the pump system to execute the oscillating flow rate may be managed according to the various methods disclosed herein.

Figure 25A:
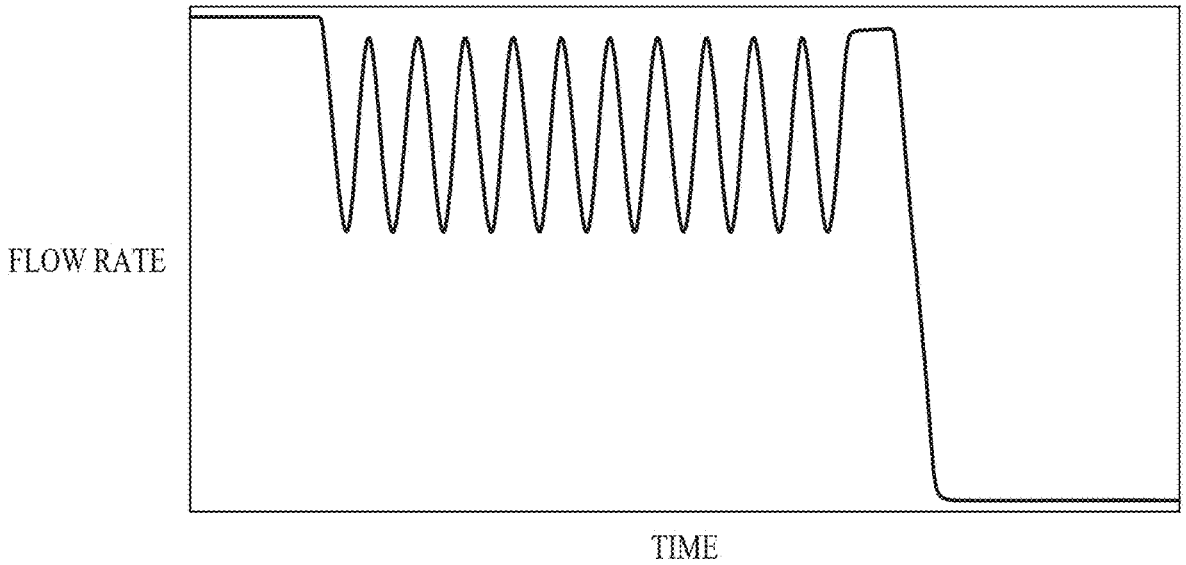
FIG. 25A is a graph of flow rate over time, according to an embodiment.
Figure 25B:
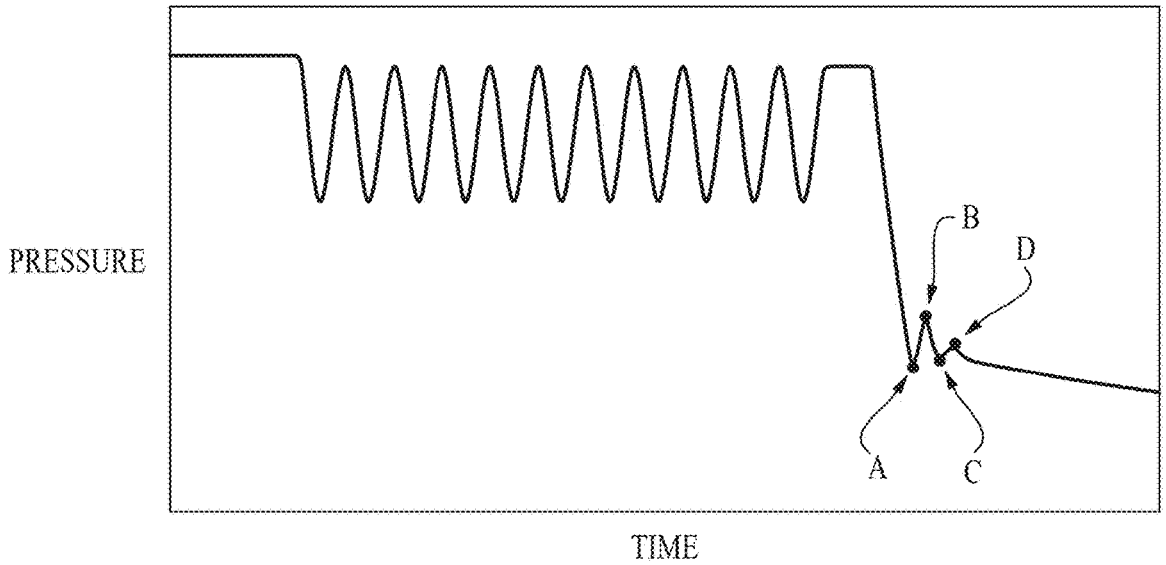
FIG. 25B is a graph of pressure over time, according to an embodiment.

Referring to FIG. 25, an example frequency/period of the induced oscillations and an example step response of the wellbore is shown. The frequency of flow rate output by the pump system may be set based on (e.g., in relation to or in consideration of) an estimated natural frequency of the wellbore. The natural frequency of the wellbore may be estimated according to any of the methods disclosed herein. In the example of FIG. 25, flow rate is oscillated for a duration, which causes an oscillation in pressure at the same frequency as and in phase with the oscillation in flow rate. The flow rate may then be held constant for a duration, and then sharply reduced (e.g., ramped down to zero or near zero). The flow rate step may create a ringing effect in the wellbore. That is, the wellbore may resonate. Without wishing to be bound by any theory, the resonance observed may be primarily a function of the wellbore length and the properties of the fluid in the wellbore. Managing the driving frequency of the pumps with respect to the natural frequency of the wellbore may be an aspect of the method. For example, the frequency of the ringing of the wellbore may be determined, which may be used to set the frequency of a future oscillation in flow rate. The natural period of the wellbore may be determined based on a resonance pressure signal from the wellbore. In the example of FIG. 25B, a time difference between a time stamp of point A and a time stamp of point C may be calculated to obtain the natural period of the wellbore. Alternatively, a time difference between a time stamp of point B and a time stamp of point D may be calculated to obtain the natural period of the wellbore. The inverse of the natural period may be taken to obtain the natural frequency of the wellbore. The output flow rate can then be set at or near the natural frequency of the wellbore or a harmonic of the natural frequency of the wellbore. Natural frequency may also be estimated theoretically. Given a measure depth of a fracturing stage is L, and the acoustic velocity (a.k.a., speed of sound) is c, the oscillation period is 4*L/c and hence the natural frequency c/(4*L). The acoustic velocity may be obtained from a materials library, from lab testing, or from time of travel between two pressure transducers separated by known distance.

Figure 26A:
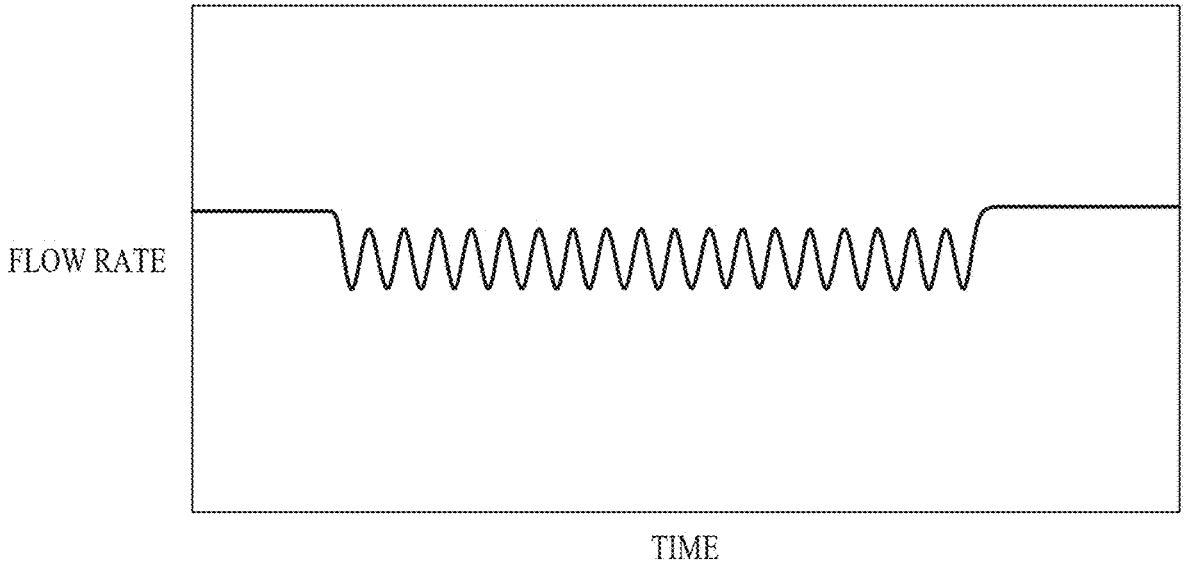
FIG. 26A is a graph of flow rate over time, according to an embodiment.
Figure 26B:
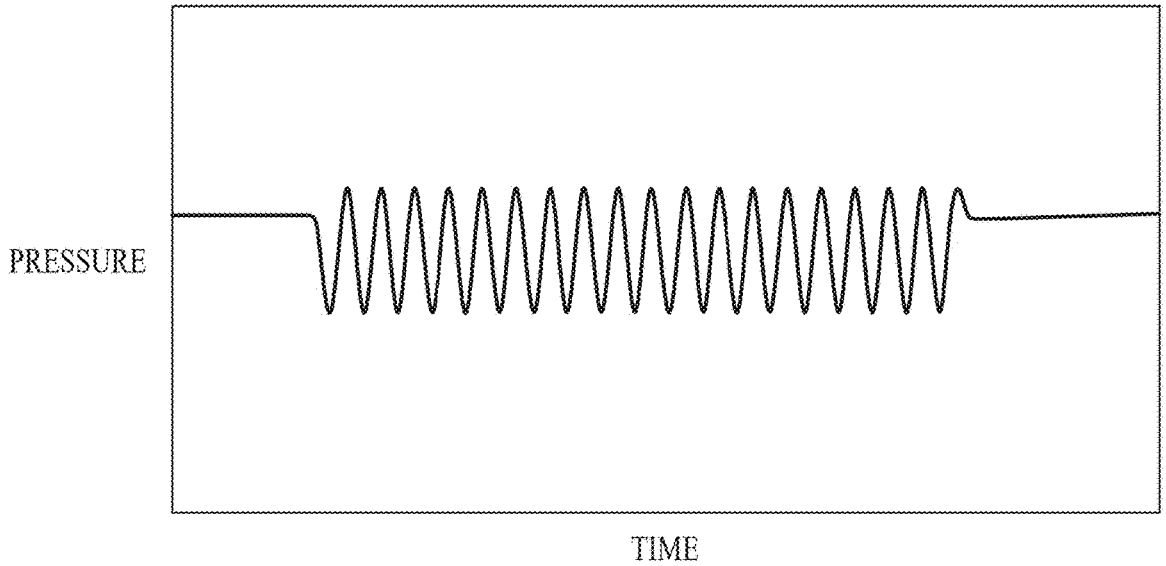
FIG. 26B is a graph of pressure over time, according to an embodiment.

Referring to FIG. 26, an oscillation is shown where the driving frequency is very near the wellbore resonance. Advantageously, when the driving frequency (e.g., flow rate from the pumps) is very near the wellbore resonance, the peak pressure amplitude in the oscillation may exceed the constant pressure level when the pump is being driven at steady state at the same power level. In other words, the maximum pressure amplitude while oscillating may be higher than the steady-state pressure before starting the oscillation. Without wishing to be bound by any theory, this phenomenon is believed to be caused by the pressure response from the wellbore when it is excited at its natural frequency.

Flow rate oscillations may impact the power system. In some embodiments, the power source is an array of local generators that forms a power source island that is independent of any utility/grid connection. In these embodiments, the oscillations may have a minor effect on the voltage supplied, however the frequency (e.g., nominally 60 Hz) may be significantly affected by the load changes. One metric used to quantify power generation limitations may be the rate of change of power per time. This may be presented as a percentage of the power capacity that is changed in one second. For example, a 2 MW change in one second with a 20 MW power capacity is 10 percent per second. The systems and methods disclosed herein may limit this rate of change to prevent blacking out the power source.

In the embodiments in which utility/grid power is used, there may be a different profile when oscillating. Line frequency may be relatively stable but line voltage is may vary, e.g., due to voltage drop in the power lines.

The system and method of the present disclosure may be performed with any suitable type of fracturing fluid. For example, reclaimed water and friction reducer or sand slurries may be used.

In some embodiments, an electric pumping system is used, which may present the advantage of enabling continuous variation of flow rates. Alternatively or additionally, direct drive pumping equipment (DDPE) (e.g., diesel pumps) can be used. For example, DDPE may be able to smoothly vary flow rate over a narrow range strictly by throttle control and may not require shifts in a transmission. In some embodiments, an effective oscillation series could use a "shallow" flow rate variation but oscillate faster and still obtain a desired effect. For example, the DDPE could be controlled to oscillate flow rate at a harmonic of a natural frequency in a range that does not require a gear shift.

The method may be implemented in a single-well configuration (see, for example, FIG. 1) or a multi-well configuration (see, for example, FIG. 8). Referring to FIG. 8, may be two or more wellbores (e.g., wellbores 105), which may be on the same pad or on different pads. The wellbores 105 may be as close as a few feet from each other or as far as several miles or more. The pump systems 137 may be connected to the same power supply despite being miles apart. However, especially if the pump systems 137 are separated by great distances, they may have separate fluid supplies 210.

In some embodiments, each pump system 137 pumps fluid at an oscillating flow rate at the same frequency. In some embodiments, the waveform of the flow rate output by the left pump system 137 may be out of phase with the waveform of the flow rate output by the right pump system 137. For example, the oscillation of the left pump system may be 180 degrees out of phase with the oscillation of the right pump system 137. This may present the advantage in that the power demand on the power supply 142 may remain constant or approximately constant. In other embodiments, the waveform of the flow rate output by the left pump system 137 may be in phase with the waveform of the flow rate output by the right pump system 137. This may present the advantage in that if the wellbores 105 are in close proximity to each other (e.g., in the same subterranean formation 110), there may be constructive interference of the treatment pressure which may enhance effectiveness of the treatment. Although a sinusoidal wave is illustrated in the embodiment of FIG. 8, any suitable waveform is within the scope of the present disclosure.

The processor 125/controller may be any type of controller (or control systems) suitable to control the pump systems 137. The type of controller may depend on how far the pump systems 137 (or the wellheads) are spaced apart. Although for ease of illustration in FIG. 8 there are two wellbores 105 each having a pump system 137, there may be three, four, five, six, seven, eight, nine, ten, or more wellbores 105 each connected to the same controller. They may also be connected to the same power source 142 and/or fluid source 210. Each pump system 137 may comprise one or more electric pumps and/or DDPE (e.g., one or more diesel pumps).

In some embodiments, the method includes oscillating flow rate on one or more wellbores. The flow rate may be oscillated on one or more wellbores with a pump. The flow rate may be oscillated on one or more wellbores with an electric pump. The waveshape, period, amplitude, and/or duration of the flow rate may be determined by an algorithm (e.g., run by a processor/controller) that generates a treatment schedule. For example, the algorithm may calculate the waveshape, period, amplitude, and/or duration of flow rate to generate a desired flow rate profile. The algorithm may use the limitations of the power system or fluid supply system as an input. For example, the algorithm may design the treatment schedule to maximize an amplitude of an oscillation (e.g., sine wave or similar) to the extent possible without exceeding the capabilities of the power supply (e.g., without causing a blackout or a brownout). For example, the oscillation profile may be defined to "ride" the power supply capability. This may be accomplished by capturing dP/dQ, (or pressure sensitivity to flowrate, which can be defined as the ratio of pressure change to flow rate change, if there is a very small amount change in flow rate, for example, 0.1 bpm.), then maximizing dQ/dt (time derivative of flow rate) set such that dPower/dt (time derivative of power) is set to a defined limit. For example, the controller may control flow rate Q over time (e.g., by setting and/or executing a treatment schedule) such that the maximum change in flow rate per time dQ/dt in the treatment schedule is maximized while not causing change in power demand per time (dPower/dt) to exceed the capabilities of the power supply. The controller may do this by relating dQ/dt to dPower/dt using a relationship between flow rate and power or a relationship between flow rate and pressure and a relationship between pressure and power. For example, if the pressure is known as a function of Q, e.g., p=f(Q), then given dQ/dt, the following may be calculated:

$$\frac{d\text{Power}}{dt} = \frac{d(P \times Q)}{dt} = \frac{d(f(Q) \times Q)}{dt} = \frac{df(Q)}{dQ} \times \frac{dQ}{dt} \quad \text{(Equation 1)}$$

The function f(Q) may be established from estimated $$\frac{dP}{dQ}$$

(from Equation 1), e.g., given dP/dQ estimated at pressure $p_0$, f(Q) may be defined as follows:

$$f(Q) = p_0 + \frac{dP}{dQ}\Big|_{p_0} (p - p_0) \quad \text{(Equation 2)}$$

The maximum dPower/dt may be different depending on whether power is increasing or decreasing, and the controller may take this into account. This may lead to irregularly shaped waveforms in the treatment schedule. For example, a sine wave-like waveform may be used in which the maximum magnitude of positive dQ/dt (e.g., from trough to peak) is less than a maximum magnitude of negative dQ/dt (e.g., from peak to trough). Power supply limitations may include frequency, voltage, rate-of-change of power, total power capacity, or the like, any of which may be taken into account when designing the treatment schedule. Mitigation techniques may include creating an island of power generation that is isolated from a utility grid, using local peak-shaving energy storage devices, increasing the power capacity by adding generators, etc. The treatment schedule may be modified dynamically based on changing limitations of the power supply. For example, a generator may go offline dropping the total power supply capacity. In response to detecting that a generator has gone offline, the processor may estimate the new power supply capabilities and then redesign the treatment plan based on the new power supply capabilities.

The algorithm may use the wellbore geometry and other inputs to estimate the natural resonant frequency. The wellbore geometry may be used as a starting point during oscillation when feedback is being used to refine the algorithm. The algorithm may use the output from a step-response test as an input. The step test may be executed at the beginning of an oscillation duration, at an end of the oscillation duration, or during an oscillation duration. A step test at the end of the oscillation duration may be used as a diagnostic technique to help determine a change in a formation characteristic. The algorithm may use the output from a targeted sweep test where the frequency of oscillation is swept and the well response is monitored. For example, an oscillation may start at a frequency below an estimated natural frequency of the wellbore and gradually/smoothly/continuously increased to a frequency above the estimated natural frequency of the wellbore. The response from the wellbore to this sweep may be used to re-estimate the natural frequency of the wellbore. The frequency of the sweep or a constant frequency may be set and executed based on the re-estimated natural frequency. For example, the processor may monitor the pressure in the wellbore during the sweep and determine when peaks of the pressure oscillation are maximized and/or when the peaks of the pressure oscillation exceed the pressure during steady-state pumping. The processor may estimate the natural frequency on this basis. For example, the frequency of flow rate oscillation that results in the greatest peaks in the pressure oscillation may be determined as the natural frequency of the wellbore. The algorithm may use the entry pressure before the oscillation as one of the inputs to determine the natural frequency of the wellbore. The treatment schedule may be adjusted in response to the resulting pressure rising above a predetermined value. For example, the processor may detect pressure peaks above a danger threshold, and in response, control the pumps to output a flow rate oscillation at a frequency farther away from the estimated natural frequency of the wellbore than a previous frequency of output flow rate.

The treatment schedule may be adjusted based on economic factors. For example, the treatment schedule may be modified to minimize the time/cost of the process. In particular, the treatment schedule may be modified to minimize fluid or chemical usage. The treatment schedule may be adjusted continually to maximize a characteristic such as power supply capacity. In some embodiments, estimated effectiveness at achieving wellbore fatigue is balanced against cost of the operation.

A characteristic of the well prior to an oscillation duration and a characteristic of the well after the oscillation duration may be evaluated. For example, a characteristic may be determined via a step-response test (e.g., pressure response is monitored after a flow rate ramp down). In another example, a characteristic of the well is determined during the oscillation sequence (e.g. impedance). For example, the processor may estimate impedance of the wellbore based on a pressure response from the wellbore, and design/alter the treatment plan based on the impedance. In some embodiments, the treatment schedule is adjusted during the oscillation duration based on the derived characteristic. For example, the method may include oscillating flow rate of the pump system, monitoring a response during the oscillating flow rate (or flow rate sequence including an oscillation); analyzing the response to formulate a change in the sequence to increase effectiveness of the treatment; and adjusting the sequence (e.g., frequency, amplitude, or duration of the oscillation) based on the determined change. Any well may be treated according the method of the present disclosure. For example, one or more wellbores of may have been previously treated and the method may be applied in a re-frac scenario. Any of the steps disclosed herein can be performed by one or more processors/controllers.

Referring to FIG. 1, a system 100 for hydraulic fracturing may include a pump system 137 fluidly coupled to a wellbore 105; and a controller (e.g., processor 125) configured to estimate a natural frequency of the wellbore 105 based on a pressure wave response from the wellbore (see FIG. 3), and control the pump system 137 to pump fluid into the wellbore 105 at an oscillating flow rate based on the estimated natural frequency of the wellbore 105. The pump system may include one or more electric pumps and/or one or more diesel pumps (see FIG. 7).

In some embodiments, the controller estimates the natural frequency of the wellbore 105 based on geometry of the wellbore, composition of the fracturing fluid, and/or parameters of the formation. For example, the controller may first estimate the natural frequency of the wellbore 105 without using a pressure response, but then repeat the estimation once the pressure response is obtained. In some embodiments, the controller estimates the natural frequency of the wellbore 105 by controlling the pump system 137 to send a pressure disturbance into the wellbore and analyzing the pressure response from the wellbore. The disturbance may be a pulse (e.g., as illustrated in FIG. 14), a step (e.g., as illustrated in FIG. 12B), a ramp up, a ramp down, or any other suitable waveform to reflect a pressure response off of the wellbore. The disturbance may be generated before, during, or after sending an oscillating flow rate. In some embodiments, the controller begins the oscillation at a frequency based on the pressure response from the wellbore received after the sending the disturbance. For example, the controller may be configured to control the pump system 137 to output a flow oscillation to sweep the natural frequency of the wellbore, match the natural frequency of the wellbore, or hold at near the natural frequency of the wellbore. In some embodiments, the disturbance is generated periodically. After receiving the pressure response from each disturbance, the processor may re-estimate the natural frequency of the wellbore. Based on the re-estimated natural frequency, the processor may adjust a parameter of the flow rate oscillation such as frequency of the oscillation.

The controller may be further configured to control the pump system 137 to generate a pressure disturbance that reflects off of the wellbore 105 to cause the pressure wave response from the wellbore 105. The controller may be further configured to generate a treatment schedule based on the estimated natural frequency of the wellbore. The treatment schedule may include parameters of waveform of the oscillating flow rate, period of the oscillating flow rate, amplitude of the oscillating flow rate, and/or duration of the oscillating flow rate. The system 100 may further include a power supply system 142 electrically coupled to the pump system 137. The controller may be further configured to generate the treatment schedule based on a limitation of the power supply system 142. For example, the controller may design a treatment schedule that is based on the natural frequency of the wellbore but does not overload the power supply system 142 (e.g., by not exceeding the power system's ability to supply a changing rate of power). The system 100 may further include a fluid supply system 210 fluidly coupled to the pump system 137. The controller may be further configured to generate the treatment schedule based on a limitation of the fluid supply system 142. For example, the controller may design a treatment schedule that is based on the natural frequency of the wellbore but does not overload the fluid supply system 210 (e.g., by not exceeding the fluid supply system's ability to supply a changing rate of fluid flow). The controller may be further configured to oscillate the flow rate to sweep across a natural frequency of the wellbore.

Figure 27:
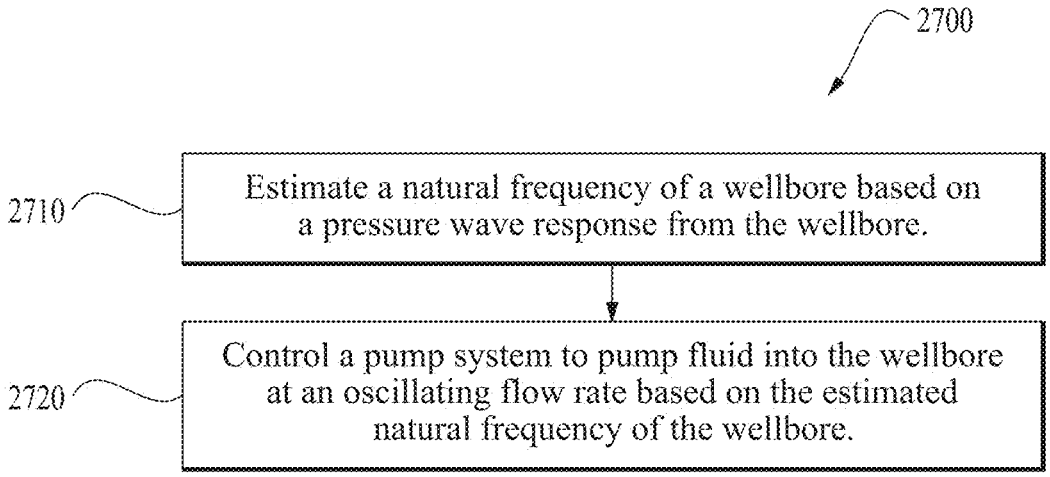
FIG. 27 is an exemplary method for hydraulic fracturing, according to an embodiment.

Referring to FIG. 27, a method 2700 for hydraulic fracturing may include the step 2710 of estimating a natural frequency of a wellbore based on a pressure wave response from the wellbore; and the step 2720 of controlling a pump system to pump fluid into the wellbore at an oscillating flow rate based on the estimated natural frequency of the wellbore.

In some embodiments, the pressure wave response is caused by sweeping a frequency of the oscillating flow rate across the natural frequency of the wellbore. As fractures develop, the natural frequency of the wellbore may change. The natural frequency of the wellbore may be thought of as the natural frequency of the wellbore plus its surroundings (e.g., the formation). Also, at different stages of wellbore development, the natural frequency may change. The method may further include re-estimating the natural frequency of the wellbore, and adjusting a frequency of the oscillating flow rate based on the re-estimated natural frequency. That is, there may be a control loop (see FIG. 3) for adjusting the oscillation of the pump system based on pressure response from the wellbore. The controlling of the pump system may further include setting a frequency of the oscillating flow rate within a range (e.g., 1, 5, 10, 20, 30, or 50%) of the natural frequency of the wellbore or a harmonic of the natural frequency of the wellbore. In some embodiments, the controller may control the pump to pump fluid at the oscillating flow rate by controlling a variable frequency drive, which may drive the pump to execute the oscillating flow rate.

Referring to FIG. 8, a system 100 for hydraulic fracturing may include a first pump system 137 (e.g., left pump system 137) fluidly coupled to a first wellbore 105 (e.g., left wellbore 105); a second pump system 137 (e.g., right pump system 137) fluidly coupled to a second wellbore 105 (e.g., right wellbore); and a controller (e.g., processor 125) configured to estimate a natural frequency of the first wellbore 105 based on a pressure wave response from the first wellbore or a pressure wave response from the second wellbore 105, control the first pump system 137 to pump fluid into the first wellbore 105 at a first oscillating flow rate based on the estimated natural frequency of the first wellbore 105, and control the second pump system 137 to pump fluid into the second wellbore 105 at a second oscillating flow rate based on the first oscillating flow rate or the pressure wave response from the second wellbore 105 (e.g., based on a natural frequency of the second wellbore 105 estimated based on the pressure wave response from the second wellbore 105).

In some embodiments, the natural frequency of the first wellbore 105 is estimated solely based on the pressure wave response from the second wellbore 105, which may be adjacent to and/or in acoustic/seismic communication with the first wellbore. If the two wellbores 105 are similar in geometry and are treated with a similar fluid composition, the natural frequency of the first wellbore 105 may be estimated to be the same as the natural frequency of the second wellbore 105. However, if the two wellbores 105 are geometrically dissimilar and/or are treated with different fluid compositions, the natural frequency of the first wellbore may be estimated by compensating for the geometric dissimilarity and the different in treatment fluid. For example, since the natural frequency is inversely proportional to the measured depth of a stage, the natural frequency of the first wellbore may be corrected by $f2=f1*d2/d1$ where f1 is the natural frequency of the first wellbore, and d1, d2 are the measured depth of the hydraulic fracturing stages in the first and second wellbore, respectively.

The pressure wave response may be a reflection of a pressure wave generated by the pump system 137 off the wellbore. It may be detected by a downhole sensor and/or by the wellhead sensor 153. In various embodiments, the natural frequency of the first pump system 137 may be estimated only based on the pressure wave response from the first wellbore 105, only based on the pressure wave response from the second wellbore 105, or based on both the pressure wave response from the first wellbore 105 and the pressure wave response from the second wellbore 105. For example, the controller may average the pressure wave response frequencies from the first and second wellbores and then base the flow rate oscillation of the first pump system 137 and the second pump system 137 on the averaged pressure rate response. In this scenario, it may still be said that the second pump system's 137 oscillation frequency is based on the first pump system's 137 oscillation frequency.

The controller may be further configured to control the second pump system 137 to pump fluid into the second wellbore 105 at the second oscillating flow rate based on the estimated natural frequency of the second wellbore 105. In some embodiments, the second oscillating flow rate is based on the first oscillating flow rate such that a frequency of the first oscillating flow rate is the same as a frequency of the second oscillating flow rate, the frequency of the first oscillating flow rate is a multiple of the frequency of the second oscillating flow rate, or the frequency of the second oscillating flow rate is a multiple of the frequency of the first oscillating flow rate. The first oscillating flow rate may be in sync with the second oscillating flow rate. Having the first oscillation flow rate in sync with the second oscillation flow rate may present the advantage of more effectively fatiguing a common formation of the two wellbores 105 (e.g., by constructive interference of the waves). Alternatively, the first oscillating flow rate may be phase shifted with respect to the second oscillating flow rate. Having the first oscillating flow rate phase shifted (e.g., 180 degrees) with respect to the second oscillating flow rate may present the advantage of avoiding stressing or overloading the power supply 142 (e.g., exceeding the stiffness of the power supply 142, (e.g., a maximum rate of change of power the power supply 142 is capable of providing)).

Figure 28:
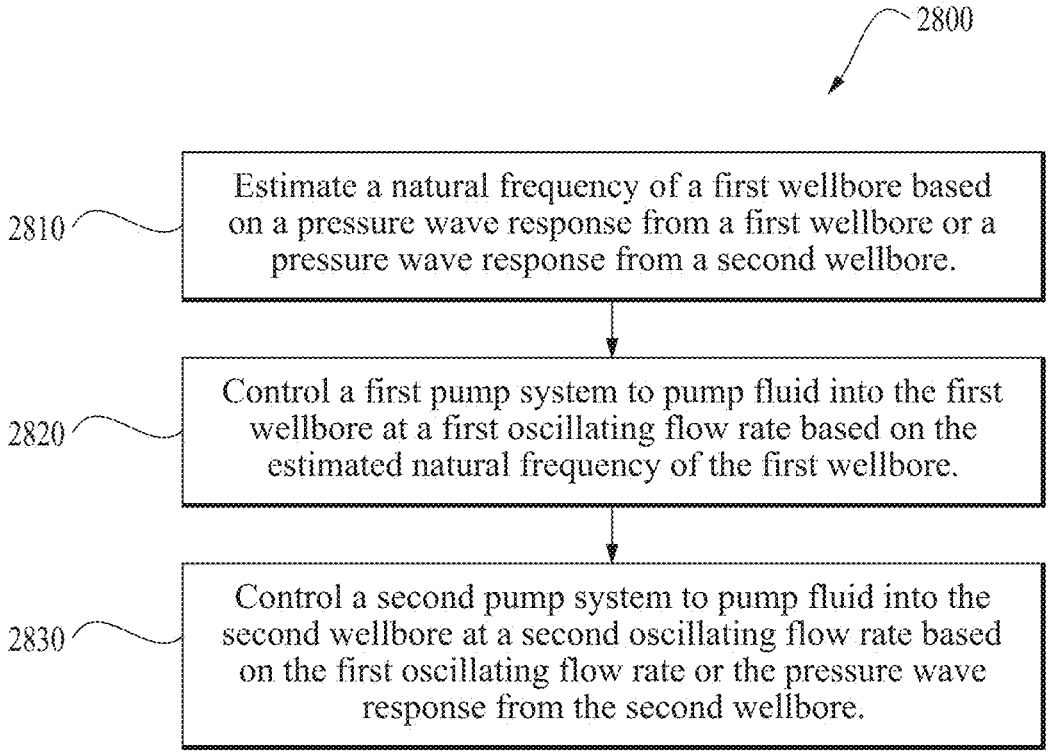
FIG. 28 is an exemplary method for hydraulic fracturing, according to another embodiment.

Referring to FIG. 28, a method 2800 for hydraulic fracturing may include the step 2810 of estimating a natural frequency of a first wellbore based on a pressure wave response from a first wellbore or a pressure wave response from a second wellbore; the step 2820 of controlling a first pump system to pump fluid into the first wellbore at a first oscillating flow rate based on the estimated natural frequency of the first wellbore; and the step 2830 of controlling a second pump system to pump fluid into the second wellbore at a second oscillating flow rate based on the first oscillating flow rate or the pressure wave response from the second wellbore (e.g., based on the natural frequency of the second wellbore estimated based on the pressure wave response from the second wellbore).

In some embodiments, the first pump system is on a pad and the second pump system is on the same pad. In other embodiments, the first pump system is on a first pad and the second pump system is on a second pad spaced apart from the first pad. The estimating of the natural frequency of the first wellbore may comprise detecting a period of a pressure response from the first wellbore, detecting a period of a pressure response from the second wellbore, or averaging a detected period of a pressure response from the first wellbore and a detected period of a pressure response from the second wellbore. Controlling the first pump system to pump fluid into the first wellbore at the first oscillating flow rate based on the estimated natural frequency of the first wellbore may comprise controlling the first pump system to sweep a flow rate oscillation frequency across the estimated natural frequency of the first wellbore, controlling the first pump system to output a flow oscillation at a frequency matching the estimated natural frequency of the first wellbore, or controlling the first pump system to output a pressure oscillation at a frequency sufficiently close to the natural frequency of the first wellbore to excite the first wellbore at its resonant frequency. Controlling the second pump system to pump fluid into the second wellbore at the second oscillating flow rate based on the first oscillating flow rate may comprise setting the second oscillating flow rate to match or approximate the first oscillating flow rate or a harmonic of the first oscillating flow rate. The first oscillating flow rate may be in sync with or at a phase shift with respect to the second oscillating flow rate depending on the application.

The systems and methods disclosed herein may provide the advantage of being able to effectively fracture and diagnose the fracture. In some embodiments, this is advantageously performed simultaneously; feedback about the degree of the fracture is continuously or periodically received and is used to determine how to adjust the method of hydraulic fracturing. The systems and methods disclosed herein may also provide the advantage of being able to execute complex waveforms with sudden changes (e.g., pulses for diagnostics) without overloading the power supply. The systems and methods disclosed herein may also provide the advantage of being able to more effectively fracture a formation as compared with the conventional art by using a sweeping pressure waveform about a natural frequency of the formation. The system and methods disclosed herein may also provide the advantage of executing pressure and/or flow rate changes using electric pumps that would normally exceed a stiffness of a power supply by using the same power supply for electric pumps of different wells wherein a combined rate of change in power demand of the electric pumps is within the capability of the power supply to accommodate. The system and methods disclosed herein may also provide the advantage of executing flow rate changes using electric pumps that would normally exceed the capability of a fluid supply to accommodate by using the same fluid supply for electric pumps of different wells wherein a combined rate of change in fluid demand of the electric pumps is within the capability of the fluid supply to accommodate.

Additional Disclosure

The following are non-limiting, specific embodiments in accordance with the present disclosure:

In a first embodiment, a system for monitoring hydraulic fracturing of a well includes an apparatus configured to generate a pressure wave in a wellbore of the well, wherein the pressure wave causes a response from a formation surrounding the wellbore; a sensor configured to detect the response, and output a signal based on the detected response; and a processor configured to receive the signal, and analyze the signal to determine a characteristic of the formation, wherein a fracking operation of the well is altered based on the determined characteristic.

A second embodiment can include the system of the first embodiment, wherein the pressure wave is a pulse.

A third embodiment can include the system of the first or second embodiments, wherein the response is a pressure response that propagates through fluid in the wellbore.

A fourth embodiment can include the system of any of the first through third embodiments, wherein the pressure response is caused by the pressure wave reflecting off of the formation.

A fifth embodiment can include the system of any of the first through fourth embodiments, wherein the apparatus comprises an electrical power generator, a pump, a blender, a manifold, a flow-pulsing device, or a flow control device.

A sixth embodiment can include the system of any of the first through fifth embodiments, wherein the apparatus comprises an electrically driven pump, and the pressure wave is generated by modulating a flow rate output by the electrically driven pump.

A seventh embodiment can include the system of any of the first through sixth embodiments, wherein each electrically driven pump is electrically coupled to a plurality of generators (e.g., a first electrically pump is connected to a first, second, and third generator, and a second electrically driven pump is connected to a fourth, fifth, and sixth generator.

A seventh embodiment can include the system of any of the first through sixth embodiments, wherein the apparatus comprises an engine driven pump, and the pressure wave is generated by modulating a flow rate output by the engine driven pump.

An eight embodiment can include the system of any of the first through seventh embodiments, wherein the apparatus comprises an engine driven pump disposed at a surface of the well and an electric driven pump disposed at the surface of the well, and wherein a combined output of the engine driven pump and the electric driven pump forms the pressure wave.

A ninth embodiment can include the system of any of the first through eighth embodiments, wherein the pressure wave is at a natural frequency of the formation.

A tenth embodiment can include the system of any of the first through ninth embodiments, wherein the pressure wave is generated by modulating amplitude, frequency, phase-shift, rate-of-change flow, wave form shape, duration, or period.

An eleventh embodiment can include the system of any of the first through tenth embodiments, wherein the apparatus is disposed at a surface of the well, the formation is disposed proximate to a horizontal portion of the wellbore, and the apparatus is configured to fracture the formation.

A twelfth embodiment can include the system of any of the first through eleventh embodiments, wherein the processor is further configured to analyze the signal by comparing the signal to a model, and control a rate at which the apparatus injects fluid into the well based on a result of the comparison.

A thirteenth embodiment can include the system of any of the first through twelfth embodiments, wherein the characteristic is a degree of fracturing of the formation.

A fourteenth embodiment can include the system of any of the first through thirteenth embodiments, wherein the apparatus comprises an electrically driven pump and an engine driven pump, and the processor is further configured to control the electrically driven pump such that a flow rate change of the electrically driven pump causes a current consumption rate of change that is less than a maximum current rate of change the power supply is capable of providing, and control the engine driven pump such that a flow rate change of the engine driven pump occurs concurrently with the flow rate change of the electrically driven pump.

In a fifteenth embodiment, a system for sending a diagnostic pressure signal into a well comprises an electrically driven pump fluidly coupled to a wellbore of the well; a power supply electrically coupled to the electrically driven pump; an engine driven pump fluidly coupled to the wellbore; and a processor configured to control the electrically driven pump such that a flow rate change of the electrically driven pump causes a current consumption rate of change that is less than a maximum current rate of change the power supply is capable of providing, and control the engine driven pump such that a flow rate change of the engine driven pump occurs concurrently with the flow rate change of the electrically driven pump, or alternatively, the processor is configured to control the electrically driven pump to output a pressure oscillation such that a maximum rate of change of current demanded/consumed by the electrically driven pump during the oscillation is less than a maximum rate of change of current the power supply is capable of providing, and control the engine driven pump to output a pressure pulse during the oscillation A sixteenth embodiment can include the system of the fifteenth embodiment, wherein the power supply comprises a gas turbine generator.

A seventeenth embodiment can include the system of the fifteenth or sixteenth embodiments, wherein the power supply comprises a power grid.

An eighteenth embodiment can include the system of any of the fifteenth through seventeenth embodiments, wherein the flow rate change of the electrically driven pump is a flow rate increase of the electrically driven pump, the flow rate change of the engine driven pump is a flow rate increase of the engine driven pump, and the current rate of change is a current increase per time.

A nineteenth embodiment can include the system of any of the fifteenth through eighteenth embodiments, wherein the flow rate change of the electrically driven pump is a flow rate decrease of the electrically driven pump, and the flow rate change of the engine driven pump is a flow rate decrease of the engine driven pump, and the current rate of change is a current decrease per time.

A twentieth embodiment can include the system of any of the fifteenth through nineteenth embodiments, wherein the decrease in flow rate of the engine driven pump is caused by a decoupling (e.g. shifting transmission to neutral) of the engine driven pump.

A twenty-first embodiment can include the system of any of the fifteen through twentieth embodiments, wherein the maximum current rate of change is a maximum current rate of change that the power supply is capable of providing without a voltage sag beyond a specified tolerable limit.

A twenty-second embodiment can include the system of any of the fifteenth through twenty-first embodiments, wherein the maximum current rate of change is a maximum current rate of change that the power supply is capable of tolerating without an overvoltage.

A twenty-third embodiment can include the system of any of the fifteenth through twenty-second embodiments, wherein the maximum current rate of change is a maximum current rate of change that the power supply is capable of providing without causing a brown out of the power supply.

A twenty-fourth embodiment can include the system of any of the fifteenth through twenty-third embodiments, wherein the maximum current rate of change is a maximum current rate of change that the power supply is capable of providing without causing a black out of the power supply.

A twenty-fifth embodiment can include the system of any of the fifteenth through twenty-fourth embodiments, wherein the flow rate change of the electrically driven pump and the flow rate change of the engine driven pump generates a pressure wave in the wellbore.

A twenty-sixth embodiment can include the system of any of the fifteenth through twenty-fifth embodiments, wherein the pressure wave/oscillation is for fracturing a formation surrounding the wellbore.

A twenty-seventh embodiment can include the system of any of the fifteenth through twenty-sixth embodiments, wherein the pressure wave/pulse is for diagnosing a formation surrounding the wellbore.

A twenty-eighth embodiment can include the system of any of the fifteenth through twenty-seventh embodiments, wherein the pressure wave is a pulse.

A twenty-eighth embodiment can include the system of any of the fifteenth through twenty-eighth embodiments, wherein the pressure wave causes a response from a formation surrounding the wellbore, the system further comprises a sensor configured to detect the response, and output a signal based on the detected response, and the processor is further configured to receive the signal, and analyze the signal to determine a characteristic of the formation, wherein a fracking operation of the well is altered based on the determined characteristic.

In a twenty-ninth embodiment, a system for hydraulic fracturing comprises a pump configured to pump fluid in a wellbore of a well to fracture a formation surrounding a horizontal portion of the wellbore; and a processor configured to control an oscillation of a flow rate of the pump to alternate between a first frequency and a second frequency, wherein the first frequency is below a natural frequency of the formation and the second frequency is above the natural frequency of the formation.

A thirtieth embodiment can include the system of the twenty-ninth embodiment, wherein the increase from the first frequency to the second frequency occurs over a duration, wherein the duration is greater than one hour.

A thirty-first embodiment can include the system of the twenty-ninth embodiment or the thirtieth embodiment, wherein the oscillation has a period of greater than ten seconds and less than one minute.

A thirty-second embodiment can include the system of any of the twenty-ninth through thirty-first embodiments, wherein the system further comprises a sensor disposed in the wellbore and configured to detect a response to the oscillation of the flow rate, and wherein the processor is further configured to estimate the natural frequency of the formation based on the detected response, and control the pump to match the estimated natural frequency of the formation.

A thirty-third embodiment can include the system of any of the twenty-ninth through thirty-second embodiments, wherein the processor is further configured to control the pump to add a pulse to the oscillation, wherein the system further comprises a sensor disposed in the wellbore and configured to detect a response to the pulse, and wherein the processor is further configured to estimate the natural frequency of the formation based on the detected response, and the control pump to match the estimated natural frequency of the formation.

A thirty-fourth embodiment can include the system of any of the twenty-ninth through thirty-third embodiments, wherein the oscillation comprises a sine wave.

A thirty-fifth embodiment can include the system of any of the twenty-ninth through thirty-fourth embodiments, wherein the pulse is a square pulse.

A thirty-sixth embodiment can include the system of any of the twenty-ninth through thirty-fifth embodiments, wherein the pulse is a triangle pulse.

A thirty-seventh embodiment can include the system of any of the twenty-ninth through thirty-sixth embodiments, wherein the pulse is a saw pulse.

A thirty-eighth embodiment can include the system of any of the twenty-ninth through thirty-seventh embodiments, wherein the pulse occurs over a duration of less than one minute.

A thirty-ninth embodiment can include the system of any of the twenty-ninth through thirty-eighth embodiments, wherein the pulse occurs over a duration of less than one second.

A fortieth embodiment can include the system of any of the twenty-ninth through thirty-ninth embodiments, wherein the pulse is caused at least in part by a transmission clutch of an engine driven pump disengaging.

A forty-first embodiment can include the system of any of the twenty-ninth through fortieth embodiments, wherein the pump is an electric driven pump.

A forty-second embodiment can include the system of any of the first through twelfth embodiments, wherein the apparatus comprises an electrically driven pump, and the pulse is generated by increasing a number of generators supplying power to the electrically driven pump.

A forty-third embodiment can include the system of any of the first through twelfth embodiments, wherein the apparatus comprises electrically driven pumps, and the pulse is generated by ramping up a flow rate of the electrically driven pumps by increasing an amount of available power to the electrically driven pumps by 200% or more.

In a forty-fourth embodiment, a system for hydraulic fracturing with a modulating flow rate includes a first electric pump system electrically coupled to a power supply and configured to pump fluid down one or more first wellbores; a second electric pump system electrically coupled to the power supply and configured to pump fluid down one or more second wellbores; and a controller configured to control the first electric pump system to increase a flow rate of the first electric pump system and concurrently control the second electric pump system to decrease a flow rate of the second electric pump system such that a combined rate of change of electric power demand of the first electric pump system and the second electric pump system is less than a stiffness of the power supply. In some embodiments, the power supply comprises any one or any combination of any two or more of a power grid, an electric generator, a load bank, and an energy storage system. In some embodiments, the fluid is proppant free, the first wellbore is fracked with proppant before the increase of the flow rate and the decrease of the flow rate, and the second wellbore is fracked with proppant before the increase in the flow rate and the decrease of the flow rate.

A forty-fifth embodiment can include the system of the forty-fourth embodiment, wherein the first electric pump system comprises a plurality of first electric pumps, and the second electric pump system comprises a plurality of second electric pumps.

A forty-sixth embodiment can include the system of the forty-fourth embodiment or the forty-fifth embodiments, wherein the rate of change of electric power demand of the first electric pump system exceeds the stiffness of the power supply, and the rate of change of electric power demand of the second electric pump system exceeds the stiffness of the power supply.

A forty-seventh embodiment can include the system of any of the forty-fourth through forty-sixth embodiments, wherein an absolute value of the rate of change of electric power demanded by the first electric pump system is within 10% of an absolute value the rate of change of electric power demanded by the second electric pump system at all points during the increase in the flow rate of the first electric pump system and the decrease in the flow rate of the second electric pump system.

A forty-eighth embodiment can include the system of any of the forty-fourth through forty-seventh embodiments, wherein the increase in the flow rate of the first electric pump is part of a flow rate oscillation executed by the first electric pump, and the decrease in the flow rate of the second electric pump is part of a flow rate oscillation executed by the second electric pump.

A forty-ninth embodiment can include the system of any of the forty-fourth through forty-eighth embodiments, wherein the increase in the flow rate of the first electric pump is part of a pressure pulse executed by the first electric pump, and the decrease in the flow rate of the second electric pump is part of a pressure pulse executed by the second electric pump.

A fiftieth embodiment can include the system of any of the forty-fourth through forty-ninth embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A fifty-first embodiment can include the system of any of the forty-fourth through fiftieth embodiments, wherein a flow waveform of the second group of electric pumps corresponds to a flow waveform of the third group of electric pumps.

A fifty-second embodiment can include the system of any of the forty-fourth through fifty-first embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A fifty-third embodiment can include the system of any of the forty-fourth through fifty-second embodiments, wherein a flow waveform of the first group of electric pumps corresponds to a flow output of the second group of electric pumps, and a flow waveform of the third group of electric pumps corresponds to a flow output of the fourth group of electric pumps.

A fifty-fourth embodiment can include the system of any of the forty-fourth through fifty-third embodiments, wherein the increase in the flow rate of the first electric pump system is simultaneous with the decrease in the flow rate of the second electric pump system.

A fifty-fifth embodiment can include the system of any of the forty-fourth through fifty-fourth embodiments, wherein the controller is further configured to control the first electric pump system to decrease the flow rate of the first electric pump system and concurrently control the second electric pump system to increase a flow rate of the second electric pump system such that the combined rate of change of electric power demanded by the first electric pump system and the second electric pump system is less than a stiffness of the power supply.

A fifty-sixth embodiment can include the system of any of the forty-fourth through fifty-fifth embodiments, wherein the decrease in the flow rate of the first electric pump system is simultaneous with the increase in the flow rate of the second electric pump system.

A fifty-seventh embodiment can include the system of any of the forty-fourth through fifty-sixth embodiments, wherein the power supply comprises a power plant.

A fifty-eighth embodiment can include the system of any of the forty-fourth through fifty-seventh embodiments, wherein the power supply comprises engine-driven generators.

A fifty-ninth embodiment can include the system of any of the forty-fourth through fifty-eighth embodiments, wherein the first electric pump system and the second electric pump system are fluidly coupled to a common fluid supply.

A sixtieth embodiment can include the system of any of the forty-fourth through fifty-ninth embodiments, wherein a combined rate of change of the flow rate of the first electric pump system and the second electric pump system is less than a stiffness of the fluid supply.

A sixty-first embodiment can include the system of any of the forty-fourth through sixtieth embodiments, wherein a maximum rate of change of the flow rate of the first electric pump system during the increase of the flow rate of the first electric pump system exceeds the stiffness of the fluid supply, and a maximum rate of change of the flow rate of the second electric pump system during the decrease of the flow rate of the second electric pump system exceeds the stiffness of the fluid supply.

A sixty-second embodiment can include the system of any of the forty-fourth through sixty-first embodiments, wherein the fluid supply comprises a blender.

In a sixty-third embodiment, a method for hydraulic fracturing with a modulating flow rate includes controlling a first electric pump system to increase a flow rate of the first electric pump system and concurrently controlling a second electric pump system to decrease a flow rate of the second electric pump system such that a combined rate of change of electric power demand of the first electric pump system and the second electric pump system is less than a stiffness of the power supply, wherein the first electric pump system is electrically coupled to a power supply and fluidly coupled to one or more first wellbores, and wherein a second electric pump system is electrically coupled to the power supply and fluidly coupled to one or more second wellbores.

In a sixty-fourth embodiment, a system for hydraulic fracturing with an oscillating flow rate comprises a first electric pump system electrically coupled to a power supply and configured to pump fluid down one or more first wellbores; a second electric pump system electrically coupled to the power supply and configured to pump fluid down one or more second wellbores; and a controller configured to control the first electric pump system to oscillate a flow rate of the first electric pump system and control the second electric pump system to oscillate a flow rate of the second electric pump system such that there is a phase shift between the oscillation of the flow rate of the first electric pump system and the oscillation of the flow rate of the second electric pump system.

A sixty-fifth embodiment can include the system of the sixty-fourth embodiment, wherein the phase shift prevents a combined rate of change of power demand of the first electric pump system and the second electric pump system from exceeding a stiffness of the power supply.

A sixty-sixth embodiment can include the system of the sixty-fourth or sixty-fifth embodiments, wherein a maximum rate of change of power demand of the first electric pump system during the oscillation of the flow rate of the first electric pump system exceeds the stiffness of the power supply, and a maximum rate of change of power demand of the second electric pump system during the oscillation of the flow rate of the second electric pump system exceeds the stiffness of the power supply.

A sixty-seventh embodiment can include the system of any of the sixty-fourth through sixty-sixth embodiments, wherein the phase shift is 180 degrees.

A sixty-eighth embodiment can include the system of any of the sixty-fourth through sixty-sixth embodiments, wherein the phase shift is 160 to 200 degrees.

A sixty-ninth embodiment can include the system of any of the sixty-fourth through sixty-eighth embodiments, wherein the oscillation of the flow rate of the first electric pump system comprises a first sine wave, and the oscillation of the flow rate of the electric pump system comprises a second sine wave.

A seventieth embodiment can include the system of any of the sixty-fourth through sixty-ninth embodiments, wherein an amplitude of the first sine wave is the same as an amplitude of the second sine wave.

A seventy-first embodiment can include the system of any of the sixty-fourth through seventieth embodiments, wherein the oscillation of the flow rate of the first electric pump system comprises a first square wave, and the oscillation of the flow rate of the electric pump system comprises a second square wave.

A seventy-second embodiment can include the system of any of the sixty-fourth through seventy-first embodiments, wherein an amplitude of the first square wave is the same as an amplitude of the second square wave.

A seventy-third embodiment can include the system of any of the sixty-fourth through seventy-second embodiments, wherein an absolute value of the rate of change of electric power demanded by the first electric pump system is within 10% of an absolute value of the rate of change of electric power demanded by the second electric pump system at all points during the oscillation in the flow rate of the first electric pump system and the oscillation in the flow rate of the second electric pump system.

A seventy-fourth embodiment can include the system of any of the sixty-fourth through seventy-third embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A seventy-fifth embodiment can include the system of any of the sixty-fourth through seventy-fourth embodiments, wherein a flow waveform of the second group of electric pumps corresponds to a flow waveform of the third group of electric pumps.

A seventy-sixth embodiment can include the system of any of the sixty-fourth through seventy-fifth embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A seventy-seventh embodiment can include the system of any of the sixty-fourth through seventy-sixth embodiments, wherein a flow waveform of the first group of electric pumps corresponds to a flow waveform of the second group of electric pumps, and a flow waveform of the third group of electric pumps corresponds to a flow waveform of the fourth group of electric pumps.

A seventy-eighth embodiment can include the system of any of the sixty-fourth through seventy-seventh embodiments, wherein a decrease in the flow rate of the first electric pump system is simultaneous with an increase in the flow rate of the second electric pump system.

A seventy-ninth embodiment can include the system of any of the sixty-fourth through seventy-eighth embodiments, wherein the power supply comprises a power plant.

An eightieth embodiment can include the system of any of the sixty-fourth through seventy-ninth embodiments, wherein the power supply comprises engine-driven generators.

An eighty-first embodiment can include the system of any of the sixty-fourth through eightieth embodiments, wherein the first electric pump system and the second electric pump system are fluidly coupled to a common fluid supply.

An eighty-second embodiment can include the system of any of the sixty-fourth through eighty-first embodiments, wherein the phase shift prevents a combined rate of change of flow rate of the first electric pump system and the second electric pump system from exceeding a stiffness of the fluid supply.

An eighty-third embodiment can include the system of any of the sixty-fourth through eighty-second embodiments, wherein a maximum rate of change of flow rate of the first electric pump system during the oscillation of the flow rate of the first electric pump system exceeds the stiffness of the fluid supply, and a maximum rate of change of the flow rate of the second electric pump system during the oscillation of the flow rate of the second electric pump system exceeds the stiffness of the fluid supply.

An eighty-fourth embodiment can include the system of any of the sixty-fourth through eighty-third embodiments, wherein the fluid supply comprises a blender.

In an eighty-fifth embodiment, a method for hydraulic fracturing with an oscillating flow rate comprises controlling a first electric pump system to oscillate a flow rate of the first electric pump system and controlling a second electric pump system to oscillate a flow rate of the second electric pump system such that there is a phase shift between the oscillation of the flow rate of the first electric pump system and the oscillation of the flow rate of the second electric pump system, wherein the first electric pump system is electrically coupled to a power supply and configured to pump fluid down one or more first wellbores, and wherein the second electric pump system is electrically coupled to the power supply and configured to pump fluid down one or more second wellbores.

In an eighty-sixth embodiment, a system for sending pulses into wellbores comprises a first electric pump system electrically coupled to a power supply and configured to pump fluid down one or more first wellbores; a second electric pump system electrically coupled to the power supply and configured to pump fluid down one or more second wellbores; and a controller configured to control the first electric pump system to execute a first positive pulse, control the second electric pump system to execute a first negative pulse concurrently with the first positive pulse.

An eighty-seventh embodiment can include the system of the eighty-sixth embodiment, wherein the controller is further configured to control the first electric pump system to execute a second negative pulse, and control the second electric pump system to execute a second positive pulse concurrently with the second negative pulse.

An eighty-eighth embodiment can include the system of the eighty-sixth or eighty-seventh embodiment, wherein the first positive pulse, the first negative pulse, the second positive pulse, and the second negative pulse are pressure pulses.

An eighty-ninth embodiment can include the system of any of the eighty-sixth through eighty-eighth embodiments, wherein the first positive pulse, the first negative pulse, the second positive pulse, and the second negative pulse are flow rate pulses.

A ninetieth embodiment can include the system of any of the eighty-sixth through eighty-ninth embodiments, wherein the first positive pulse, the first negative pulse, the second positive pulse, and the second negative pulse comprise trapezoidal pulses.

A ninety-first embodiment can include the system of any of the eighty-sixth through ninetieth embodiments, wherein the first positive pulse occurs simultaneously with the first negative pulse, and the second positive pulse occurs simultaneously with the second negative pulse.

A ninety-second embodiment can include the system of any of the eighty-sixth through ninety-first embodiments, wherein the first positive pulse has a same duration as the first negative pulse, and the second positive pulse has a same duration as the second negative pulse.

A ninety-third embodiment can include the system of any of the eighty-sixth through ninety-second embodiments, wherein the first positive pulse is added to an oscillation output by the first electric pump system, and the first negative pulse is added to an oscillation output by the second electric pump system.

A ninety-fourth embodiment can include the system of any of the eighty-sixth through ninety-third embodiments, wherein a combined rate of change of power demand of the first electric pump system and a rate of change of power demand second electric pump system remains less than a stiffness of the power supply during the first positive pulse, the first negative pulse, the second positive pulse, and the second negative pulse.

A ninety-fifth embodiment can include the system of any of the eighty-sixth through ninety-fourth embodiments, wherein the rate of change of power demand of the first electric pump system during at least a portion of the first positive pulse and at least a portion of the second negative pulse is greater than the stiffness of the power supply, and the rate of change of power demand of the second electric pump system during at least a portion of the first negative pulse and at least a portion of the second positive pulse is greater than the stiffness of the power supply.

A ninety-sixth embodiment can include the system of any of the eighty-sixth through ninety-fifth embodiments, wherein the power supply comprises a power plant.

A ninety-seventh embodiment can include the system of any of the eighty-sixth through ninety-sixth embodiments, wherein the power supply comprises engine-driven generators.

A ninety-eighth embodiment can include the system of any of the eighty-sixth through ninety-seventh embodiments, wherein the first electric pump system and the second electric pump system are configured to receive fluid from a common fluid supply.

A ninety-ninth embodiment can include the system of any of the eighty-sixth through ninety-eight embodiments, wherein a rate of change of flow rate of the first electric pump system during the first positive pulse and a rate of change of flow rate of the second electric pump system during the first negative pulse combined is less than a stiffness of the fluid supply.

A one-hundredth embodiment can include the system of any of the eighty-sixth through ninety-ninth embodiments, wherein a maximum rate of change of the flow rate of the first electric pump system during the first positive pulse is greater than the stiffness of the fluid supply, and a maximum rate of change of the flow rate of the second electric pump during the first negative pulse is greater than the stiffness of the fluid supply.

A one-hundred-first embodiment can include the system of any of the eighty-sixth through one-hundredth embodiments, wherein the fluid supply comprises a blender.

A one-hundred-second embodiment can include the system of any of the eighty-sixth through one-hundred-first embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A one-hundred-third embodiment can include the system of any of the eighty-sixth through one-hundred-second embodiments, wherein a flow waveform of the second group of electric pumps corresponds to a flow waveform of the third group of electric pumps.

A one-hundred-fourth embodiment can include the system of any of the eighty-sixth through one-hundred-third embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A one-hundred-fifth embodiment can include the system of any of the eighty-sixth through one-hundred-third embodiments, wherein a flow waveform of the first group of electric pumps corresponds to a flow waveform of the second group of electric pumps, and a flow waveform of the third group of electric pumps corresponds to a flow waveform of the fourth group of electric pumps.

In a one-hundred-sixth embodiment, a method for sending pulses into wellbores comprises controlling a first electric pump system to execute a first positive pulse, and controlling a second electric pump system to execute a first negative pulse concurrently with the first positive pulse, wherein the first electric pump system is electrically coupled to a power supply and configured to pump fluid down one or more first wellbores, and wherein the second electric pump system is electrically coupled to the power supply and configured to pump fluid down one or more second wellbores.

In a one-hundred-seventh embodiment, a system for hydraulic fracturing with a modulating flow rate comprises a first electric pump system electrically coupled to a power supply and fluidly coupled to one or more first wellbores; a second electric pump system electrically coupled to the power supply and fluidly coupled to one or more second wellbores; and a controller configured to control the first electric pump system to increase a flow rate of the first electric pump system and concurrently control the second electric pump system to decrease a flow rate of the second electric pump system such that a combined rate of change of electric power demand of the first electric pump system and the second electric pump system is less than a stiffness of the power supply.

A one-hundred-eighth embodiment can include the system of the one-hundred-seventh embodiment, wherein a rate of change of electric power demand of the first electric pump system individually exceeds the stiffness of the power supply, and a rate of change of electric power demand of the second electric pump system individually exceeds the stiffness of the power supply.

A one-hundred-ninth embodiment can include the system of the one-hundred-seventh or one-hundred-eighth embodiments, wherein the increase in the flow rate of the first electric pump system is part of a flow rate oscillation executed by the first electric pump system, and the decrease in the flow rate of the second electric pump system is part of a flow rate oscillation executed by the second electric pump system.

A one-hundred-tenth embodiment can include the system of any of the one-hundred-seventh through one-hundred-ninth embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A one-hundred-eleventh embodiment can include the system of any of the one-hundred-seventh through one-hundred-tenth embodiments, wherein a flow rate waveform of the second group of electric pumps corresponds to a flow rate waveform of the third group of electric pumps.

A one-hundred-twelfth embodiment can include the system of any of the one-hundred-seventh through one-hundred-eleventh embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A one-hundred-thirteenth embodiment can include the system of any of the one-hundred-seventh through one-hundred-twelfth embodiments, wherein a flow rate waveform of the first group of electric pumps corresponds to a flow rate waveform of the second group of electric pumps, and a flow rate waveform of the third group of electric pumps corresponds to a flow rate waveform of the fourth group of electric pumps.

A one-hundred-fourteenth embodiment can include the system of any of the one-hundred-seventh through one-hundred-thirteenth embodiments, wherein the first electric pump system and the second electric pump system are fluidly coupled to a common fluid supply.

A one-hundred-fifteenth embodiment can include the system of any of the one-hundred-seventh through one-hundred-fourteenth embodiments, wherein a rate of change of the flow rate of the first electric pump system and a rate of change of the flow rate of the second electric pump system combined is less than a stiffness of the fluid supply.

A one-hundred-sixteenth embodiment can include the system of any of the one-hundred-seventh through one-hundred-fifteenth embodiments, wherein a maximum rate of change of the flow rate of the first electric pump system during the increase of the flow rate of the first electric pump system exceeds the stiffness of the fluid supply, and a maximum rate of change of the flow rate of the second electric pump system during the decrease of the flow rate of the second electric pump system exceeds the stiffness of the fluid supply.

A one-hundred-seventeenth embodiment can include the system of any of the one-hundred-seventh through one-hundred-sixteenth embodiments, wherein the power supply comprises any one or any combination of any two or more of a power grid, an electric generator, a load bank, and an energy storage system.

A one-hundred-nineteenth embodiment can include the system of any of the one-hundred-seventh through one-hundred seventeenth embodiments, wherein the fluid is proppant free, the first wellbore is fracked with proppant before the increase of the flow rate and the decrease of the flow rate, and the second wellbore is fracked with proppant before the increase in the flow rate and the decrease of the flow rate.

In a one-hundred-twentieth embodiment, a system for hydraulic fracturing with an oscillating flow rate comprises a first electric pump system electrically coupled to a power supply and fluidly coupled to one or more first wellbores; a second electric pump system electrically coupled to the power supply and fluidly coupled to one or more second wellbores; and a controller configured to control the first electric pump system to oscillate a flow rate of the first electric pump system and control the second electric pump system to oscillate a flow rate of the second electric pump system such that there is a phase shift between the oscillation of the flow rate of the first electric pump system and the oscillation of the flow rate of the second electric pump system.

A one-hundred-twenty-first embodiment can include the system of the one-hundred-twentieth embodiment, wherein the phase shift prevents a combined rate of change of power demand of the first electric pump system and the second electric pump system from exceeding a stiffness of the power supply.

A one-hundred-twenty-second embodiment can include the system of the one-hundred-twentieth or one-hundred-twenty-first embodiments, wherein a maximum rate of change of power demand of the first electric pump system during the oscillation of the flow rate of the first electric pump system individually exceeds the stiffness of the power supply, and a maximum rate of change of power demand of the second electric pump system during the oscillation of the flow rate of the second electric pump system individually exceeds the stiffness of the power supply.

A one-hundred-twenty-third embodiment can include the system of any of the one-hundred-twentieth through one-hundred-twenty-second embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A one-hundred-twenty-fourth embodiment can include the system of any of the one-hundred-twentieth through one-hundred-twenty-third embodiments, wherein a flow rate waveform of the second group of electric pumps corresponds to a flow rate waveform of the third group of electric pumps.

A one-hundred-twenty-fifth embodiment can include the system of any of the one-hundred-twentieth through one-hundred-twenty-fourth embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A one-hundred-twenty-sixth embodiment can include the system of any of the one-hundred-twentieth through one-hundred-twenty-fifth embodiments, wherein a flow rate waveform of the first group of electric pumps corresponds to a flow rate waveform of the second group of electric pumps, and a flow rate waveform of the third group of electric pumps corresponds to a flow rate waveform of the fourth group of electric pumps.

A one-hundred-twenty-seventh embodiment can include the system of any of the one-hundred-twentieth through one-hundred-twenty-sixth embodiments, wherein the first electric pump system and the second electric pump system are fluidly coupled to a common fluid supply.

A one-hundred-twenty-eighth embodiment can include the system of any of the one-hundred-twentieth through one-hundred-twenty-seventh embodiments, wherein the phase shift prevents a rate of change of flow rate of the first electric pump system and a rate of change of flow rate of the second electric pump system combined from exceeding a stiffness of the fluid supply.

A one-hundred-twenty-ninth embodiment can include the system of any of the one-hundred-twentieth through one-hundred-twenty-eighth embodiments, wherein a maximum rate of change of flow rate of the first electric pump system during the oscillation of the flow rate of the first electric pump system individually exceeds the stiffness of the fluid supply, and a maximum rate of change of the flow rate of the second electric pump system during the oscillation of the flow rate of the second electric pump system exceeds the stiffness of the fluid supply.

In a one-hundred-thirtieth embodiment, a system for sending pulses into wellbores comprises a first electric pump system electrically coupled to a power supply and fluidly coupled to one or more first wellbores; a second electric pump system electrically coupled to the power supply and fluidly coupled to one or more second wellbores; and a controller configured to control the first electric pump system to execute a first positive pulse, control the second electric pump system to execute a first negative pulse concurrently with the first positive pulse.

A one-hundred-thirty-first embodiment can include the system of the one-hundred-thirtieth embodiment, wherein the controller is further configured to control the first electric pump system to execute a second negative pulse, and control the second electric pump system to execute a second positive pulse concurrently with the second negative pulse.

A one-hundred-thirty-second embodiment can include the system of the one-hundred-thirtieth or one-hundred-thirty-first embodiment, wherein the first positive pulse, the first negative pulse, the second positive pulse, and the second negative pulse are pressure pulses.

A one-hundred-thirty-third embodiment can include the system of any of the one-hundred-thirtieth through one-hundred-thirty-second embodiment, wherein a rate of change of power demand of the first electric pump system and a rate of change of power demand of the second electric pump system combined remains less than a stiffness of the power supply during the first positive pulse, the first negative pulse, the second positive pulse, and the second negative pulse.

A one-hundred-thirty-fourth embodiment can include the system of any of the one-hundred-thirtieth through one-hundred-thirty-third embodiments, wherein a maximum rate of change of power demand of the first electric pump system during the first positive pulse and the second negative pulse is individually greater than a stiffness of the power supply, and a maximum rate of change of power demand of the second electric pump system during the first negative pulse and the second positive pulse is individually greater than the stiffness of the power supply.

A one-hundred-thirty-fifth embodiment can include the system of any of the one-hundred-thirtieth through one-hundred-thirty-fourth embodiments, wherein the first electric pump system and the second electric pump system are fluidly coupled to a common fluid supply.

A one-hundred-thirty-sixth embodiment can include the system of any of the one-hundred-thirtieth through one-hundred-thirty-fifth embodiments, wherein a maximum rate of change of flow rate of the first electric pump system during the first positive pulse and a maximum rate of change of flow rate of the second electric pump system during the first negative pulse combined is less than a stiffness of the fluid supply.

A one-hundred-thirty-seventh embodiment can include the system of any of the one-hundred-thirtieth through one-hundred-thirty-sixth embodiments, wherein the maximum rate of change of the flow rate of the first electric pump system during the first positive pulse is individually greater than the stiffness of the fluid supply, and the maximum rate of change of the flow rate of the second electric pump system during the first negative pulse is individually greater than the stiffness of the fluid supply.

A one-hundred-thirty-eighth embodiment can include the system of any of the one-hundred-thirtieth through one-hundred-thirty-seventh embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores.

A one-hundred-thirty-ninth embodiment can include the system of any of the one-hundred-thirtieth through one-hundred-thirty-eighth embodiments, wherein a flow rate waveform of the second group of electric pumps corresponds to a flow rate waveform of the third group of electric pumps.

A one-hundred-fortieth embodiment can include the system of any of the one-hundred-thirtieth through one-hundred-thirty-ninth embodiments, wherein the first electric pump system comprises a first group of electric pumps fluidly coupled to a first wellbore of the one or more first wellbores and a second group of electric pumps fluidly coupled to a second wellbore of the one or more first wellbores, and the second electric pump system comprises a third group of electric pumps fluidly coupled to a third wellbore of the one or more second wellbores and a fourth group of electric pumps fluidly coupled to a fourth wellbore of the one or more second wellbores.

A one-hundred-forty-first embodiment can include the system of any of the one-hundred-thirtieth through one-hundred-fortieth embodiments, wherein a flow rate waveform of the first group of electric pumps corresponds to a flow rate waveform of the second group of electric pumps, and a flow rate waveform of the third group of electric pumps corresponds to a flow rate waveform of the fourth group of electric pumps.

In a one-hundred-forty-second embodiment, a method for hydraulic fracturing with a modulating flow rate comprises controlling a first electric pump system to increase a flow rate of the first electric pump system and concurrently controlling a second electric pump system to decrease a flow rate of the second electric pump system such that a combined rate of change of electric power demand of the first electric pump system and the second electric pump system is less than a stiffness of the power supply, wherein the first electric pump system is electrically coupled to a power supply and fluidly coupled to one or more first wellbores, and wherein the second electric pump system is electrically coupled to the power supply and fluidly coupled to one or more second wellbores.

In a one-hundred-forty-third embodiment, a method for hydraulic fracturing with an oscillating flow rate comprises controlling a first electric pump system to oscillate a flow rate of the first electric pump system and controlling a second electric pump system to oscillate a flow rate of the second electric pump system such that there is a phase shift between the oscillation of the flow rate of the first electric pump system and the oscillation of the flow rate of the second electric pump system, wherein the first electric pump system is electrically coupled to a power supply and fluidly coupled to one or more first wellbores, and wherein the second electric pump system electrically coupled to the power supply and fluidly coupled to one or more second wellbores.

In a one-hundred-forty-fourth embodiment, a method for sending pulses into wellbores, comprises controlling a first electric pump system to execute a first positive pulse, and controlling the second electric pump system to execute a first negative pulse concurrently with the first positive pulse, wherein the first electric pump system electrically coupled to a power supply and fluidly coupled to one or more first wellbore, and wherein the second electric pump system electrically coupled to the power supply and fluidly coupled to one or more second wellbores.

A one-hundred-forty-fifth embodiment can include the system or method of any of the forty-fourth through one-hundred-forty-fourth embodiments, wherein stiffness of the power supply is the ability of the power supply to support demand variations without going outside of performance parameters (i.e. voltage and frequency).

A one-hundred-forty-sixth embodiment can include the system or method of any of the forty-fourth through one-hundred-forty-fourth embodiments, wherein stiffness of the fluid supply is a first time derivative of flow rate the fluid supply is capable of providing.

A one-hundred-forty-seventh embodiment can include the system or method of any of the forty-fourth through one-hundred-forty-fourth embodiment, wherein stiffness of the power supply is a first time derivative of power the power supply is capable of providing.

A one-hundred-forty-eighth embodiment can include the system or method of any of the forty-fourth through one-hundred-forty-fourth embodiment, wherein the stiffness of the power supply is tolerance band of the first derivative of power that the power supply is capable of providing (e.g., the tolerance band comprising an upper limit (e.g., a maximum rate of increase of power that the power supply is capable of providing) and a lower limit (e.g., a maximum rate of decrease of power that the power supply is capable of providing)).

In a one-hundred-forty-ninth embodiment, a system for hydraulic fracturing comprises a pump system fluidly coupled to a wellbore; and a controller configured to estimate a natural frequency of the wellbore based on a pressure wave response from the wellbore, and control the pump system to pump fluid into the wellbore at an oscillating flow rate based on the estimated natural frequency of the wellbore.

A one-hundred-fiftieth embodiment can include the system of the one-hundred-forty-ninth embodiment, wherein the pump system comprises one or more electric pumps.

A one-hundred-fifty-first embodiment can include the system of the one-hundred-forty-ninth or one-hundred-fiftieth embodiments, wherein the pump system comprises one or more diesel pumps.

A one-hundred-fifty-second embodiment can include the system of any of the one-hundred-forty-ninth through one-hundred-fifty-second embodiments, wherein the controller is further configured to control the pump system to generate a pressure disturbance that reflects off of the wellbore to cause the pressure wave response from the wellbore.

A one-hundred-fifty-third embodiment can include the system of any of the one-hundred-forty-ninth through one-hundred-fifty-second embodiments, wherein the controller is further configured to generate a treatment schedule based on the estimated natural frequency of the wellbore, wherein the treatment schedule comprises waveshape of the oscillating flow rate, period of the oscillating flow rate, amplitude of the oscillating flow rate, and duration of the oscillating flow rate.

A one-hundred-fifty-fourth embodiment can include the system of any of the one-hundred-forty-ninth through one-hundred-fifty-third embodiments, further comprising a power supply system electrically coupled to the pump system, wherein the controller is further configured to generate the treatment schedule based on a limitation of the power supply system.

A one-hundred-fifty-fifth embodiment can include the system of any of the one-hundred-forty-ninth through one-hundred-fifty-fourth embodiments, further comprising a fluid supply system fluidly coupled to the pump system, wherein the controller is further configured to generate the treatment schedule based on a limitation of the fluid supply system.

A one-hundred-fifty-sixth embodiment can include the system of any of the one-hundred-forty-ninth through one-hundred-fifty-fifth embodiments, wherein the controller is further configured to modulate the oscillating flow rate to sweep across the estimated natural frequency of the wellbore.

In a one-hundred-fifty-seventh embodiment, a method for hydraulic fracturing comprises estimating a natural frequency of a wellbore based on a pressure wave response from the wellbore; and controlling a pump system to pump fluid into the wellbore at an oscillating flow rate based on the estimated natural frequency of the wellbore.

A one-hundred-fifty-eighth embodiment can include the method of the one-hundred-fifty-seventh embodiment, wherein the pressure wave response is caused by sweeping a frequency of the oscillating flow rate across the natural frequency of the wellbore.

A one-hundred-fifty-ninth embodiment can include the method of the one-hundred-fifty-seventh or one-hundred-fifty-eighth embodiments, further comprising re-estimating the natural frequency of the wellbore, and adjusting a frequency of the oscillating flow rate based on the re-estimated natural frequency.

A one-hundred-sixtieth embodiment can include the method of any of the one-hundred-fifty-seventh through one-hundred-fifty ninth embodiments, wherein the controlling of the pump system further comprises setting a frequency of the oscillating flow rate within 10% of the natural frequency of the wellbore or a harmonic of the natural frequency of the wellbore.

In a one-hundred-sixty-first embodiment, a system for hydraulic fracturing comprises a first pump system fluidly coupled to a first wellbore; a second pump system fluidly coupled to a second wellbore; and a controller configured to estimate a natural frequency of the first wellbore based on a pressure wave response from the first wellbore or a pressure wave response from the second wellbore, control the first pump system to pump fluid into the first wellbore at a first oscillating flow rate based on the estimated natural frequency of the first wellbore, and control the second pump system to pump fluid into the second wellbore at a second oscillating flow rate based on the first oscillating flow rate or the pressure wave response from the second wellbore.

A one-hundred-sixty-second embodiment can include the system of the one-hundred-sixty-first embodiment, wherein the controller is further configured to control the second pump system to pump fluid into the second wellbore at the second oscillating flow rate based on the estimated natural frequency of the second wellbore.

A one-hundred-sixty-third embodiment can include the system of the one-hundred-sixty-first or one-hundred-sixty second embodiments, wherein a frequency of the first oscillating flow rate is the same as a frequency of the second oscillating flow rate, the frequency of the first oscillating flow rate is a multiple of the frequency of the second oscillating flow rate, or the frequency of the second oscillating flow rate is a multiple of the frequency of the first oscillating flow rate.

A one-hundred-sixty-fourth embodiment can include the system of any of the one-hundred-sixty-first through one-hundred-sixty-third embodiments, wherein the first oscillating flow rate is in sync with the second oscillating flow rate.

A one-hundred-sixty-fifth embodiment can include the system of any of the one-hundred-sixty-first through one-hundred-sixty-fourth embodiments, wherein the first oscillating flow rate is phase shifted with respect to the second oscillating flow rate.

In a one-hundred-sixty-sixth embodiment, a method for hydraulic fracturing comprises estimating a natural frequency of a first wellbore based on a pressure wave response from a first wellbore or a pressure wave response from a second wellbore; controlling a first pump system to pump fluid into the first wellbore at a first oscillating flow rate based on the estimated natural frequency of the first wellbore; and controlling a second pump system to pump fluid into the second wellbore at a second oscillating flow rate based on the first oscillating flow rate or the pressure wave response from the second wellbore.

A one-hundred-sixty-seventh embodiment can include the method of the one-hundred-sixty-sixth embodiment, wherein the first pump system is on a pad, and the second pump system is on the pad.

A one-hundred-sixty-eighth embodiment can include the method of the one-hundred-sixty-sixth or one-hundred-sixty-seventh embodiment, wherein the first pump system is on a first pad, and the second pump system is on a second pad spaced apart from the first pad.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for hydraulic fracturing, comprising:

a pump system fluidly coupled to a wellbore; and a controller configured to:

estimate a natural frequency of the wellbore based on a pressure wave response from the wellbore;

generate a treatment schedule based on the estimated natural frequency of the wellbore, wherein the treatment schedule comprises a period of an oscillating flow rate, an amplitude of the oscillating flow rate and a duration of the oscillating flow rate, and control the pump system to pump fluid into the wellbore at the oscillating flow rate according to the treatment schedule.

2. The system of claim 1, wherein the pump system comprises one or more electric pumps.

3. The system of claim 1, wherein the pump system comprises one or more diesel pumps.

4. The system of claim 1, wherein the controller is further configured to control the pump system to generate a pressure disturbance that reflects off of the wellbore to cause the pressure wave response from the wellbore.

5. The system of claim 1, wherein the treatment schedule further comprises a waveshape of the oscillating flow rate.

6. The system of claim 1, further comprising a power supply system electrically coupled to the pump system, wherein the controller is further configured to generate the treatment schedule based on a limitation of the power supply system.

7. The system of claim 1, further comprising a fluid supply system fluidly coupled to the pump system, wherein the controller is further configured to generate the treatment schedule based on a limitation of the fluid supply system.

8. The system of claim 1, wherein the controller is further configured to modulate the oscillating flow rate to sweep across the estimated natural frequency of the wellbore.

9. The system of claim 1, wherein the controller is further configured to re-estimate the natural frequency of the wellbore, and adjust a frequency of the oscillating flow rate based on the re-estimated natural frequency.

10. The system of claim 1, wherein the period is set such that a frequency of the oscillating flow rate is within 10% of the natural frequency of the wellbore or a harmonic of the natural frequency of the wellbore.

11. A method for hydraulic fracturing, comprising:

estimating a natural frequency of a wellbore based on a pressure wave response from the wellbore;

controlling a pump system to pump fluid into the wellbore at an oscillating flow rate based on the estimated natural frequency of the wellbore, re-estimating the natural frequency of the wellbore; and adjusting a frequency of the oscillating flow rate based on the re-estimated natural frequency.

12. The method of claim 11, wherein the pressure wave response is caused by sweeping a frequency of the oscillating flow rate across the natural frequency of the wellbore.

13. The method of claim 11, wherein the controlling of the pump system further comprises setting the frequency of the oscillating flow rate within 10% of the natural frequency of the wellbore or a harmonic of the natural frequency of the wellbore.

14. A system for hydraulic fracturing, comprising:

a first pump system fluidly coupled to a first wellbore;

a second pump system fluidly coupled to a second wellbore; and a controller configured to estimate a natural frequency of the first wellbore based on a pressure wave response from the first wellbore or a pressure wave response from the second wellbore, control the first pump system to pump fluid into the first wellbore at a first oscillating flow rate based on the estimated natural frequency of the first wellbore, and control the second pump system to pump fluid into the second wellbore at a second oscillating flow rate based on the first oscillating flow rate or the pressure wave response from the second wellbore.

15. The system of claim 14, wherein the controller is further configured to control the second pump system to pump fluid into the second wellbore at the second oscillating flow rate based on an estimated natural frequency of the second wellbore.

16. The system of claim 14, wherein a frequency of the first oscillating flow rate is the same as a frequency of the second oscillating flow rate, the frequency of the first oscillating flow rate is a multiple of the frequency of the second oscillating flow rate, or the frequency of the second oscillating flow rate is a multiple of the frequency of the first oscillating flow rate.

17. The system of claim 14, wherein the first oscillating flow rate is in sync with the second oscillating flow rate.

18. The system of claim 14, wherein the first oscillating flow rate is phase shifted with respect to the second oscillating flow rate.

19. A method for hydraulic fracturing, comprising:

estimating a natural frequency of a first wellbore based on a pressure wave response from the first wellbore or a pressure wave response from a second wellbore;

controlling a first pump system to pump fluid into the first wellbore at a first oscillating flow rate based on the estimated natural frequency of the first wellbore; and controlling a second pump system to pump fluid into the second wellbore at a second oscillating flow rate based on the first oscillating flow rate or the pressure wave response from the second wellbore.

20. The method of claim 19, wherein the first pump system is on a pad, and the second pump system is on the pad.

21. The method of claim 19, wherein the first pump system is on a first pad, and the second pump system is on a second pad spaced apart from the first pad.

22. A method for hydraulic fracturing, comprising:

estimating a natural frequency of a wellbore based on a pressure wave response from the wellbore; and controlling a pump system to pump fluid into the wellbore at an oscillating flow rate having a frequency within 10% of the natural frequency of the wellbore or a harmonic of the natural frequency of the wellbore.

23. The method of claim 22, further comprising re-estimating the natural frequency of the wellbore, and adjusting the frequency of the oscillating flow rate based on the re-estimated natural frequency.

* * * * *